US005985530A

United States Patent [19]

Ishikawa et al.

[11] Patent Number: 5,985,530

[45] Date of Patent: Nov. 16, 1999

[54] SILVER HALIDE PHOTOGRAPHIC LIGHT SENSITIVE MATERIAL

[75] Inventors: Wataru Ishikawa; Takehiro Kobayashi; Hirohide Ito, all of Hino, Japan

[73] Assignee: Konica Corporation, Japan

[21] Appl. No.: 08/900,997

[22] Filed: Jul. 25, 1997

[30] Foreign Application Priority Data

Aug. 6, 1996 [JP] Japan ..... 8-207190
Aug. 7, 1996 [JP] Japan ..... 8-208286

[51] Int. Cl.[6] ..... G03C 1/035; G03C 1/04

[52] U.S. Cl. ..... 430/531; 430/533; 430/536; 430/537; 430/567; 430/604; 430/627; 430/630; 430/930; 430/961

[58] Field of Search ..... 430/531, 533, 430/536, 537, 567, 604, 627, 630, 930, 961

[56] References Cited

U.S. PATENT DOCUMENTS

| | | | |
|---|---|---|---|
| 4,914,012 | 4/1990 | Kawai | 430/536 |
| 5,550,003 | 8/1996 | Inoue | 430/264 |
| 5,698,385 | 12/1997 | Ousaka et al. | 430/531 |

FOREIGN PATENT DOCUMENTS

| | | |
|---|---|---|
| 0646836 | 5/1995 | European Pat. Off. . |
| 8-201949 | 8/1996 | Japan . |
| 9-061952 | 3/1997 | Japan . |

*Primary Examiner*—John A. McPherson
*Attorney, Agent, or Firm*—Jordan B. Bierman; Bierman, Muserlian and Lucas

[57] ABSTRACT

A silver halide photographic material is disclosed, comprising a support having on one side the support photographic component layers, wherein at least one of the component layers contains a composite polymeric material comprising inorganic particles and a hydrophobic polymer, a silver halide emulsion layer comprising a silver halide emulsion containing silver halide grains having an average chloride content of not less than 60 mol % and containing a metal dopant.

14 Claims, No Drawings

SILVER HALIDE PHOTOGRAPHIC LIGHT SENSITIVE MATERIAL

FIELD OF THE INVENTION

The present invention is related to a silver halide photographic light sensitive material and in particular to an improved silver halide photographic light sensitive material for use in the graphic arts.

BACKGROUND OF THE INVENTION

In the field of scanners for printing plate-making, there have become popular screening systems such as high definition screening or FM screening in which images are formed with smaller halftone dots than conventional halftone screens. For this type of screening system, it is preferable to have an ultra-high contrast type photographic material in which sufficient density of small dots can easily be obtained.

With regard to photographic techniques for reproducing ultra-high contrast images in a silver halide photographic light sensitive material (hereinafter, referred to as photographic material), for example, U.S. Pat. No. 4,269,929 discloses a photographic material containing a hydrazine derivative and JP-A 4-98239 (the term, "JP-A" refers to unexamined, published Japanese Patent Application) discloses a photographic material containing a nucleation accelerating agent.

Photographic materials are generally subject to abrasion during handling or various transporting apparatuses, and in particular, a photographic material used in the graphic arts is likely to produce abrasion marks due to friction from transporting rollers of scanner exposing apparatus or contact with other photographic materials.

Abrasion in films not only produces abrasion marks but also markedly deteriorates qualities of finished originals. In view thereof, an improvement of abrasion resistance has strongly been desired.

In scanner exposing apparatus, a photographic material is generally set into position and transported via rollers. In this case, excessively high curl of the photographic material results in transport troubles. Curl of processed films is desired to be as low as possible to enable the films to be easily handled in subsequent processes, so that it is important to keep the curl of the photographic material, before and after exposure and processing, to the absolutely minimum.

As is well known in the art, for the purpose of minimizing curl due to elongation or shrinkage of the photographic material, a softening agent (e.g., polymer latex) is incorporated in one of gelatin layers to lower the Young modulus of the layer. Further, to minimize cracks or abrasion marks of the film is also a softening agent or plasticizer, and there are disclosed a number of relevant techniques.

The recent trend of more and more rapid processing of photographic materials accelerates the transporting speed of films. Accordingly, physical properties based on prior art have become increasingly insufficient and further improvements are strongly desired. Further, physical properties of films which exhibit less deterioration even when subjected to rapid processing, are also desired.

SUMMARY OF THE INVENTION

It is therefore an object of the present invention to provide a silver halide photographic light sensitive material superior in resistance to abrasion and cracking, with little curl before and after processing and improved handling characteristics It is a further objective to provide a silver halide photographic light sensitive material superior in a drying speed when subjected to rapid processing.

The above objects can be accomplished by the following.

(1) A silver halide photographic light sensitive material comprising a support having on one side thereof component layers including a silver halide emulsion layer and light insensitive hydrophilic colloidal layer, wherein at least one of the component layers contains a composite polymeric material comprising inorganic particles and a hydrophobic polymer, said silver halide emulsion layer comprising a silver halide emulsion containing silver halide grains which have an average chloride content of not less than 60 mol % and contain at least one selected from the group consisting of rhodium (Rh), rhenium (Re), ruthenium (Ru) and osmium (Os).

(2) The silver halide photographic material described in (1), wherein at least one of the component layers contains a hydrazine compound.

(3) The silver halide photographic material described in (2), wherein at least one of the component layers contains a redox DIR compound capable of releasing a development inhibitor upon being oxidized.

(4) The silver halide photographic material described in (1) to (3), wherein a total coating amount of gelatin of the emulsion layer side is not more than 3.6 g per $m^2$ of the photographic material.

(5) The silver halide photographic material described in (1) to (4), wherein the total coating amount of gelatin of the emulsion layer side (A) and a total amount of said composite material in $g/m^2$ (B) meet the following requirement:
$1.0 \leqq A/B \leqq 17.5$.

(6) The silver halide photographic material described in (1), wherein at least one of the component layers contains a lubricant.

(7) The silver halide photographic material described in (1), wherein at least one the component layers contains a water soluble polymer.

(8) The silver halide photographic material described in (1), wherein at least one the component layers contains a latex.

(9) The silver halide photographic material described in (1), wherein at least one the component layers contains an oleophilic compound.

(10) The silver halide photographic material described in (1), wherein at least one the component layers contains a matting agent.

DETAILED DESCRIPTION OF THE INVENTION

The inorganic particles contained in the composite polymeric material of the invention are metal oxides, nitrides and sulfides. Among these, metal oxides are preferable. The metal oxide is preferably an oxide of Na, K, Ca, Ba, Al, Zn, Fe, Cu, Ti, Sn, In, W, Y, Sb, Mn, Ga, V, Nb, Tu, Ag, Bi, B, Mo, Ce, Cd, Mg, Be, Pb, each or composite thereof. Among these oxides, oxide particles of Y, Sn, Ti, Al, V, Sb, In, Mn, Ce, B, Si, each or composite thereof are more preferable in terms of miscibility with a silver halide emulsion.

The metal oxide particles may be crystalline or amorphous. The amorphous metal oxide is preferably used.

The metal oxide particles used in the invention have an average size of 0.5 to 3000 nm, preferably 3 to 500 nm.

Preferably, the metal oxide is dispersed in water or a water soluble solvent.

The metal oxide is contained in an amount of 1 to 2000%, preferably 30 to 1000% by weight of the hydrophobic polymer.

Exemplary examples of preferred metal oxides are shown below.

| | | | | | |
|---|---|---|---|---|---|
| SO-1 | $SiO_2$ | SO-9 | $Al_2O_3$ | SO-17 | $Sb_2O_5$ |
| SO-2 | $TiO_2$ | SO-10 | $BeSiO_4$ | SO-18 | $Nb_2O_5$ |
| SO-3 | ZnO | SO-11 | $Al_2SiO_5$ | SO-19 | $Y_2O_3$ |
| SO-4 | $SnO_2$ | SO-12 | $ZrSiO_5$ | SO-20 | $CeO_2$ |
| SO-5 | MgO | SO-13 | $CaWO_4$ | SO-21 | $Sb_2O_3$ |
| SO-6 | $MnO_2$ | SO-14 | $CaSiO_3$ | SO-22 | $Na_2O$ |
| SO-7 | $Fe_2O_3$ | SO-15 | $InO_2$ | | |
| SO-8 | $ZnSiO_4$ | SO-16 | $SnSbO_2$ | | |

As hydrophobic monomer(s) forming the hydrophobic polymer are cited those including acrylates, methacrylates, vinyl esteres, olefines, stylenes, crotonates, itaconic acid diesters, fumaric acid diesters, maleic acid diesters, allyl compounds, vinyl ethers, vinylketones, vinyl heterocyclic compounds, glycidyl esters, unsaturated nitriles, each or a combination thereof. Among these monomers are preferable acrylates, methacrylates and/or methyl methacrylates, vinyl esters and styrenes, their ester groups each preferably having 6 or more carbon atoms. A hydrophobic monomer having a glycidyl group is preferably used in combination with these hydrophobic monomers, in proportion of at least 1.0 to 20% by weight, preferably 20 to 100% by weight.

In addition, a hydrophilic monomer is preferably copolymerized with the above-described hydrophobic monomers to form the hydrophobic polymer. As examples of the hydrophilic monomers are cited a carboxyl group containing monomer such as acrylic acid, methacrylic acid etc., hydroxy group containing monomer such as hydroxyethylacrylate, alkyleneoxide containing monomer, methacrylamide monomer, sulfonic acid group containing monomer and amino group containing monomer. Among these monomers are preferable a hydroxy group containing monomer, carboxyl group containing monomer, amido group containing monomer and sulfonic acid group containing monomer. These monomers are contained in proportion of 0.1 to 30% by weight, preferably 1 to 20% by weight.

The composite polymer material used in the invention can become one having a cross-linking group by optimally selecting the kind of the above-described hydrophobic monomer and/or hydrophilic monomer, for example, by using a hydrophobic monomer having a cross-linking group , such as carboxyl group, glycidyl group, amino group, amido group or N-methylol group.

The polymer contains preferably an unsaturated monomer having at least two ethylenic group capable of copolymerization. As examples of such monomers are cited ones having two vinyl groups, such as divinylbenzene, ethylene glycol diacrylate, ethylene glycol dimethacrylate, diethylene glycol diacrylate, diethylene glycol dimethacrylate, N,N-methylenebis- acrylamide; ones having three vinyl groups, such as trivinyl cyclohexane, trimethylolpropane triacrylate, trimethylolpropane trimethacrylate, pentaerythritol trimethacrylate; and ones having four vinyl groups, such as pentaerythritol tetraacrylate and pentaerythritol tetramethacrylate.

The composite polymer material used in the invention is preferably in the form of solid particles. The average size of the composite polymer particles is preferably 0.005 to 3.0 μm, more preferably 0.01 to 0.8 μm, furthermore preferably not less than 0.01 and less than 0.5 μm in terms of a weight-averaged grain diameter.

As polymerization methods of the composite polymer can be polymerized are cited an emulsion polymerization method, solution polymerization method, block polymerization, suspension polymerization method and radiation polymerization. In the solution polymerization, a mixture of monomers dissolved in a solvent in a optimal concentration (conventionally, 40 wt. % or less of the solvent, preferably 10 to 25 wt. %) is subjected to polymerization, in the presence of an initiator, at 10 to 200° C. (preferably 30 to 120° C.) for 0.5 to 48 hours (preferably, 2 to 20 hours).

The initiator may be any one which is soluble in a polymerization solvent. As examples thereof are cited organic solvent-soluble initiators including benzoyl peroxide, azobisisobutyronitrile (AIBN), di-tert-butyl peroxide etc.; water-soluble initiators including ammonium persulfate (APS), potassium persulfate, 2,2'-azobis-(2-amidinopropane)-hydrochloride; and redox type initiators, such as the above-described initiator combined with a reducing agent such as $Fe^{2+}$ salts or sodium hydrogencarbonate.

As examples of the solvent are cited water, methanol, ethanol, dimethylsulfoxide, dimethylformamide and dioxane. After completing polymerization, a reaction mixture is poured into a medium which does not dissolve the resulting polymer to have the polymer sedimented. The mixture is dried to remove unreacted residue.

In the emulsion polymerization, water is used as a dispersing medium. Monomers of 10 to 50 wt. % of water, together with a polymerization initiator and a dispersing agent of 0.05 to 5 wt. % and 0.1 to 20 wt. % of the monomer, respectively, are subjected to polymerization at 30 to 100° C. (preferably, 60 to 90° C.) for 3 to 8 hours with stirring to obtain a polymer. The concentration of the monomer, amount of the initiator, reaction temperature and time can be broadly varied.

Examples of the initiator include water soluble peroxides (e.g., potassium persulfate, ammonium persulfate, etc.), water soluble azo compounds (e.g., 2,2'-azobis-(2-amidinopropane)-hydrochloride, etc.), and redox type polymerization initiators by combination of a reducing agent such as $Fe^{2+}$ salt or sodium hydrogensulfite.

As the dispersing agent, any of anionic surfactants, nonionic surfactants, cationic surfactants and amphoteric surfactants may be usable. Anionic or nonionic surfactants are preferable. A water soluble polymer may usable as the dispersing agent. The water soluble polymer includes water soluble synthetic polymer or water soluble natural polymer.

The water soluble synthetic polymer includes ones having, in the molecule, a nonionic group, anionic group, cationic group, both nonionic and anionic groups, both nonionic and cationic groups or both anionic and cationic groups. As the nonionic group is cited an ether group, alkyleneoxide group, hydroxy group, amido group or amino group. As the anionic group is cited carboxylic acid group including its salt, phosphoric acid group including its salt or sulfonic acid group including its salts. As the cationic group is cited quaternary ammonium salt group or tertiary amino group.

The water soluble natural polymer includes ones having, in the molecule, a nonionic group, anionic group, cationic group, both nonionic and anionic groups, both nonionic and cationic groups or both anionic and cationic groups.

As the water soluble polymer which may be a synthetic or natural polymer are preferable ones having an anionic group or both nonionic and anionic groups.

In the invention, the water soluble polymer is referred to as a polymer having solubility to water, of 0.05 g or more, preferably 0.1 g or more per water of 100 g at 20° C. As the synthetic water-soluble polymer is preferable a polymer having a repeating unit represented by the following formula (1) and/or (2), in an amount of 10 to 100% a polymer molecule.

Formula (1)

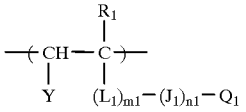

In the formula, $R_1$ represents a hydrogen atom, alkyl group, halogen atom or —$CH_2COOM$ group, preferably an alkyl group having 1 to 4 carbon atoms. $L_1$ represents bivalent linkage group, such as —CONH—, —NHCO—, —COO—, —OCO—, —CO— or —O—. $J_1$ represents an alkylene group, arylene group or polyoxyalkylene group. $Q_1$ represents —OM, —$NH_2$, $SO_3M$, —COOM,

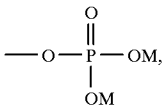

—$COR_2$,

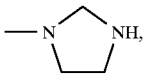

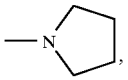

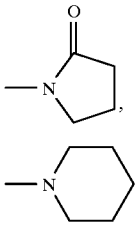

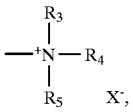

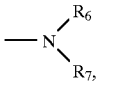

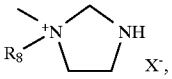

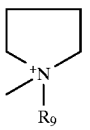

-continued

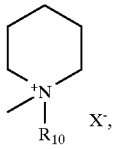

hydrogen atom or $R_3$, and among these are preferable —COOM or —$SO_3M$, more preferable —$SO_3M$. M represents a hydrogen atom or cation (e.g., alkali metal ions, ammonium ion); $R_2$, $R_3$, $R_4$, $R_5$, $R_6$, $R_7$, $R_8$, $R_9$ and $R_{10}$ each represents an alkyl group having 1 to 20 carbon atoms; $X^-$ represents an anion; $m_1$ and $n_1$ each are 0 or 1.

Y represents a hydrogen atom or -$(L_2)m_2$-$(J_2)n_2$-$Q_2$; $L_2$, $J_2$, $Q_2$, m2, $n_2$ are respectively the same as defined $L_1$, $J_1$, $Q_1$, $m_1$, $n_1$.

Formula (II)

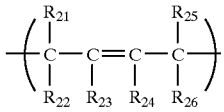

In the formula, $R_{21}$, $R_{22}$, $R_{23}$, $R_{24}$, $R_{25}$ and $R_{26}$ represents a hydrogen atom, alkyl group having 1 to 8 carbon atoms, aryl group having 6 to 20 carbon atoms or —$SO_3X$, in which X represents a hydrogen atom, alkali metal atom, alkaline earth metal atom, ammonium group or amino group, provided that at least one of $R_{21}$, $R_{22}$, $R_{23}$, $R_{24}$ $R_{25}$ and $R_{26}$ is —$SO_3X$.

The synthetic water-soluble polymer having a repeating unit represented by formula (1) and/or (2) may be a homopolymer comprised of the unit represented by formula (1) and/or (2), or may contain further another component.

As examples of said another component are cited acrylates, methacrylates, vinyl esteres, olefines, stylenes, crotonates, itaconic acid diesters, maleic acid diesters, fumaric acid diesters, allyl compounds, vinyl ethers, vinylketones, vinyl heterocyclic compounds, glycidyl esters, unsaturated nitriles, each or a combination thereof. Among these monomers are preferable acrylates, methacrylates and stylenes.

Example of the water-soluble synthetic polymer of formulas (1) and (2) are shown below.

SP-1

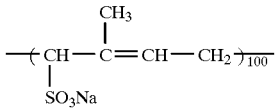

Weight-averaged molecular weight (Mw): 20000

SP-2

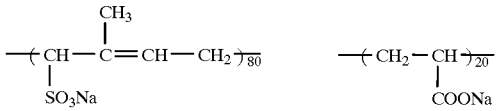

Mw = 30000

-continued

SP-3

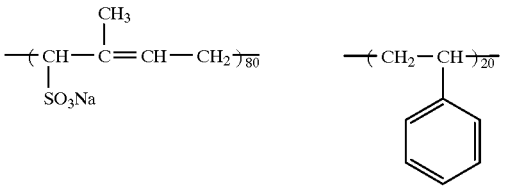

Mw = 40000

SP-4

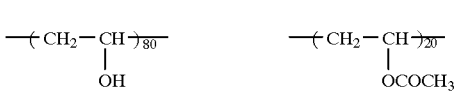

Mw = 40000

SP-5

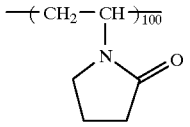

Mw = 9000

SP-6

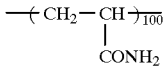

Mw = 20000

SP-7

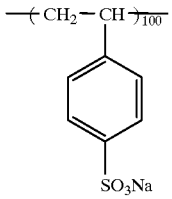

Mw = 10000

SP-8

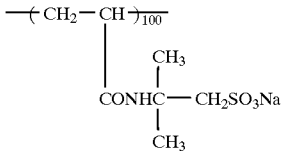

Mw = 20000

SP-9

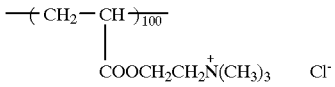

Mw = 10000

SP-10

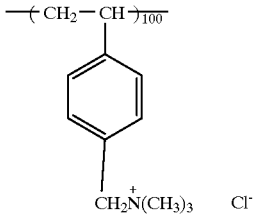

Mw = 150000

-continued

SP-11

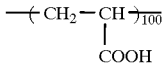

Mw = 40000

SP-12

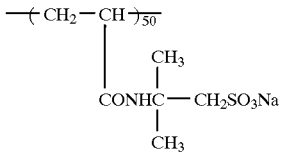

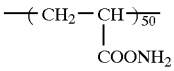

Mw = 40000

SP-13

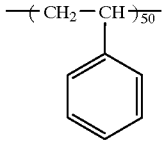

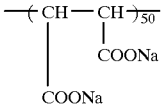

Mw = 5000

SP-14

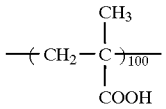

Mw = 20000

The water soluble natural polymer is described in details in Sohgo Gijutsu Shiryo-shu (Keieikaihatsu Center). Preferable examples include lignin, starch, pullulan, cellulose, dextran, dextrin, glycogen, alginic acid, gelatin, collagen, guar gum, gum arabic, laminaran, lichenin, nigran, each or derivative thereof. As derivatives of the water soluble natural polymer are cited sulfonated, carboxylated, phosphated, sulfonalkylenated, carboxyalkylenated or alkylphosphonated ones including salts thereof. Glucose, gelatin, dextran, cellulose, pullulan, glucomannan, dextrin, geran gum, xanthane gum and their derivatives are preferable.

The composite polymer material preferably contains a metal alkoxide compound. Thus, the hydrophobic polymer is polymerized preferably in the presence of the metal alkoxide compound. The metal alkoxide compound includes so-called coupling agents. A variety of the coupling agents, such as silane coupling agent, titanium coupling agent, aluminum coupling agent and zirconium coupling agent are commercially available. Among these are preferable a silane coupling agent and titanium coupling agent.

Examples of preferred metal alkoxide compounds are shown below.

ST-1
$Si(OCH_3)_4$
ST-2
$Ti(OC_3H_7(i))_4$
ST-3
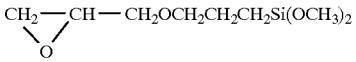
ST-4
$HSCH_2CH_2CH_2Si(OCH_3)_2$
ST-5
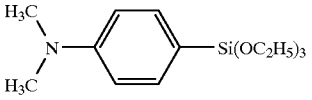
ST-6
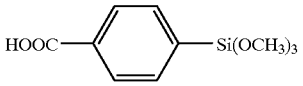
ST-7
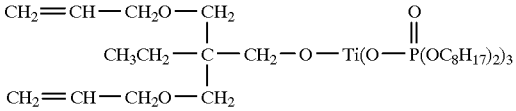
ST-8
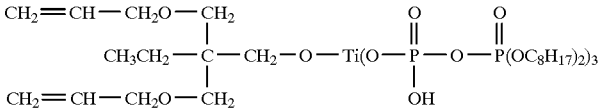
ST-9
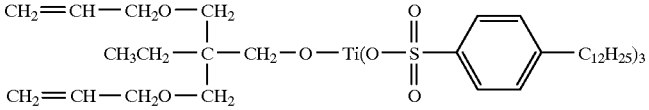
ST-10
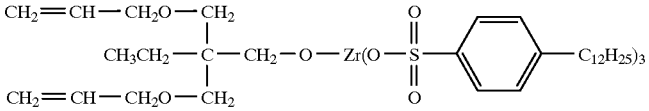
ST-11
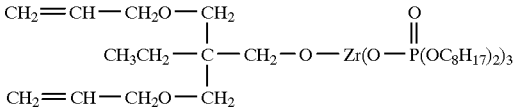
ST-12
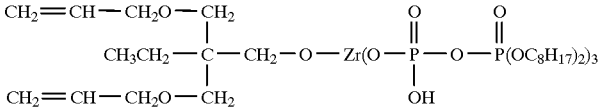
ST-13
$C_{10}H_{21}Si(OCH_3)_3$
ST-14
$CH_3(CH_2)_7Si(OC_2H_5)_3$ -continued

ST-15

$CH_2{=}CHSi(OC_2H_4OCH_3)_3$

ST-16

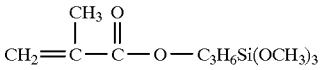

ST-17

$NH_2{-}C_2H_4{-}NHC_3H_6Si(OCH_3)_3$

ST-18

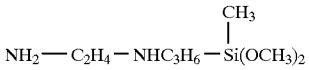

ST-19

$(CH_3O)_3Si{-}C_3H_6{-}NH{-}C_2H_4{-}NH_2CH_2COOH$

ST-20

$(CH_3O)_3Si{-}C_3H_6{-}NH{-}C_2H_4{-}NH{-}CH_2{-}CH{=}CH_2$

ST-21

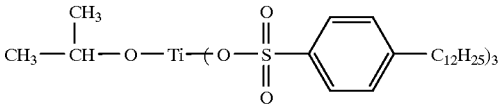

ST-22

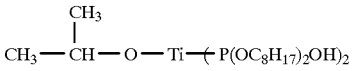

ST-23

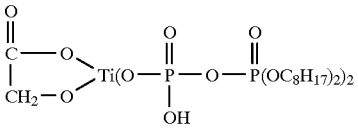

ST-24

$(C_8H_{17}{-}O)_4Ti(P(O{-}C_{13}H_{27})_2OH)_2$

ST-25

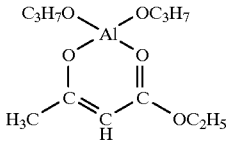

The composite polymer is contained in a photographic component layer as such or in the form of aqueous dispersion. The polymer can be dispersed by means of a ultrasonic homogenizer, ball mill, atreiter, pearl mil, roll mill and high-speed grinder.

The composite polymer is contained in the photographic component layer, in an amount of 5 to 300 wt. %, preferably 10 to 150 wt. % of binder used in the component layer. It may be contained in a light sensitive layer or light insensitive layer.

A coating solution of the component layer containing the composite material preferably has a pH of 4.0 to 6.9

Exemplary examples of the composite polymer materials usable in the present invention are shown as below. In addition, alkoxides. and dispersing agents which were used in the preparation of the composite polymer material were also shown below. The composite material used in the present invention is not limited these examples.

| No. No. | Polymer composition | Inorganic particles (wt. %, based on polymer) | | Metal alkoxide (wt. %, based on polymer) | | Dispersing agent (wt. %, based on polymer) | |
|---|---|---|---|---|---|---|---|
| PL-1 | $-(CH_2-C(CH_3)(COOCH_3))_{100}-$ | SO-17 | 100 | — | — | SF-1* | 10 |
| PL-2 | $-(CH_2-C(CH_3)(COOCH_3))_{80}-(CH_2-C(CH_3)(COOCH_2CH_2OH))_{20}-$ | SO-1 | 100 | — | — | SP-5 | 5 |
| PL-3 | $-(CH_2-C(CH_3)(COOCH_3))_{80}-(CH_2-C(CH_3)(COOCH_2CH_2OH))_{20}-$ | SO-4 | 123 | — | — | Hydroxypropyl cellulose | 22 |
| PL-4 | $-(CH_2-CH(COOEt))_{90}-(CH_2-C(CH_3)(COOCH_2CH_2OH))_{10}-$ | SO-1 | 200 | — | — | SF-1<br>SP-4 | 1<br>5 |
| PL-5 | $-(CH_2-CH(COOEt))_{98}-(CH_2-CH(COOH))_{2}-$ | SO-1 | 200 | — | — | SP-4<br>SF-1 | 4<br>5 |
| PL-6 | $-(CH_2-C(CH_3)(COO-C_6H_{11}))_{80}-(CH_2-C(CH_3)(COOC_9H_{19}(i)))_{20}-$ | SO-1 | 200 | ST-3 | 5 | SP-4 | 10 |
| PL-7 | $-(CH_2-CH(COOEt))_{93}-(CH_2-C(CH_3)(COOCH_2CH_2OOC-C(CH_3)-CH_2-))_{7}-$ | SO-1 | 300 | ST-16 | 5 | SP-4 | 10 |

-continued
| No. No. | Polymer composition | Inorganic particles (wt. %, based on polymer) | | Metal alkoxide (wt. %, based on polymer) | | Dispersing agent (wt. %, based on polymer) | |
|---|---|---|---|---|---|---|---|
| PL-8 | 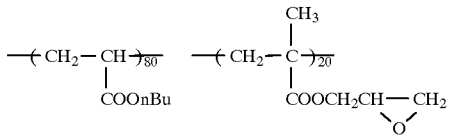 | SO-19 | 100 | — | — | SP-3 | 10 |
| PL-9 | 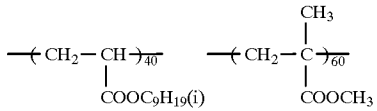 | SO-4 | 200 | — | — | SP-1 | 10 |
| PL-10 | 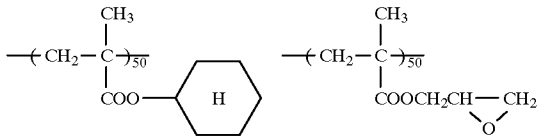 | SO-1 | 600 | — | — | SP-3 | 10 |
| PL-11 | 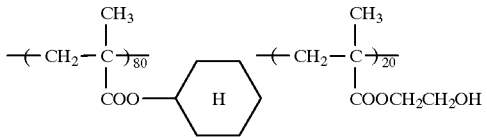 | SO-4 | 200 | ST-16 | 5 | SP-6 | 10 |
| PL-12 | 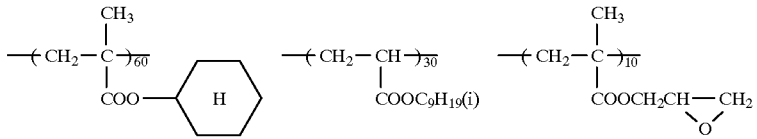 | SO-1 | 200 | ST-16 | 1 | SP-3 | 10 |
| PL-13 | 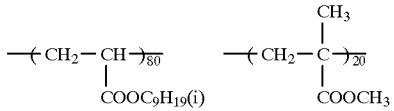 | SO-20 | 100 | — | — | SP-1 | 10 |
| PL-14 | 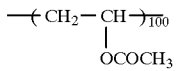 | SO-1 | 300 | — | — | SP-3 | 10 |

-continued

| No. No. | Polymer composition | Inorganic particles (wt. %, based on polymer) | | Metal alkoxide (wt. %, based on polymer) | | Dispersing agent (wt. %, based on polymer) | |
|---|---|---|---|---|---|---|---|
| PL-15 | $-(CH_2-CH)_{50}-$ ($OCOCH_3$) $-(CH_2-CH)_{50}-$ ($OCO^tBu$) | SO-1 | 300 | — | — | SP-3 | 10 |
| PL-16 | $-(CH_2-CH)_{25}-$ ($OCOCH_3$) $-(CH_2-CH)_{75}-$ ($OCO^tBu$) | SO-1 | 300 | — | — | SP-3 | 10 |
| PL-17 | $-(CH_2-CH)_{30}-$ ($OCOCH_2CH_3$) $-(CH_2-CH)_{70}-$ ($OCO^tBu$) | SO-1 | 300 | — | — | SP-3 | 10 |
| PL-18 | $-(CH_2-CH)_{30}-$ ($OCOCH_2CH_3$) $-(CH_2-CH)_{70}-$ ($OCO^tBu$) | SO-1 | 300 | ST-16 | 1 | SP-3 | 10 |
| PL-19 | $-(CH_2-CH)_{30}-$ ($OCOCH_2CH_2CH_3$) $-(CH_2-CH)_{70}-$ ($OCO^tBu$) | SO-1 | 300 | — | — | SP-3 | 10 |
| PL-20 | $-(CH_2-CH)_{26}-$ ($OCO(CH_2)_6CH_3$) $-(CH_2-CH)_{74}-$ ($OCO^tBu$) | SO-1 | 300 | — | — | SP-3 | 10 |

*SF-1: p-$C_9H_{19}$ $(C_6H_4)O(CH_2CH_2O)_6(CH_2)_3SO_3Na$

In the invention, a lubricant is preferably contained in a component layer of the photographic material. The lubricant is not limitative, and any compound which can reduce a friction coefficient of the surface when it is present.

Representative examples include silicone lubricants, as described in U.S. Pat. Nos. 3,042,522, 3,080,317, 4,004,927, 4,047,958 and 3,489,576, British Patents 955,061 1,143.118 and JP-A 60140341; higher fatty acid lubricants, as described in U.S. Pat. Nos. 2,454,043, 2,732,305, 2,976,148 and 3,206,311, German Patents 1,284,294 and 1,284,295; alcohol lubricants; acid amides lubricants; metal soaps as described in British patent 1,263,722 and U.S. Pat. No. 3,933,516; ester of ether type lubricants, as described in U.S. Pat. Nos. 2,588,765 and 3,121,060 and British Patent 1,198,387; and taurine type lubricants, as described in U.S. Pat. Nos. 3.502,437 and 3,042,222.

The friction coefficient reduced by the lubricant is preferably not more than 0.35 and more preferably, not more than 0.3. Exemplary examples of the lubricants usable in the invention are shown below, but the invention is not limited to these examples.

R-1

$C_{16}H_{33}OSO_3Na$

R-2

$C_{18}H_{37}OSO_3Na$

R-3

$C_{13}H_{27}SO_3Na$

R-4

$C_{16}H_{33}O(CH_2)_4SO_3Na$

R-5

$C_{17}H_{35}CON(CH_3)CH_2CH_2SO_3Na$

R-6

$C_{16}H_{33}O(CH_2CH(CH_3)O)_nSO_3Na$ n = 3

R-7

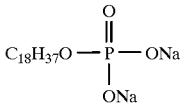

R-8

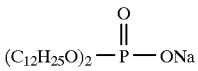

R-9

$C_{15}H_{31}COOK$

R-10

$C_{17}H_{35}COONa$

R-11

$C_{17}H_{35}CON(CH_3)CH_2CH_2COONa$

R-12

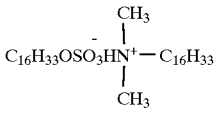

-continued

R-13

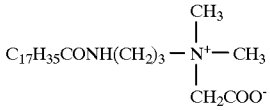

R-14

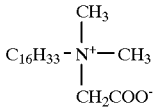

R-15

Sorbitan monolaurate

R-16

Sorbitan monostearate

R-17

Sorbitan dioleate

R-18

$C_{15}H_{31}COOC_{16}H_{33}$

R-19

$C_{17}H_{35}CON(CH_3)_2$

R-20

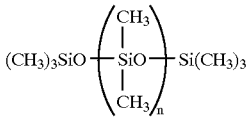

n = 30

R-21

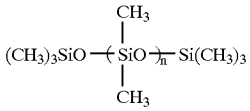

n = 1,000

R-22

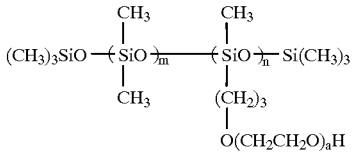

m = 25 n = 3 a = 3

R-23

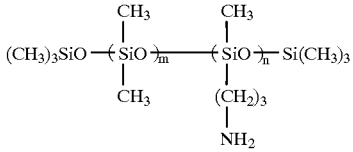

m = 25 n = 3

R-24

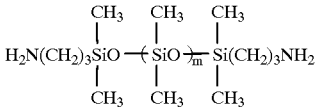

m = 20

R-25

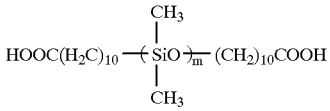

m = 30

-continued

R-26

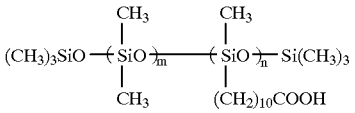

m = 30 n = 2

The lubricant may be dispersed by a dispersant used in synthesis of organic matting agents and added.

According to the invention, at least one of component layers of the photographic material preferably contains a water soluble polymer. The content of the water soluble polymer is 50 to 800 mg, preferably, 100 to 500 mg and more preferably 200 to 400 mg per $m^2$.

The water soluble polymer has a solubility of 0.5 g or more and preferably 0.1 g per 100 g of water at 20° C.

The water soluble polymer includes water soluble synthetic polymer or water soluble natural polymer. The water soluble synthetic polymer includes ones having, in the molecule, a nonionic group, anionic group, cationic group, both nonionic and anionic groups, both nonionic and cationic groups or both anionic and cationic groups. As the nonionic group is cited a sulfonic acid group or its salt, carboxylic acid group or its salt and phosphoric acid group or its salt.

The water soluble synthetic polymer may be a homopolymer or copolymer The copolymer, in particular one partially having hydrophobic monomers is limited with respect to adding position and an adding amount, so as to keep water solubility. Thus, in the case when added to the emulsion layer in a large amount, the range of the composition is to be limited so as not to cause side reaction.

The water soluble natural polymers include those having, in the molecule, a nonionic group, anionic group, or a combination of the nonionic group and anionic group. The water soluble polymers are preferably those having high solubility in a developing solution or fixing solution. The solubility is preferably 0.05 g or more, preferably, 0.5 g or more and more preferably, 1 g or more.

As the water-soluble polymer is preferred a polymer having a repeating unit represented by the following formula (P), in an amount of 10 to 100% a polymer molecule.

Formula (P)

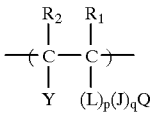

In the formula, $R_1$ and $R_2$ each represent a hydrogen atom, alkyl group (preferably alkyl group having 1 to 4 carbon atoms), which may be substituted, such as methyl, ethyl, propyl or butyl;, halogen atom (e.g., chlorine) or —$CH_2COOM$ group. L represents bivalent linkage group, such as —CONH—, —NHCO—, —COO—, —OCO—, —CO—, —$SO_2$—, —$NHSO_2$—, —$SO_2NH$— or —O—. $J_1$ represents an alkylene group preferably having 1 to 10 carbon atoms (e.g., methylene group, ethylene group, propylene group, butylene group and hexylene group), arylene group (which may be substituted, e.g., phenylene group), an aralkylene group (which may be substituted) such as

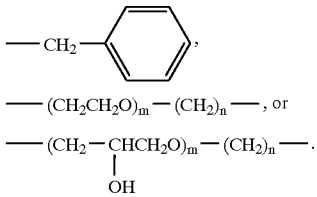

in which m is an integer of 0 to 40 and n is an integer of 0 to 4. Q represents

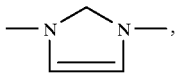

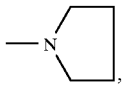

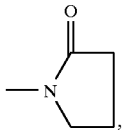

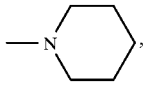

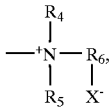

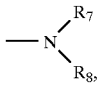

—OM,

—$NH_2$,

—$SO_3M$,

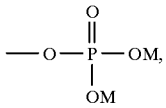

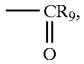

a hydrogen atom or $R_3$, in which M represents a hydrogen atom or a cation; $R_9$ represents an alkyl group having 1 to 4 carbon atoms (e.g., methyl, ethyl, propyl and butyl); $R_3$, $R_4$, $R_5$, $R_6$, $R_7$ and $R_8$ each represent a hydrogen atom or an alkyl group having 1 to 20 carbon atoms (e.g., methyl, ethyl, propyl, butyl, hexyl, decyl, hexadecyl, etc.), an alkenyl group (e.g., vinyl, allyl, etc.), a phenyl group (e.g., phenyl, methoxyphenyl, chlorophenyl, etc.) or an aralkyl group (e.g., benzyl, etc.); $X^-$ represents an anion. p and q each are 0 or 1 and Y represents a hydrogen atom or -(L)p-(J)q-Q.

The water soluble polymer can be co-polymerized with an ethylenic unsaturated monomer. Examples of the ethylenic unsaturated monomer include ethylene, alkylstyrene, hydroxyalkylstyrene, in which the alkyl group has 1 to 4 carbon atoms, such as methyl, ethyl or butyl; vinylbenzenesulfonic acid and its salt; α-methylstyrene; 4-vinylpyridine; N-vinylpyrrolidone; monoethylenic unsaturated ester of fatty acid (e.g., vinyl acetate, vinyl propionate); ethylenic unsaturated monocarboxylic or dicarboxylic acid or its salt; (e.g., acrylic acid, methacrylic acid); anhydrous maleic acid; ethylenic unsaturated mono- or di-carboxylic acid ester (e.g., n-butyl acrylate, N,N-diethylaminoethyl methacrylate); ethylenic unsaturated mono- or di-carboxylic acid amide (e.g., acrylamide, sodium 2-acrylamido-2-methylpropanesulfonate, N,N-dimethyl-N'-methacryloylpropanediamineacetate betaine)

Exemplary examples of the water soluble synthetic polymer are shown below.

| | | Number-averaged molecular weight (Mn) Mn |
|---|---|---|
| P-1 | $-(CH_2-CH)_{100}-$ (OH) | 8.000 |
| P-2 | $-(CH_2-CH)_{95}-(CH_2-CH)_{5}-$ ($CONH_2$; $SO_3K$) | 15.000 |
| P-3 | $-(CH_2-CH)_{100}-$ (COOH) | 4.800 |
| P-4 | $-(CH_2-CH)_{90}-(CH_2-CH)_{10}-$ ($CONH_2$; COONa) | 9.000 |
| P-5 | $-(CH_2-CH)_{100}-$ (N, O) | 3.100 |
| P-6 | $-(CH_2-C)_{100}-$ ($CH_2COOH$; $COOCH_2CH_2OH$) | 11.000 |
| P-7 | $-(CH_2-CH)_{100}-$ ($CONH_2$) | 3.000 |
| P-8 | $-(CH_2-C)_{100}-$ (COOH; $CON(CH_3)_2$) | 8.000 |
| P-9 | $-(CH_2-CH)_{100}-$ ($CONH-C_3H_7(i)$) | 6.000 |
| P-10 | $-(CH_2-CH)_{100}-$ ($SO_3Na$) | 7.800 |

-continued

| | | Number-averaged molecular weight (Mn) Mn |
|---|---|---|
| P-11 | $-(CH_2-C(CH_3))_{100}-$ <br> $COO-(CH_2-CHCH_2O)_3-CH_3$ <br> OH | 10.000 |
| P-12 | $-(CH_2-CH)_{100}-$ <br> CO—N | 9.500 |
| P-13 | $-(CH_2-CH)_{95}-(CH_2-CH)_5-$ <br> OH $OCOCH_3$ | 9.000 |
| P-14 | $-(CH_2-CH)_{48}-(CH_2-CH)_{52}-$ <br> $CONH_2$ COOH | 12.000 |
| P-15 | $-(CH_2-CH)_3-(CH_2-CH)_{97}-$ <br> $CONH_2$ | 5.300 |
| P-16 | $-(CH_2-CH)_{40}-(CH_2-CH)_{10}-$ <br> $COOCH_2CH_2OH$ $CONH-C(CH_3)_2CH_2SO_3Na$ | 8.000 |
| P-17 | $-(CH_2-CH(CH_3))_{50}-(CH_2-CH)_{50}-$ <br> $COO(CH_2CH_2O)_4H$ $SO_3Na$ | 9.000 |
| P-18 | $-(CCH=CH-CO(CH_2)_6O)_{n1}-(C-CHCH_2-CO(CH_2)_6O)_{n2}-$ <br> $SO_3Na$ | |
| | (Molar ratio; n1:n2 = 50:50, Mn = 10,000) | |
| P-19 | $-(CCH=CHCOCH_2-CHO)_{n1}-(CCHCH_2COCH_2CHO)_{n2}-$ <br> $CH_2OCH_3$ $SO_3NH_4$ $CH_2OCH_3$ | |
| | (Molar ratio; n1:n2 = 75:25, Mn = 20,000) | |
| P-20 | $-(CH_2-CH)_{97}-(CH_2-CH)_3-$ <br> CON COOH <br> O | 8.000 |

The number-averaged molecular weight of the water soluble synthetic polymer is not limitative, and preferably 30,000 or less , and more preferably, 15,000 or less.

The water soluble natural polymer is described in details in Sohgo Gijutsu Shiryo-shu (Keieikaihatsu Center). Preferable examples include lignin, starch, pullulan, cellulose, dextran, dextrin, glycogen, alginic acid, gelatin, collagen, guar gum, gum arabic, laminaran, lichenin, nigran, each or derivative thereof. As derivatives of the water soluble natural polymer are cited sulfonated, carboxylated, phosphated, sulfonalkylenated, carboxyalkylenated or alkylphosphonated ones, polyoxyalkylenated ones (e.g., ethylene, glycerin, propylene) and alkylated ones (methyl, ethyl, benzyl).

The water soluble natural polymer can be used singly or in combination. Of these water soluble natural polymers, glucose polymers or their derivatives are preferred. Further, of these, starch, glycogen, cellulose, lignin, dextran, dextrin, cyclodextrin and their derivatives are more preferred.

The water soluble synthetic or natural polymer usable in the invention is preferably incorporated in an amount of 0.01 to 2 $g/m^2$ more preferably 0.05 to 1 $g/m^2$ and furthermore preferably 0.1 to 0.5 $g/m^2$. The polymer is incorporated preferably into an emulsion layer and optionally into another hydrophilic colloidal layer.

The water soluble synthetic or natural polymer is used singly or in combination. The polymer is incorporated in an amount of 10%, preferably, 10 to 30%, based on the total weight of the photographic material.

Dextrin usable in the invention is a α-1,4-bonded glucose polymer, which is generally referred to as various decomposition products produced during the course of hydrolysis of starch to form maltose. There are a number of kinds of dextrins, including one with high molecular weight obtained by partial hydrolysis of starch and one with lower molecular weight which does not exhibit iodine-starch reaction. As examples of commercially available dextrins are cited LLD (trade name, produced by Meitoh Corp.), Amicol 1 or Dextrin 102S (trade name, produced by Nichiden Kagaku Corp.) and P.O. (trade name, produced by Towa Kasei Kogyo Corp.).

In at least one of the component layers of the photographic material according to the invention is preferably incorporated a latex. The latem is preferably a polymer latex comprising at least one ethylenic monomer. Ethylenic monomers usable for the latex include, for example, acrylic acid esters, methacrylic acid esters, vinyl esters, olefins, styrenes, crotonic acid esters, itaconic acid esters, maleic acid esters, fumaric acid diesters, acrylamides, acryl compounds, vinyl ethers, vinyl ketones, vinyl heterocyclic compounds, glycidyl esters and unsaturated nitriles. Further, polyfunctional monomers, and monomer compounds selected from a variety of unsaturated acids or their combination are also usable.

More concretely, examples of the acrylic acid esters include methyl acrylate, ethyl acrylate, n-propyl acrylate, isopropyl acrylate, n-butyl acrylate, isobutyl acrylate, sec-butyl acrylate, tert-butyl acrylate, amyl acrylate, hexyl acrylate, 2-chloroethyl acrylate, 2-bromoethyl acrylate, 4-chlorobutyl acrylate, cyanoethyl acrylate, 2-acetoxyethyl acrylate, dimethylaminoethyl acrylate, methoxybenzyl acrylate, 2-chlorocyclohexyl acrylate, furfuryl acrylate, tetrahydrofurfuryl acrylate, phenyl acrylate, 2-hyroxyethyl acrylate, 5-hydroxypentyl acrylate, 2,2-dimethyl-3-hydroxypropyl acrylate, 2-methoxyethyl acrylate, 3-methoxybutyl acrylate, 2-ethoxyethyl acrylate, 2-isopropoxy acrylate, 2-butoxyethyl acrylate, 2-(2-methoxyethoxy)ethyl acrylate, 2-(2-butoxyethoxy)ethyl acrylate, ω-methoxypolyethylene glycol acrylate (addition molar number=9), 1-bromo-2-methoxyethyl acrylate, and 1,1-dichloro-2-ethoxyethyl acrylate.

Examples of the methacrylic acid esters include methyl methacrylate, ethyl methacrylate, n-propyl methacrylate, isopropyl methacrylate, amyl methacrylate, chlorobenzyl methacrylate, sulfopropyl methacrylate, N-ethyl-N-phenylaminoethyl methacrylate, 2-(3-phenylpropyloxy) ethyl methacrylate, dimethylaminophenoxyethyl methacrylate, furfuryl methacrylate, tetrahydrofurfuryl methacrylate, phenyl methacrylate, cresyl methacrylate, naphthyl methacrylate, 2-hydroxyethyl methacrylate, 4-hydroxybutyl methacrylate, triethylene glycol mono methacrylate, dipropylene glycol mono methacrylate, 2-methoxyethyl methacrylate, 3-methoxybutyl methacrylate, 2-acetoxyethyl methacrylate, 2-acetoacetoxyethyl methacrylate, 2-ethoxyethyl methacrylate, 2-iso-propoxyethyl methacrylate, 2-butoxyethyl methacrylate, 2-(2-methoxyethoxy)ethyl methacrylate, 2-(2-ethoxyethoxy)ethyl methacrylate, 2-(2-butoxyethoxy)ethyl methacrylate, ω-methoxypolyethylene glycol methacrylate (addition molar number=6), allyl methacrylate, and methacrylic acid dimethylaminoethylmethyl chloride.

Examples of the vinyl esters include vinyl acetate, vinyl propionate, vinyl butylate, vinyl isobutylate, vinyl caproate, vinyl chloroacetate, vinyl methoxyacetate, vinyl phenylacetate vinyl benzoate, and vinyl salicylate.

Examples of the olefins include dicyclopentadiene, ethylene, propylene, 1-butene, 1-pentene, vinyl chloride, chlorovinilidene, isoprene, chloroprene, butadiene, and 2,3-dimethylbutadiene.

Examples of the styrenes include styrene, methylstyrene, dimethystyrene, trimethylstyrene, ethylstyrene, isopropylstyrene, chloromethylstyrene, methoxystyrene, acetoxystyrene, chlorostyrene, dichlorostyrene, bromostyrene, trifluoromethylstyrene, and methyl vinylbenzoate.

Examples of the crotonic acid esters include butyl crotonate and hexyl crotonate.

Examples of the itaconic acid diesters include dimethyl itaconate, diethyl itaconate and dibutyl itaconate. Examples of the maleic acid diesters include diethyl maleate, dimethyl maleate, and dibutyl maleate. Examples of the fumaric acid diesters include dimethyl fumarate, diethyl fumarate and dibutyl fumarate. Examples of the acrylamides include acrylamide, methylacrylamide, ethylacrylamide, propylacrylamide, butylacrylamide, tert-butylacrylamide, cyclohexylacrylamide, benzylacrylamide, hydroxymethylacrylamide, methoxyethylacrylamide, dimethylamionoethylacrylamide, phenylacrylamide, dimethylacrylamide, diethylacrylamide, β-cyanoethylacrylamide, N-(2-acetoacetoxyethyl) acrylamide; examples of the methacrylamides include methacrylamide, methyl methacrylamide, ethyl methacrylamide, propyl methacrylamide, butyl methacrylamide, tert-butyl methacrylamide, cycohexyl methacrylamide, benzyl methacrylamide, hydroxymethyl methacrylamide, methoxymethyl methacrylamide, dimethylaminoethyl methacrylamide, phenyl methacrylamide, dimethyl methacrylamide, diethyl methacrylamide, β-cyanoethyl methacrylamide, and N-(2-acetoacetoxyethyl) methacrylamide; examples of the allyl compounds include allyl acetate, allyl capronate, allyl laurate, and allyl benzoate; examples of the vinyl ethers include methyl vinyl ether, butyl vinyl ether, hexyl vinyl ether, methoxyethyl vinyl ether, and dimethylaminoethyl vinyl ether; examples of the vinyl ketones include methyl vinyl ketone, phenyl vinyl ketone, and methoxyethyl vinyl ketone; examples of the vinyl heterocyclic compounds include vinylpiridine, N-vinylimidazole, N-vinyloxazolidone, N-vinyltriazole, and N-vinylpyrrolidone; examples of the glycidyl esters include glycidyl acrylate, and glycidyl methacrylate; examples of the unsaturated nitriles include acrylonitrile and methacrylonitrile; and examples of the polyfunctional monomers include divinylbenzene, methylenebisacrylamide and ethylene glycol dimethacrylate.

Further examples include acrylic acid, methacrylic acid, itaconic acid, maleic acid, monoalkyl itaconate such as monomethyl itaconate, monoethyl itaconate and monobutyl itaconate; monoalkyl maleate such as monomethyl maleate, monoethyl maleate and monobutyl maleate; citraconic acid styrene sulfonic acid, vinylbenzylsulfonic acid, vinylsulfonic acid, acryloyloxyalkylsulfonic acid such as acryloyloxymethylsulfonic acid, acryloyloxyethylsulfonic acid and acryloyloxypropylsulfonic acid; methacryloyloxyalkylsulfonic acid such as methacryloyloxydimethylsulfonic acid, methacryloyloxyethylsulfonic acid and methacryloyloxypropylsulfoic acid; acrylamidoalkylsulfonic acid such as 2-acrylamido-2-methylethane sulfonic acid, 2-acrylamido-2-methylpropane sulfonic acid and 2-acrylamido-2-methylbutane sulfonic acid; acryloyloxyalkylphosphate such as acryloyloxyethylphosphate, 3-acryloyloxypropyl-2-phosphate; methacryloyloxyalkylphosphate such as methacryloyloxyethylphosphate and 3-methacryloyloxypropyl-2-phosphate; and naphthyl 3-allyloxy-2-hydroxypropane sulfonate, which has three hydrophilic groups. These acids may be alkali metal or ammonium salts thereof. As other monomer compounds can also employed curable monomers, as described in U.S. Pat. Nos. 3,459,790, 3,438,708, 3,554,987, 4,215,195 and 4,247,673; JP-A 57-205735. Examples thereof include N-(2-acetoacetoxyethyl)acrylamide and N-{2-(2-acetoacetoxyethoxy)ethyl}acrylamide.

Of these monomer compounds, acrylic acid esters, methacrylic acid esters, vinyl esters, styrenes and olefins are preferred. Exemplary examples of polymer latexes used in the invention are shown below, but the latexes are not limited to these examples.

L-A

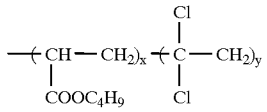

(x/y = 50/50)

L-B

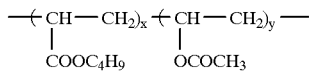

(x/y = 50/50)

L-C

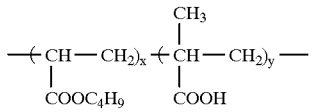

(x/y = 95.6/4.4)

L-D

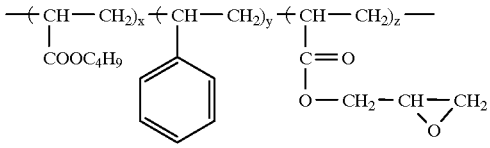

(x/y/z = 40/20/40)

L-E

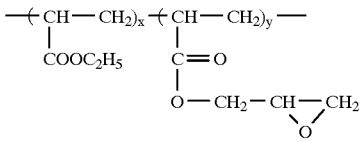

(x/y = 50/50)

L-F

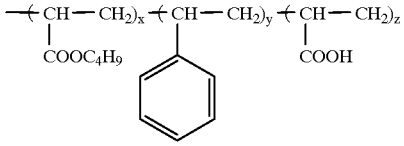

(x/y/z = 39.4/59/1.6)

-continued
L-G
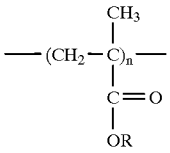
R: —$CH_3$, $C_2H_5$, $C_4H_9$
L-H
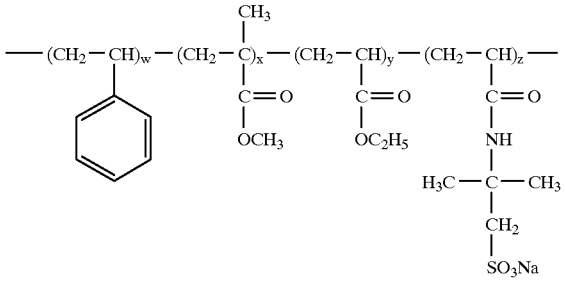
(x/y/z = 30/20/42/8)
L-I
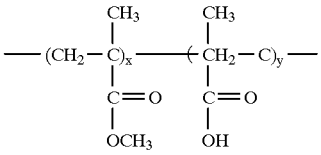
(x/y = 93/7)
L-J
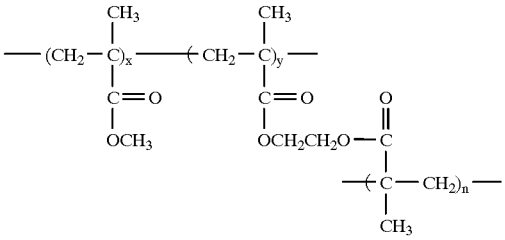
(x/y = 93/7)
L-K
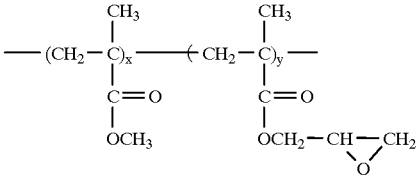
(x/y = 93/7)
L-L
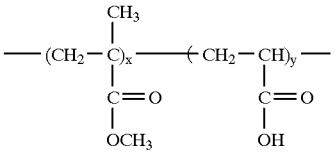
(x/y = 93/7)

-continued
L-M
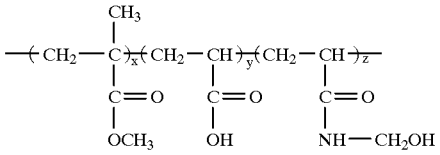
x/y/z = 93/3/4
L-N
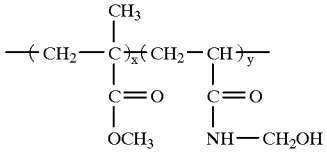
x/y = 93/7
L-O
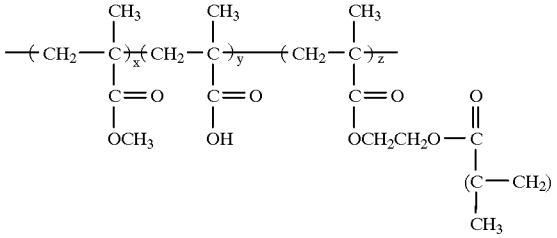
x/y/z = 93/3/4
L-P
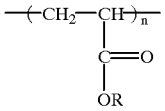
R: $-CH_3$, $-C_2H_5$, $-C_4H_9$
L-Q
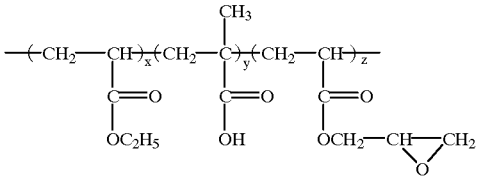
(x/y/z = 93/3/4)
L-R
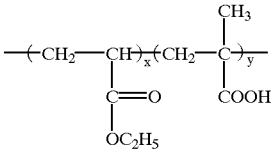
(x/y = 93/7)
L-S
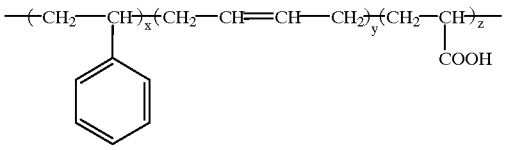
(x/y/z = 59/39/2)

-continued
L-T
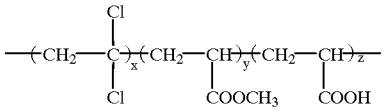
(x/y/z = 85/13/2)
L-U
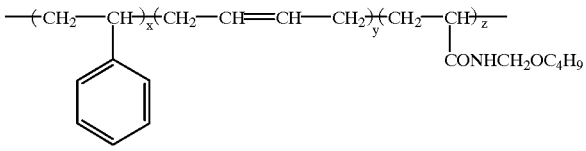
(x/y/z = 64/33/3)
L-V
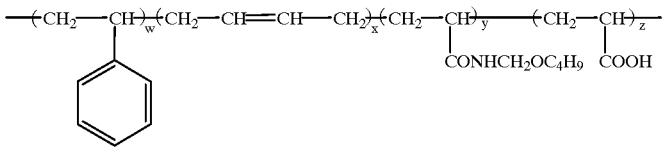
(w/x/y/z = 63/32/3/2)
L-W
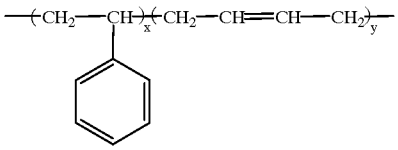
(x/y = 67/33)
L-X
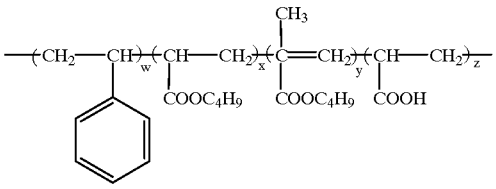
(w/x/y/z = 45/43/8/4)
L-Y
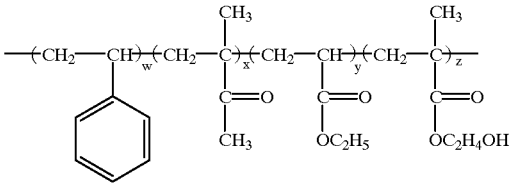
(w/x/y/z = 30/30/32/8)
L-Z
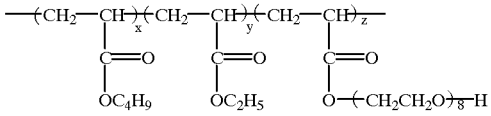
(x/y/z = 40/52/8)

-continued

L-AA

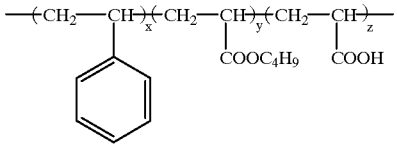

(x/y/z = 60/38/2)

L-AB

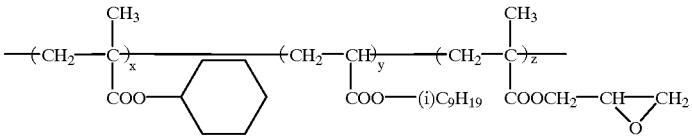

(x/y/z = 60/30/10)

The polymer latexes preferably have an average particle size of 0.01 to 0.8 μm and any of those with 0.005 to 2.0 μm can be employed. The particle size of the latex can be determined by a variety of methods, such as electronmicrograph, soap titration, light scattering and centrifugal sedimentation, as described in "Chemistry of Polymer Latex" published by Kohbunshi Kankohkai (1973). Of these is preferred the light scattering method. Light scattering can be measured by using light scattering apparatus, DLS700 (product by Ohtsuka Denshi Corp.).

Molecular weights of latexes are not specifically limited, and the molecular weight is preferably 1,000 to 1,000,000 and more preferably, 2,000 to 500,000. The polymer latex is incorporated into the photographic component layer as it is or through dispersion in water.

At least one of the component layers of the photographic material according to the invention preferably contains an oleophilic compound. The oleophilic compound, which has a boiling point of 165° C. or higher at atmospheric pressure and a solubility in water of 10% by weight or less, is preferably incorporated in the form of oil drops dispersed in a hydrophilic colloidal layer. It is preferred that oil drops with sizes of 0.1 to 0.4 μm accounts for 75% or more of the total oil drops.

The oleophilic compound can be dispersed using a variety of surfactants, such as anionic surfactants described in U.S. Pat. Nos. 2,332,027, 2,801,170 and 2,801,171 and anionic and nonionic surfactants described in JP-B 48-9979 (herein, term, "JP-B" means examined and published Japanese Patent).

Exemplary examples of the oleophilic compound include diethyl adipate, dibutyl adipate, diisobutyl adipate, di-n-hexyl adipate, dioctyl adipate, dicyclohexyl acetate, diethylhexyl acetate, dioctyl sebacate, diisooctyl sebacate; dibutyl succinate, dioctyl stearate, dibenzyl phthalate, tricresyl phosphate, diphenyl-mono--p-tert-butylphenylphosphate, monophenyl-di-o-chlorophenylphosphate, monobutyl-dioctylphosphate, 2,4-di-n-amylphenol, 2,4-di-tert-amylphenol, 4-n-nonylphenol, 2-methyl-4-n-octylphenol, N,N-diethylcaprylamide, N,N-diethyllaurylamide, glycerol tripropionate, glycerol tributyrate, glycerol monolactate-acetate, tributyl citrate, acetyltriethyl citrate, di-2-ethylhexyl adipate, dioctyl sebacate, di-isooctyl azerate, diethylene glycol dibenzoate, dipropylene glycol dibenzoate, triethyl citrate, tri(2-ethylhexyl)citrate, acetyl-tri-n-butylcitrate, di(isodecyl)-4,5-epoxytetrahydrophthalate, olygovinylethyl ether, dibutyl fumarate, polyethyleneoxide (n>16), glycerol tributylate, ethylene glycol dipropionate, di(2-ethylhexyl) isophthalate, butyl laurate, tri-(2-ethylhexyl)phosphate, triphenylphosphate, tricresyl phosphate, silicone oil, dimethyl phthalate, diethylphthalate, dipropyl phthalate, dibutyl phthalate, diisooctyl phthalate, diamyl phthalate, di-n-octyl phthalate, diamyl naphthalene, triamyl naphthalene, monocaprin, monolaurin, monomyristin, monopalmitin, monostearin, monoolein, dicaprin, dilaurin, dimyristin, dipalmitin, distearin, diolein, 1-stearo-2-palmitin, 1-palmito-3-stearin, 1-palmito-2-stearin, triacetin, tricaprin, trilaurin, trimyristin, tripalmitin, tristearin, triolein, tripetrocelin, trielsin, triricinolein, linoledistearin, linoleodililenin, oleodielsin, linoleodielsin, palmitooleolinolenin, paraffin, drying oils (e.g., inseed oil, soybean oil, perilla oil, tung oil, hamp-seed oil, kaya oil, walnut oil, soy sauce oil, poppy seed oil, sunflower, mustard oil, kuwai oil and safflower oil), semi-drying oils (e.g., cotton seed oil, corn oil, sesame oil, rape oil, rice bran oil, croton oil, pepper oil, kaboky oil, dehydrated castor oil), peanut oil, olive oil, tsubaki oil, sasanqua oil, tea oil, castor oil, hydrogenated castor oil, almond oil, soybean cake oil, ben oil and chaulmoogra oil.

Furthermore, compounds represented by the following formulas,

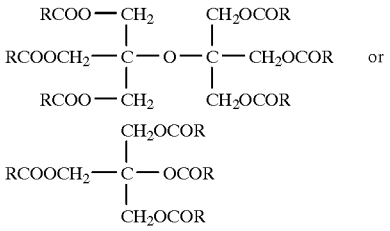

in which R represents an alkyl group having 1 to 8 carbon atoms,; compounds described in JP-A 50-23823, 50-62632, 51-26035, 51-26036 and 51-26037 are also usable as a oleophilic compound material.

Of these, esters of adipinic acid, phthalic acid, sebacinic acid, succinic acid, fumaric acid, maleic acid, isophthalic acid, phosphoric acid; glycerin ester and paraffin are preferably used in terms of being no disadvantageous effect on photographic materials, commercially available, chemically stable and easily handlable. Tricresyl phosphate, dibutyl phosphate, di-n-octyl phthalate, glycerol tributylate, glycerol tripropionate, dioctyl sebacate, paraffin and silicone oil are particularly preferred, and di-n-octyl phthalate is furthermore preferred.

The oleophilic compound is incorporated into the photographic material, in an amount of 10 to 500 mg, preferably, 50 to 400 mg and more preferably 100 to 300 mg per $m^2$ of the photographic material. The layer containing the oleophilic compound can further contain a film forming material such as gelatin, hydrophobic polymer and hydrophilic polymer, surfactant, or hardening agent.

In the formation of oil drops, there can also be used organic low boiling solvents which do not remain after coating and drying. Examples thereof include methanol, ethanol, propyl alcohol, fluoroalcohol, acetonitrile, dimethylformamide, dioxane, methyl isobutyl ketone, diethylene glycol monoacetate, chloroform, methyl acetate, ethyl acetate, propyl acetate, butyl acetate, cyclohexanol, cyclohexane, and tetrahydrofuran. In the invention, the use of di-n-octyl phthalate, as the oleophilic compound, achieves advantageous effects. When the di-n-octyl phthalate is dispersed, its average particle size may be 0.10 to 0.2 μm.

In the invention, a matting agent is preferably incorporated in a component layer (preferably, an outermost layer). Thus, the outermost layer of the emulsion-side preferably contains a regular-shaped or irregular shaped matting agent with particle sizes of 4 μm or more (preferably, 4 to 20 μm) in an amount of 4 to 50 mg/$m^2$. The matting agent is also contained preferably in combination with a matting agent with sizes of smaller than 4 μm.

As the matting agent, there may be usable any one known in the art. Examples thereof include inorganic particles, such as silica described in Switzerland Patent 330,158, blass powder described in France Patent 1,296,995, carbonates of alkali earth metals, cadmium and zinc described in British Patent 1,173,181; and organic particles such as starch described in U.S. Pat. No. 625,451 and British Patent 981,198, poly(vinyl alcohol) described in JP-B 44-3643, polystyrene and poly(methyl methacrylate) described in Switzerland Patent 330,158, polynitriloacryl described in U.S. Pat. No. 3,079,257 and polycarbonate described in U.S. Pat. No. 3,022,169.

The matting agent can be used singly or in combination. The matting agent may be in a regular shape or irregular shape. The regular shaped matting agent is preferably spherical one. other shaped ones, such as planar or cubic ones are usable. The particle size of the matting agent is expressed as a diameter of sphere having the same volume as the matting agent. Thus, the particle size of the matting agent refers to sphere equivalent diameter. The matting agent is desirable to be exposed on the surface to effectuate basic functions thereof. The matting agent is previously dispersed in a coating solution and then coated.

For the purpose of shortening the processing time, the coating amount of gelatin is reduced to allow to dry up in a short time. However, reduction of gelatin results in an increase of pin-holes due to sinking of matting agent particles.

According to the invention, a layer adjoining to the outermost layer preferably has gelatin in an amount more than that of the outermost layer, whereby occurrence of the pin-hole due to the matting agent can be prevented, when the coating amount of gelatin is changed to 0.5 to 2.5 g/$m^2$ (or 0.5 to 2.0 g/$m^2$).

The photographic material of the invention comprises a silver halide emulsion layer containing silver halide grains. The silver halide emulsion is preferably spectrally sensitized so as to have a spectral sensitivity maximum within the range of 600 to 900 nm.

The silver halide emulsion having a spectral sensitivity within the range of 600 to 900 nm refers to the emulsion spectrally sensitized with a sensitizing dye so as to have the sensitivity maximum within the wavelength region of 600 to 900 nm. Sensitizing dye having a sensitivity maximum within the range of 600 to 900 nm are not specifically limited, and those represented by the following formula (I-a) or (I-b) are preferred.

Formula (I-a)

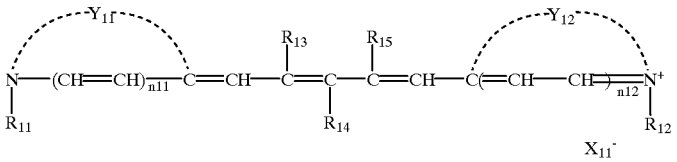

Formula (I-b)

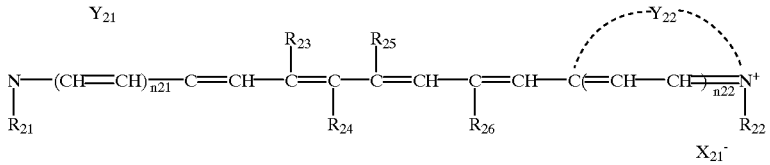

In the formulas, $Y_{11}$, $Y_{12}$, $Y_{21}$ and $Y_{22}$ each represent an atomic group necessary for forming 5 or 6-membered nitrogen-containing heterocyclic ring, such as a benzothiazole ring, naphthothiazole ring, benzoselenazole ring, naphthoselenazole ring, benzooxazole ring, naphthooxazole ring, quinoline ring, 3,3-dialkylindolenine ring, benzimidazole ring or pyridine ring. These heterocyclic ring may be substituted by a lower alkyl group, alkoxy group, hydroxy group, aryl group, alkoxycarbonyl group or halogen atom.

$R_{11}$, $R_{12}$, $R_{21}$ and $R_{22}$ each represent a substituted or unsubstituted alkyl group, aryl group or aralkyl group. $R_{13}$, $R_{14}$, $R_{15}$, $R_{23}$, $R_{24}$, $R_{25}$ and $R_{26}$ each represent a hydrogen atom, a substituted or unsubstituted alkyl group, alkoxy group, phenyl group, benzyl group, or —$N(W_1)W_2$, in which $W_1$ and $W_2$ represent a substituted or unsubstituted alkyl group (an alkyl portion having 1 to 18 and preferably 1 to 4 carbon atoms), aryl group and $W_1$ and $W_2$ may combine with each other to form a 5 or 6-membered nitrogen containing heterocyclic ring. $R_{13}$ and $R_{15}$, or $R_{23}$ and $R_{25}$ may combine with each other to form a 5 or 6-membered ring. $n_{11}$, $n_{12}$, $n_{21}$ and $n_{22}$ each are 0 or 1.

Examples of the above-described cationic di- or tricarbocyanine dyes are shown below, but the dyes are not limited to these examples.

I-1
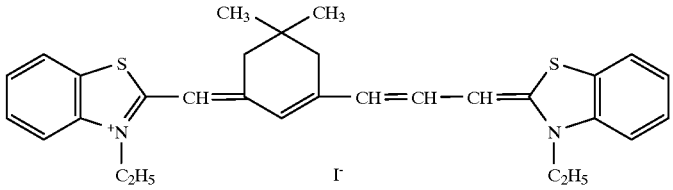
I-2
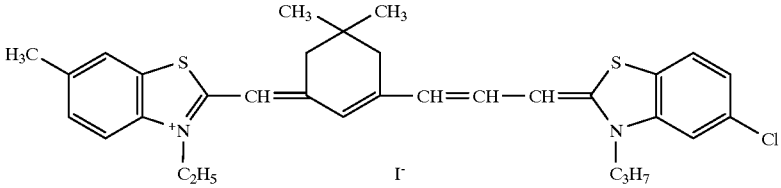
I-3
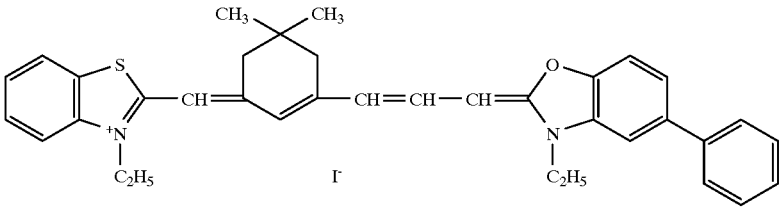
I-4
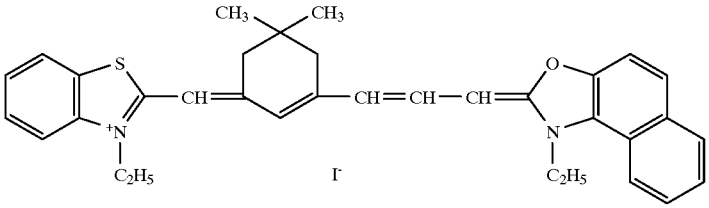
I-5
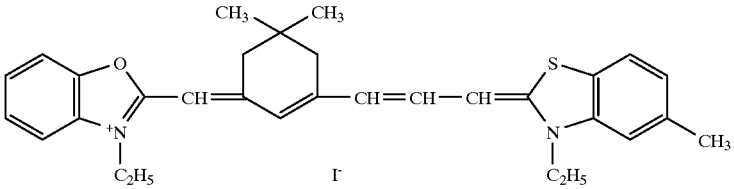
I-6
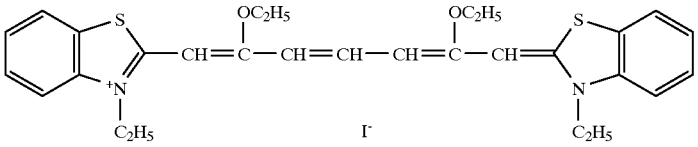
I-7
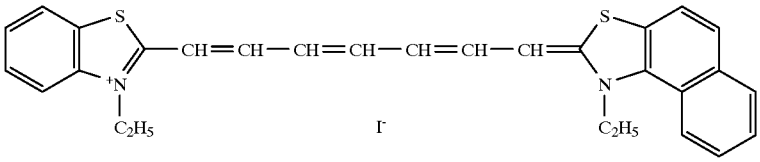

-continued
I-8
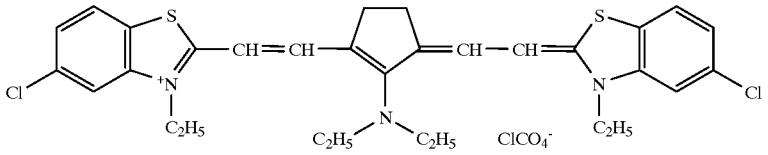
I-9
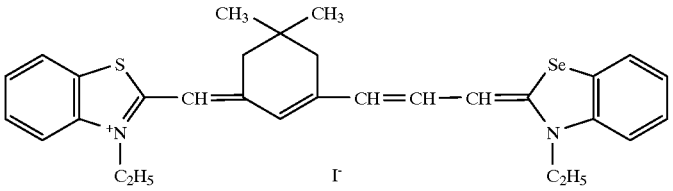
I-10
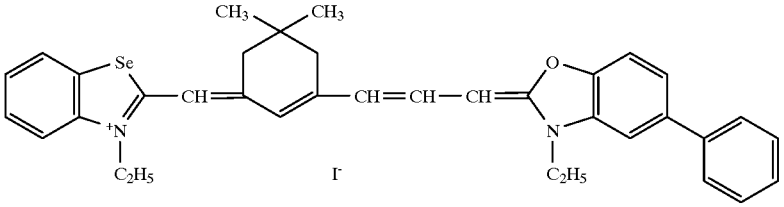
I-11
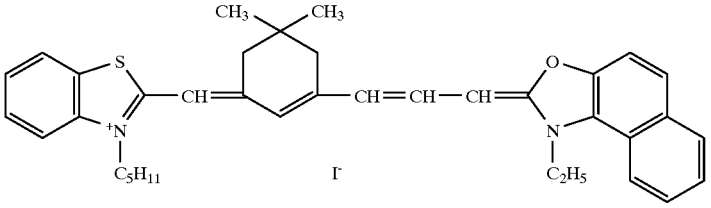
I-12
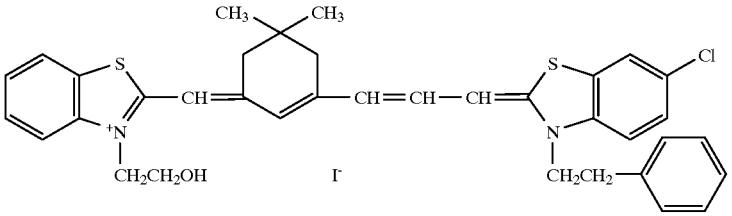
I-13
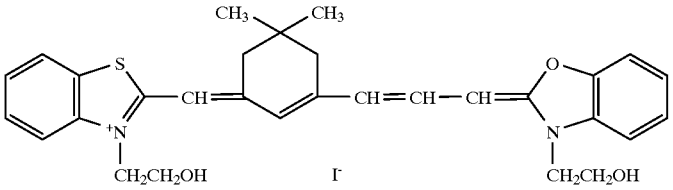
I-14
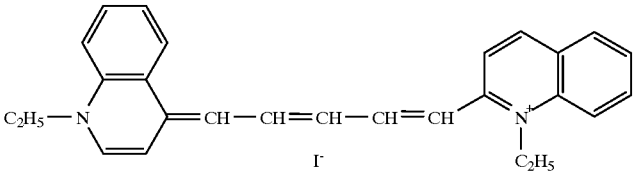

-continued
I-15
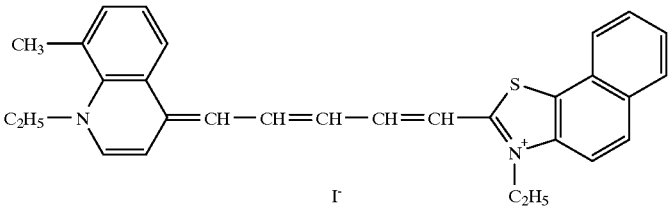
I-16
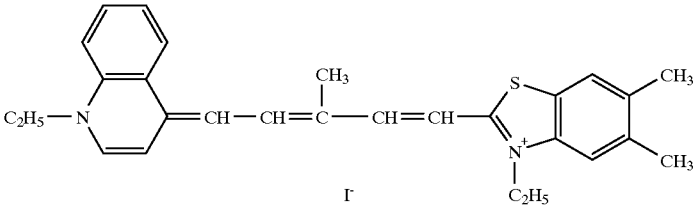
I-17
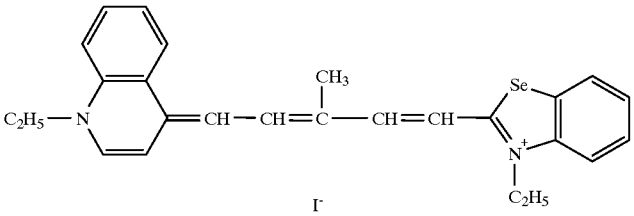
I-18
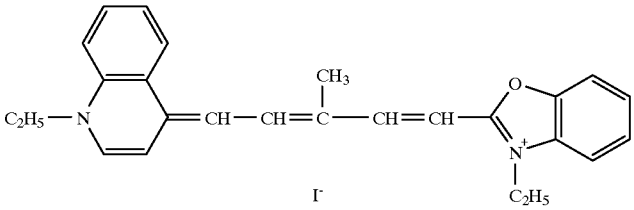
I-19
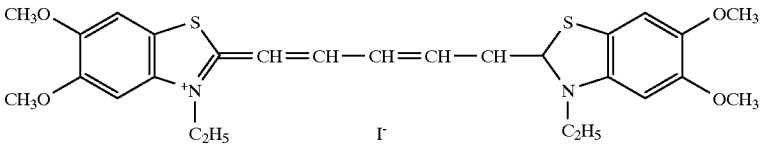
I-20
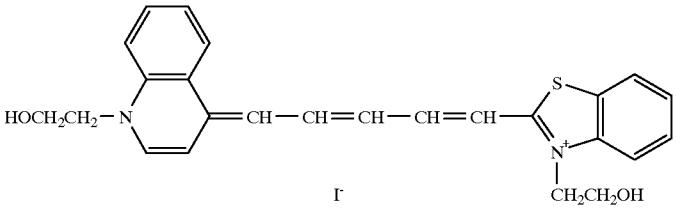

-continued

I-21

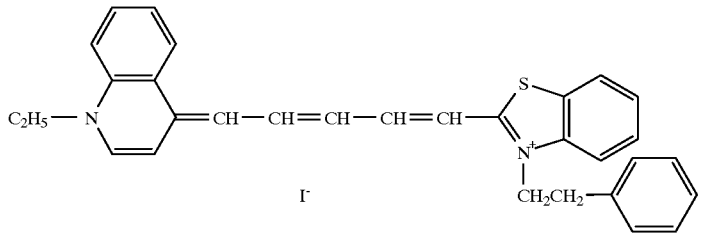

In addition to the above dyes, sensitizing dyes represented by the following formulas (II), (III), (IV), (V) and (VI) are preferred.

Formula (II)

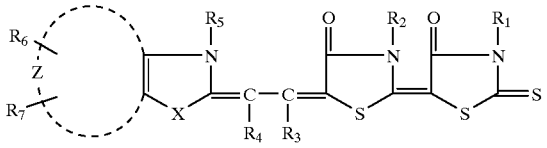

In the formula, X represents a sulfur or selenium atom; at least two of $R_1$, $R_2$, $R_3$, $R_4$ and $R_5$, each represents an organic group having a water-solubilizing group, provided that $R_3$ and $R_4$ are not simultaneously the organic groups having a water-solubilizing group. $R_1$, $R_2$, $R_3$, $R_4$ and $R_5$, which do not represent the organic group having a water-solubilizing group, represent a hydrogen atom, alkyl group, substituted alkyl group, alkenyl group, substituted alkenyl group, aryl group or substituted aryl group. Z represents an atomic group necessary for forming a ring; $R_6$ and $R_7$ each represent a hydrogen atom, hydroxy group, halogen atom, alkyl group, substituted alkyl group, alkenyl group, substituted alkenyl group, alkynyl group, substituted alkynyl group, alkoxy group, substituted alkoxy group, alkylthio group, substituted alkylthio group, arylthio group, substituted arylthio group, aryl group, substituted aryl group, acyl group, substituted acyl group, acyloxy group, substituted acyloxy group, alkoxycarbonyl group, substituted alkoxycarbonyl group, alkylsulfonyl group, substituted alkylsulfonyl group, carbamoyl group, substituted carbamoyl group, sulfamoyl group, substituted sulfamoyl group, carboxy group or cyano group.

Formula (III)

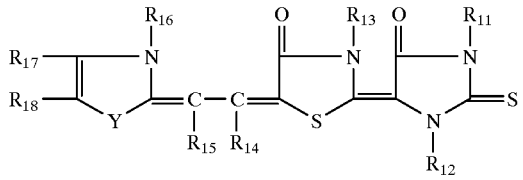

In the formula, Y represents a sulfur or selenium atom; at least two of $R_{11}$, $R_{12}$, $R_{13}$, $R_{14}$, $R_{15}$ and $R_{16}$, each represents an organic group having a water-solubilizing group, provided that $R_{14}$ and $R_{15}$ are not simultaneously the organic groups having a water-solubilizing group. $R_{11}$, $R_{12}$, $R_{13}$, $R_{14}$, $R_{15}$ and $R_{16}$, which do not represent the organic group having a water-solubilizing group, represent a hydrogen atom, alkyl group, substituted alkyl group, alkenyl group, substituted alkenyl group, aryl group or substituted aryl group. $R_{17}$ and $R_{18}$, which may be the same with or different from each other, are respectively the same as defined in $R_6$ and $R_7$ of Formula (II), or represent an atomic group necessary for completing a carbon-cyclic ring formed by combination of $R_{17}$ and $R_{18}$. The carbon ring may have a group selected from the groups represented by $R_6$ and $R_7$.

Formula (IV)

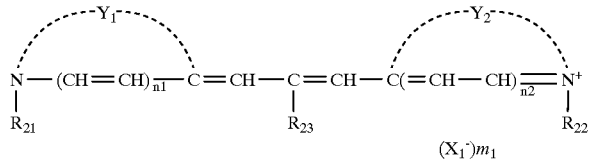

In the formula, $Y_1$ and $Y_2$ each represent an atomic group necessary for forming a benzothiazole ring, benzoselenazole ring, naphthoselenazole ring, or quinoline ring. These heterocyclic rings may be substituted by a lower alkyl group, alkoxy group, aryl group, hydroxy group, alkoxycarbonyl group or a halogen atom.

$R_{21}$ and $R_{22}$ each represent a lower alkyl group, or an alkyl group having a sulfo group or a carboxy group. $R_{23}$ represents a methyl group, ethyl group or propyl group. $X_1^-$ is an anion and $n_1$ and $n_2$ are 1 or 2, and $m_1$ is 0 or 1, provided that when an intramolecular salt is formed, $m_1$ is 0.

Formula (V)

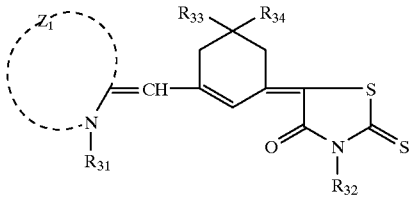

In the formula, $R_{31}$ and $R_{32}$ each represent an alkyl group, substituted alkyl group, aryl group, substituted aryl group or allyl group, provided that at least one of $R_{31}$ and $R_{32}$ is the alkyl group having a sulfo group or carboxy group. $R_{33}$ and $R_{34}$ each represent an alkyl group. $Z_1$ represents an atomic group necessary for forming a 5- or 6-membered nitrogen-containing heterocyclic ring.

Formula (VI)

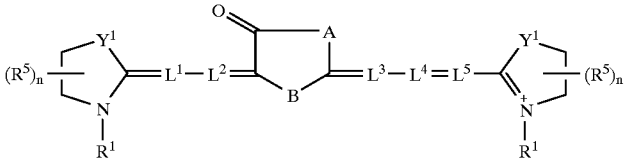

In the formula, $Y_1$ represents —S— or —Se—, $L^1$, $L^2$, $L^3$, $L^4$ and $L^5$ represent a methine group, which may be substituted. A represents —N($R^3$)—, —O—, or —S—, and when A is —O—, B represents —N($R^4$)— and when A is —N($R^3$)—, B represents —N($R^4$)—, —S— or —O—.

$R^1$, $R^2$, $R^3$ and $R^4$ each represent alkyl group or aryl group, each of which may be substituted; $R^5$ represents an alkyl group having 1 to 4 carbon atoms, provided that at least two of $R^1$, $R^2$, $R^3$ and $R^4$ are substituted by an acid or base; n is an integer of 0, 1 or 2; and $X^-$ represents a counter ion.

Examples of the sensitizing dyes represented by formulas (II) through (VI) are shown below.

II-1

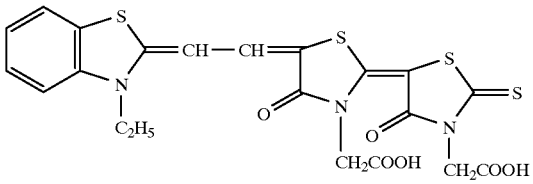

II-2

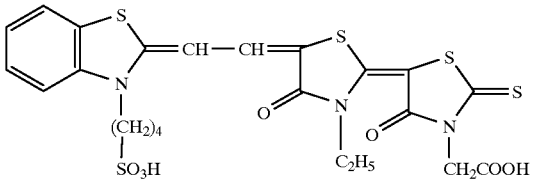

-continued

II-3

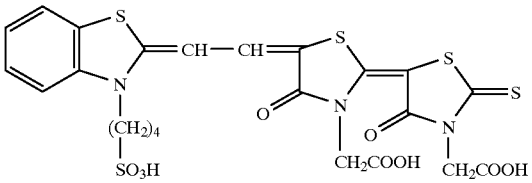

II-4

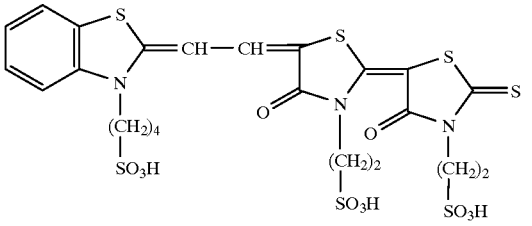

-continued

II-5

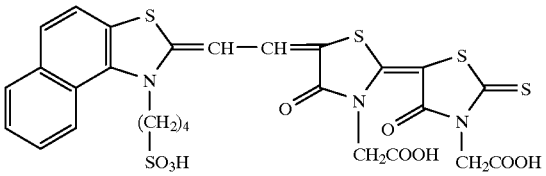

II-6

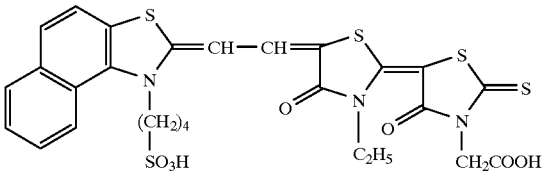

II-7

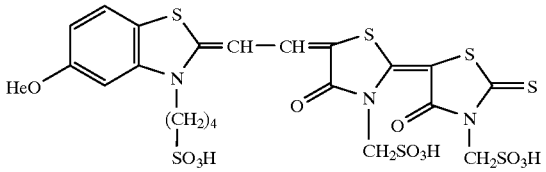

II-8

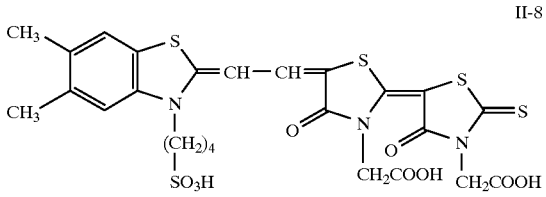

-continued
II-9
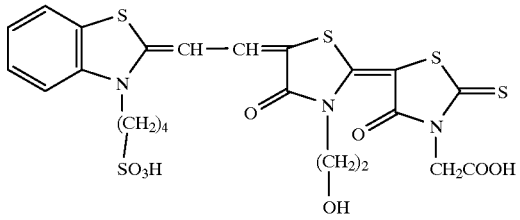
II-10
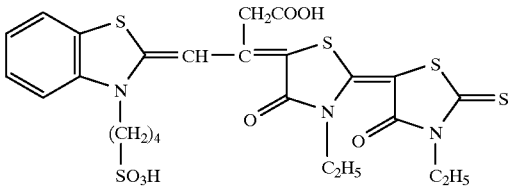
II-11
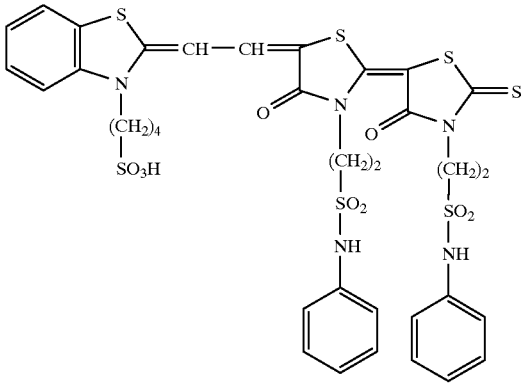
II-12
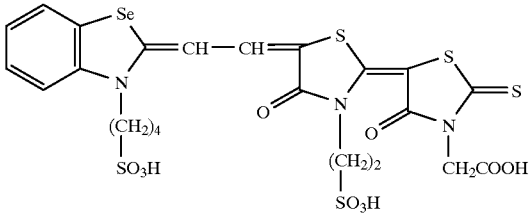
II-13
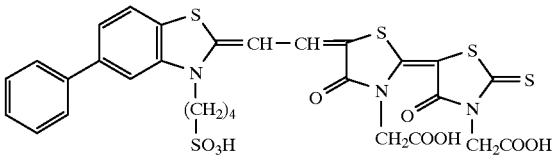
II-14
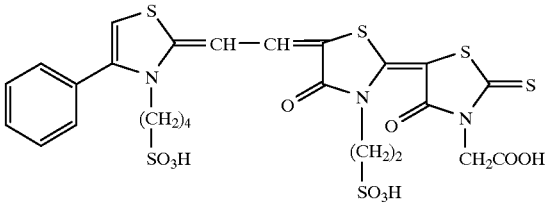
-continued
III-1
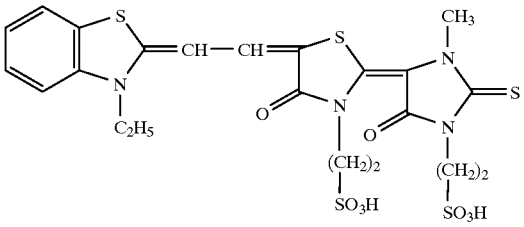
III-2
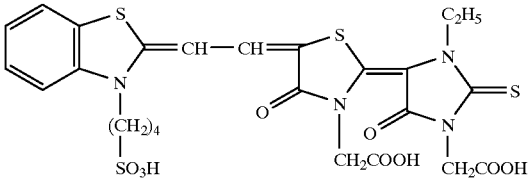
III-3
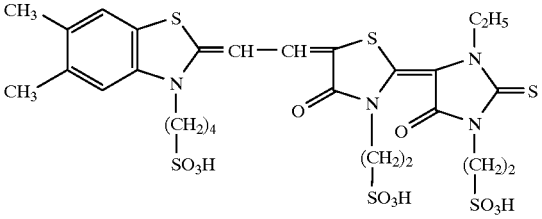
III-4
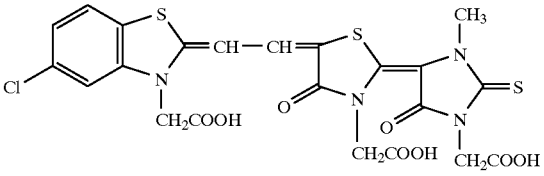
III-5
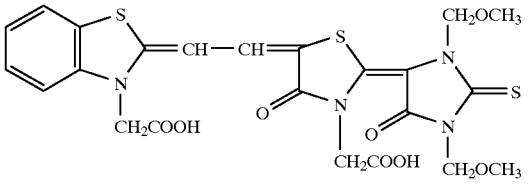
III-6
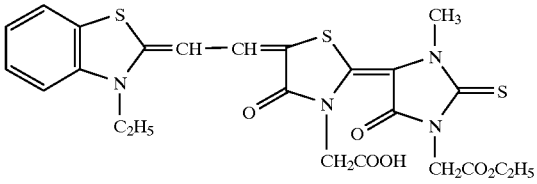
III-7
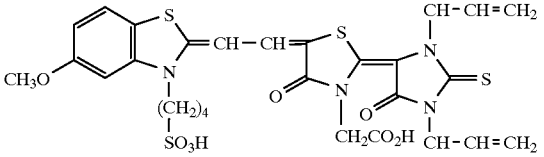

-continued
IV-1
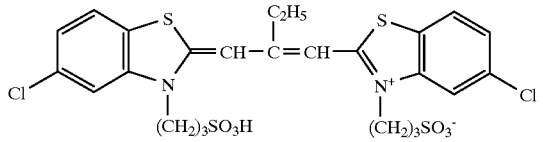
IV-2
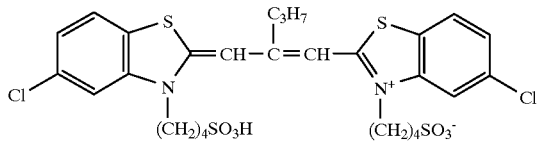
IV-3
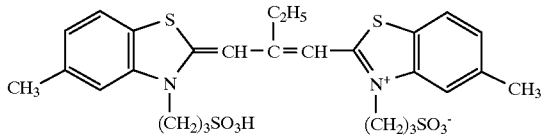
IV-4
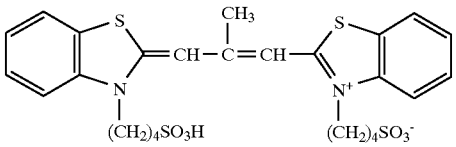
IV-5
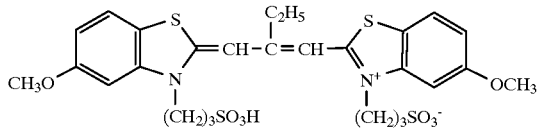
IV-6
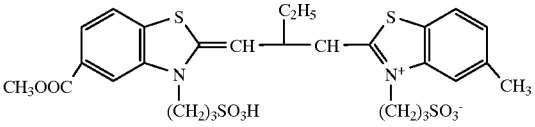
IV-7
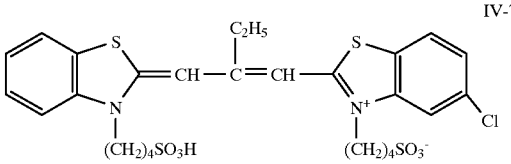
IV-8
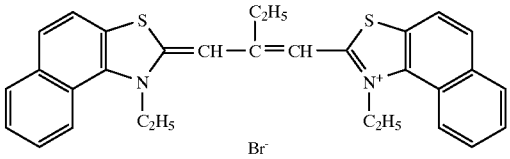
IV-9
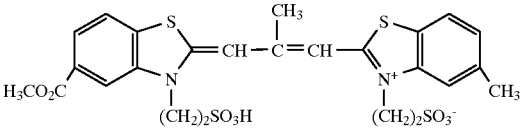
-continued
IV-10
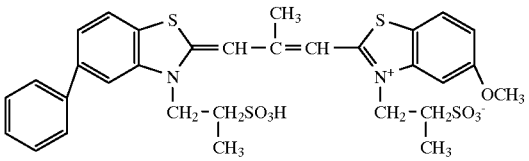
IV-11
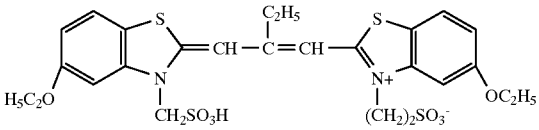
IV-12
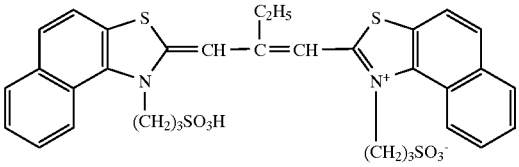
IV-13
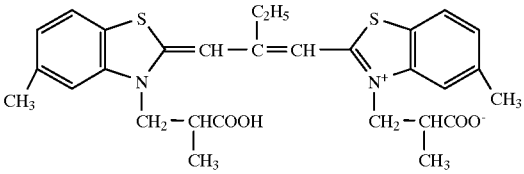
V-1
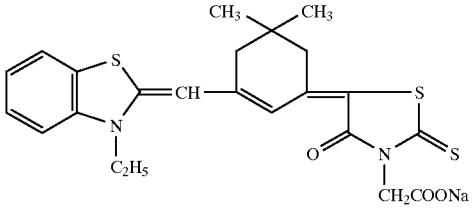
V-2
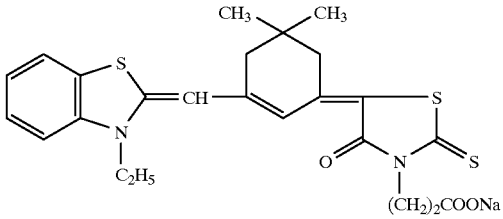
V-3
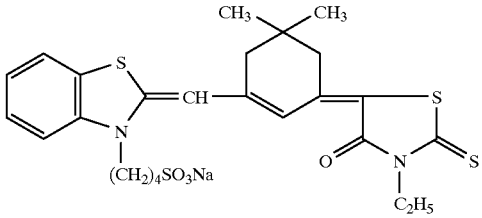

-continued

V-4

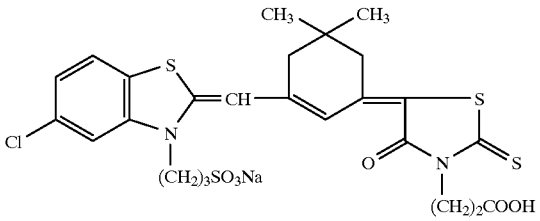

V-5

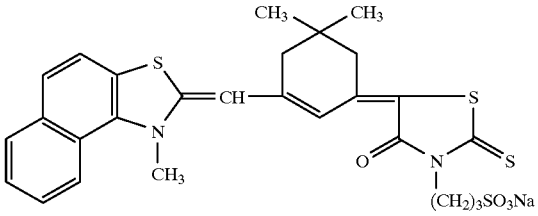

V-6

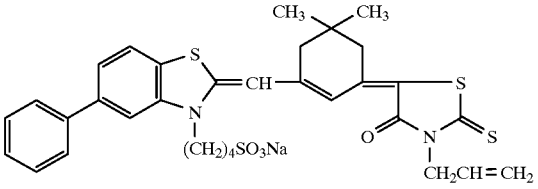

V-7

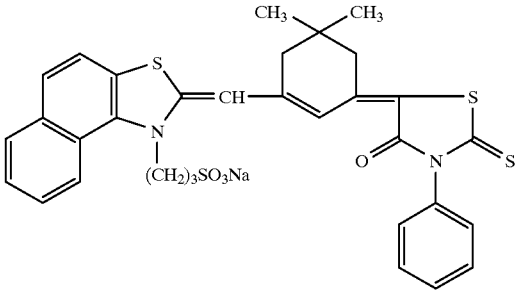

V-8

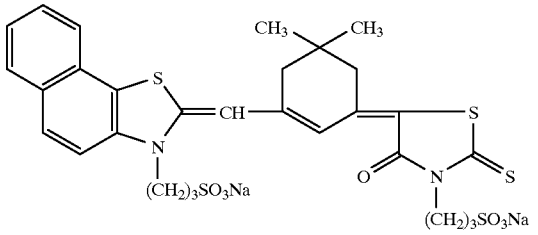

V-9

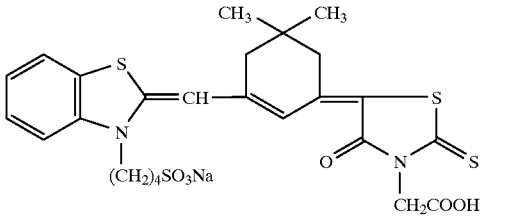

-continued

V-10

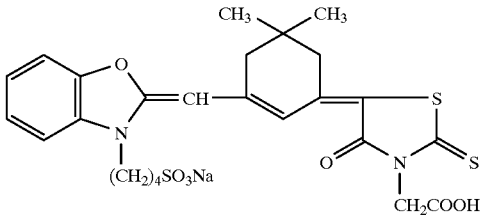

VI-1

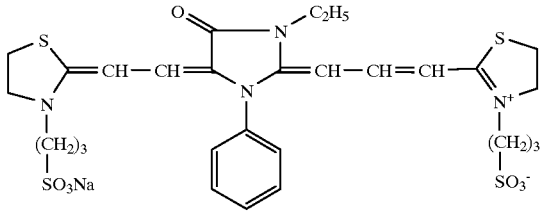

VI-2

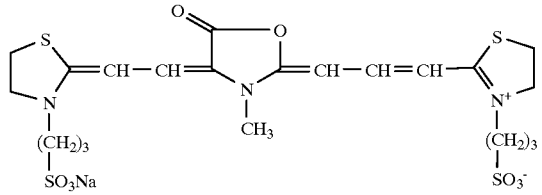

VI-3

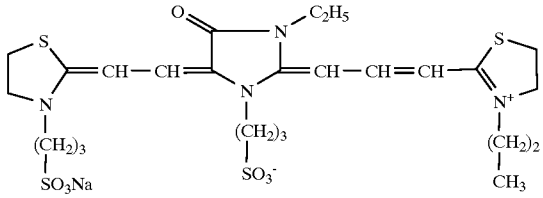

The above-described sensitizing dye is incorporated in an amount of 1 mg to 2 g and preferably 3.5 mg to 1 g per mol of silver halide.

The silver halide grains can also be spectrally sensitized with a sensitizing dye represented by the following formula (VII) or (VIII):

Formula (VII)

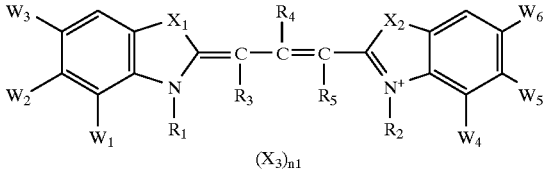

In the formula, $W_1$ and $W_4$ represent a hydrogen atom; $W_2$, $W_3$, $W_5$ and $W_6$ each represent a hydrogen atom, alkyl group, alkoxy group, hydroxy group, halogen atom, cyano group, aryl group, aryloxy group, alkylthio group, acylamino group, acyl group, alkylsulfamoyl group, carboxyl group, or alkoxycarbamoyl group, provided that $W_2$ may combine with $W_1$ or $W_3$, or $W_5$ may combine with $W_4$ or $W_6$ to form a benzene ring. $W_3$ and $W_6$ are preferably an alkyl group or alkoxy group, each of which preferably has a total carbon atoms of 6 or less. Methyl group or methoxy group is more preferred. $W_2$ is preferably an alkyl group with a total carbon atoms of 6 or less (e.g., methyl, ethyl, butyl isobutyl, hexyl, methoxyethyl), alkoxy group with a total carbon atoms of 5 or less (e.g., methoxy, ethoxy, pentyloxy, ethoxymethoxy, hydroxyethoxy), halogen atom (e.g., chlorine atom, bromine atom, iodine atom) or aryl group (e.g., phenyl, tolyl, anisyl, chlorophenyl, carboxyphenyl), and $W_2$ may combine with $W_1$ or $W_3$ to form a benzene ring. When $W_3$is methyl or methoxy, $W_2$ is preferably a chlorine atom. $W_5$ is preferably an alkyl group with total carbon atoms of 6 or less (e.g., methyl, ethyl, butyl, isobutyl, hexyl, methoxyethyl), hydroxy, halogen atom, aryl group with total carbon atoms of 9 or less (e.g., phenyl, tolyl, anisyl, chlorophenyl, carboxyphenyl), aryloxy group with total carbon atoms of 9 or less (e.g., tolyloxy, anisyloxy, phenoxy, chlorophenyoxy), arylthio with total carbon atoms of 8 or less (e.g., tolylthio, chlorophenylthio, phenylthio), alkylthio as group with total carbon atoms of 4 or less (e.g., methylthio, ethylthio, hydroxyethylthio), acylamino with total carbon atoms of 4 or less (e.g., acetylamino, propionylamino, methanesulfonylamino), and $W_5$ may combine with $W_4$ or $W_6$ to form a benzene ring.

$X_1$ and $X_2$ each represent an oxygen atom, sulfur atom or >NR, in which R represents an alkyl group or alkenyl group. $X_1$ and $X_2$ each are preferably an oxygen atom or >NR.

$R_1$ and $R_2$, which may be the same or different from each other, are preferably an alkyl or alkenyl group with a total carbon atoms of 10 or less. The alkyl group or alkenyl group may be substituted. Examples of substituents include a sulfo group, carboxy group, hydroxy group, alkoxy group with total carbon atoms of 6 or less, aryl group with total carbon atoms of 8 or less (e.g., phenyl, tolyl, sulfophenyl, carboxyphenyl), heterocyclic group (e.g., furyl, thienyl), aryloxy group with total carbon atoms of 8 or less (chloropheoxy, pheoxy, sulfopheoxy, hydropheoxy, hydroxyphenoxy), acyl group with total carbon atoms of 8 or less (e.g., benzenesulfonyl, methanesulfonyl, acetyl, propionyl)alkoxycarbonyl group with total carbon atoms of 6 or less (e.g., ethoxycarbonyl, butoxycarbonyl), cyan group, alkylthio group with total carbon atoms of 6 or less (e.g., methylthio, ethylthio), arylthio group with total carbon atoms of 8 or less (e.g., phenylthio, tolylthio), carbamoyl group with total carbon atoms of 8 or less (e.g., carbamoyl, N-ethylcarbamoyl) and acylamino group with total carbon atoms of 8 or less (acetylamino, methanesulfonylamino). At least of $R_1$ and $R_2$ contains a sulfo group or carboxy group.

Examples of $R_1$ and $R_2$ include methyl, ethyl, propyl, allyl, pentyl, hexyl, methoxyethyl, ethoxyethyl, phenethyl, tolylethyl, sulfophenethyl, 2,2,2-trifluoroethyl, 2,2,3,3-tetrasulfopropyl, carbamoylethyl, hydroxyethyl, 2-(2-hydroxyethoxy)ethyl, carboxymethyl, carboxyethyl, ethoxycarbonylmethyl, sulfoethyl, 2-chloro-3-sulfopropyl, 3-sulfopropyl, 2-hydroxy-3-sulfopropyl, 3-sulfobutyl, 4-sulfobutyl, 2-(2,3-dihydroxypropyloxy)ethyl or 2-[2-(3-sulfopropyloxy)ethoxy]ethyl.

$R_3$, $R_4$ and $R_5$ each are preferably a lower alkyl group, which may be substituted (e.g., methyl, ethyl, propyl, methoxyethyl, benzyl, phenethyl). $X_3$ represents a counter ion necessary for neutralizing charge; n1 is 0 or 1 and when intramolecular salt is formed, n1 is 0.

Formula (VIII)

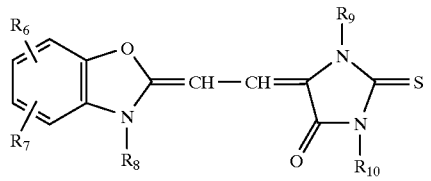

In the formula, $R_6$ and $R_7$ each represent a hydrogen atom, halogen atom (e.g., chlorine atom, bromine atom), alkyl group (preferably with 1 to 8 carbon atoms), which may be substituted (e.g., methyl, ethyl, butyl), hydroxy group, alkoxy group, phenyl group, naphthyl group, sulfo group or carboxy group, provided that $R_6$ and $R_7$ may combine with each other to form a ring. $R_8$ represents an alkyl group or aryl group (preferably, alkyl group), $R_9$ represents a hydrogen atom or an alkyl group (preferably with 1 to 12 carbon atoms). $R_{10}$ represents a halogen atom (e.g., chlorine, bromine), lower alkyl group, hydroxy group, hydroxyalkyl group, alkoxy group, sulfo group, or a pyridyl or phenyl group which may be substituted by a carboxy group.

The compound represented by formula (VII) is preferably represented by formula (VII-a):

Formula (VII-a)

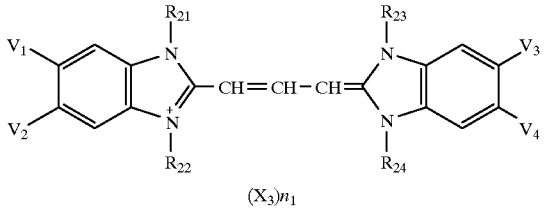

wherein $V_1$ and $V_3$ represent a hydrogen atom or an electron withdrawing group; and $V_2$ and $V_4$ represents an electron withdrawing group. Examples of preferred electron withdrawing groups include a halogen atom, lower perfluoroalkyl group (preferably, with 5 or less carbon atoms, such as trifluoromethyl, 2,2,2-trifluoroethyl, 2,2,3,3-tetrafluoropropyl), acyl group (preferably with 8 or less carbon atoms, such as acetyl, propionyl, benzoyl, mecityl, benzenesulfonyl), alkylsulfamoyl group (preferably with 5 or less carbon atoms, such as methylsulfamoyl, ethylsulfamoyl), carboxyl group, alkoxycarbonyl group (preferably with 5 or less carbon atoms), such as methoxycarbonyl, ethoxycarbonyl, butoxycarbonyl), and cyano group. $R_{21}$ and $R_{22}$ $R_{23}$ and $R_{24}$ each represent an alkyl group or alkenyl group, each of which has 20 or less carbon atoms. At least one of $R_{21}$ and $R_{22}$ $R_{23}$ and $R_{24}$ is a substituted alkyl group. Examples of a substituent include a carboxy group, sulfo group, cyano group, halogen atom (e.g., fluorine, chlorine, bromine), hydroxy group, alkoxy group with 5 or less carbon atoms (e.g., 2-methoxyethyl, 2-ethoxyethyl, 3-methoxypropyl, 3-ethoxypropyl), alkoxycarbonyl group with 8 or less carbon atoms (e.g., methoxycarbonyl, phenoxycarbonyl, ethoxycarbonyl, benzyloxycarbonyl), monocyclic aryloxy group with 10 or less carbon atoms (e.g., pheoxy, p-tolyloxy), acyloxy group with 3 or less carbon atoms (acetyl, propionyl, benzoyl, mesyl), carbamoyl group (carbamoyl, N,N-dimethylcarbamoyl, morphorinocarbonyl, piperidinocarbonyl), sulfamoyl group (e.g., sulfamoyl, N,N-dimethylsulfamoyl, morphorionosulfonyl, piperidinosulfonyl)aryl group with 10 or less carbon atoms (e.g., phenyl, 4-chlorophenyl, 4-methylphenyl, α-naphthyl), —$CONHSO_2$—$R_{25}$— and —$SO_2NHCO$—$R_{26}$, in which $R_{25}$ and $R_{26}$ are an alkyl group with 18 or less carbon atoms, preferably 8 or less carbon atoms and more preferably 4 or less carbon atoms. In the formula, $X_3$ and n1 each are the same as defined in formula (VII).

Exemplary examples of dyes represented by formula (VII) or (VII-a) are shown below, but the dyes are not limited to these examples.

VII-1

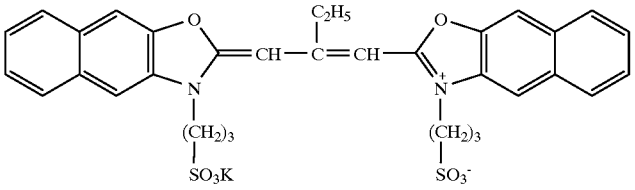

VII-2

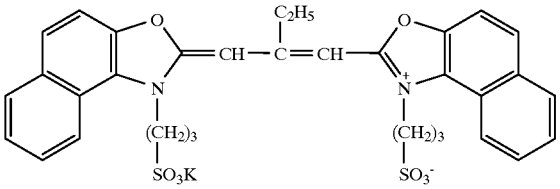

VII-3

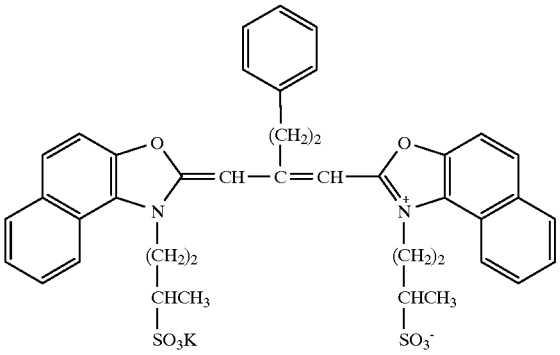

VII-4

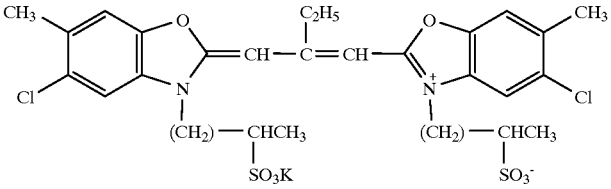

VII-5

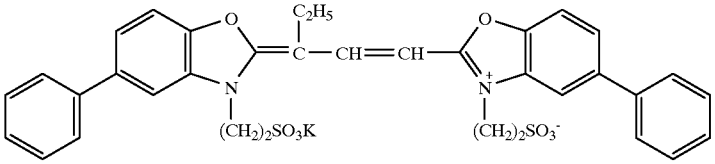

VII-6

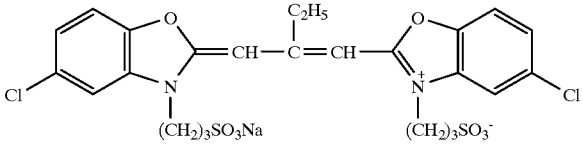

-continued
VII-7
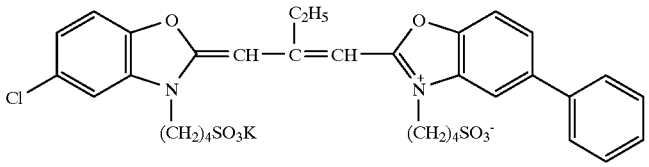
VII-8
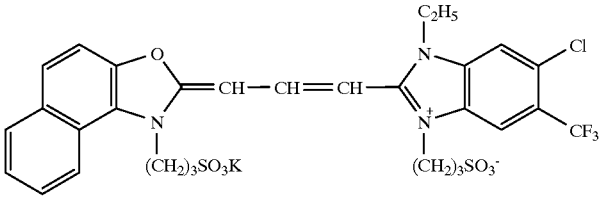
VII-9
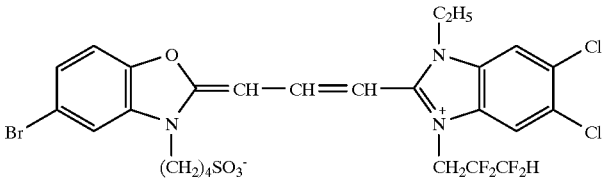
VII-10
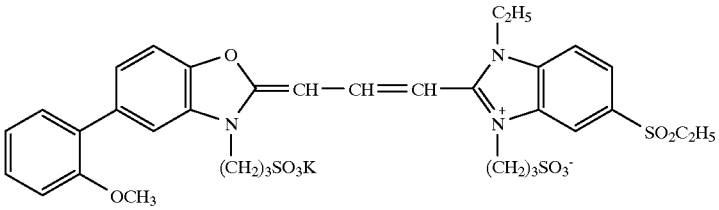
VII-11
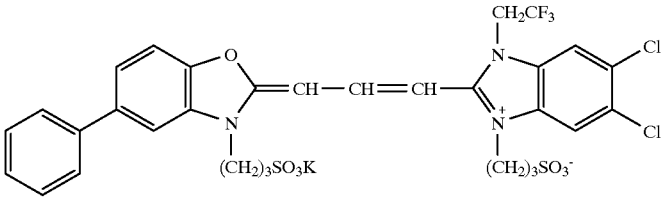
VII-12
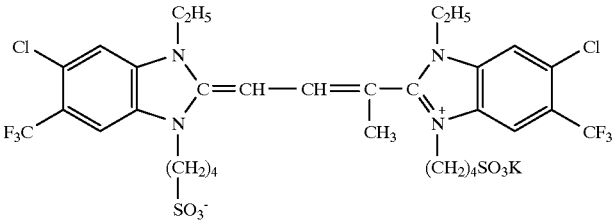
VII-13
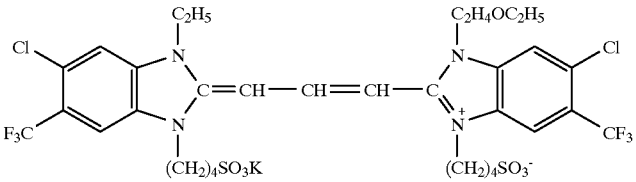

-continued
VII-14
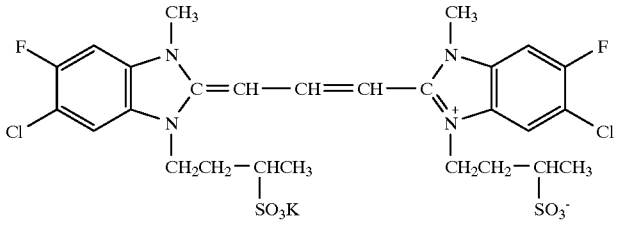
VII-15
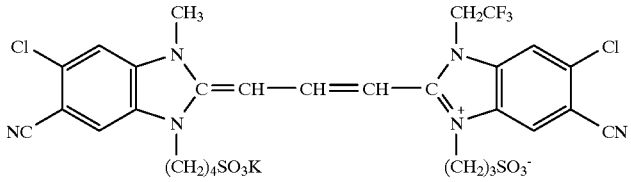
VII-16
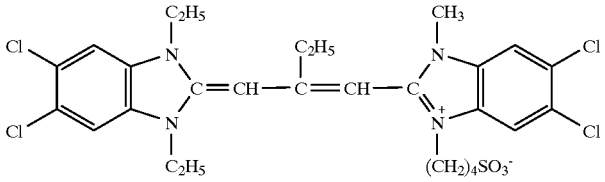
VII-17
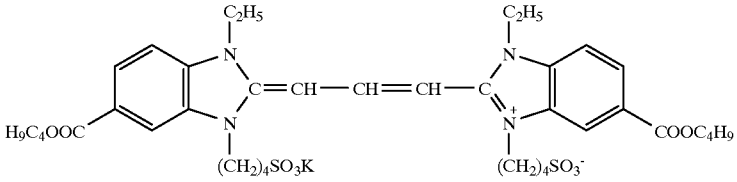
Exemplary examples of dyes represented by formula (VIII) are shown below, but the dyes are not limited to these examples.
II-1
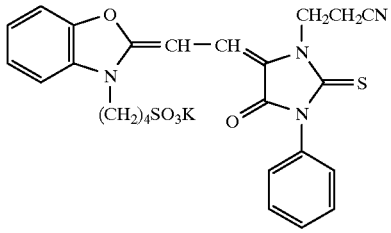
II-2
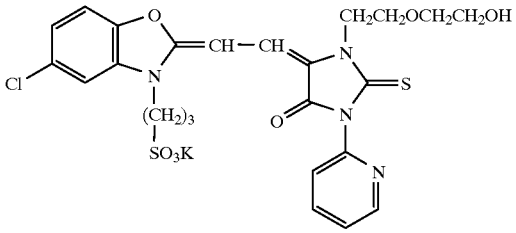
-continued
II-3
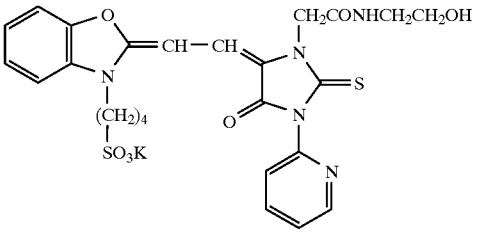
II-4
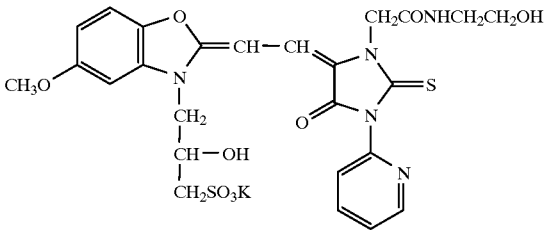

-continued

II-5

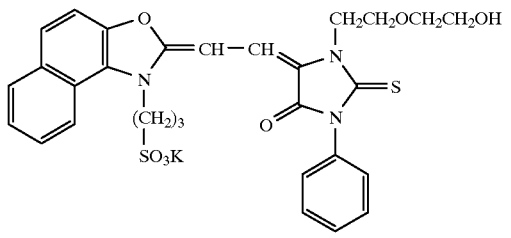

II-6

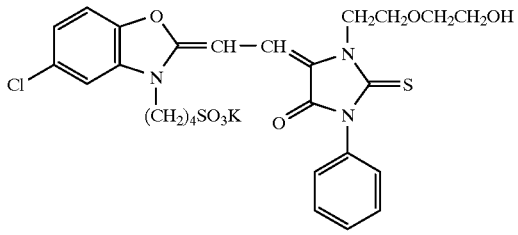

A component layer of the photographic material according to the invention preferably contains a hydrazine compound represented by the following formula (H):

Formula (H)

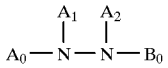

In the formula, $A_0$ is an aliphatic group, aromatic group or heterocyclic group. The aliphatic group represented by $A_0$ is an alkyl group having 1 to 30 carbon atoms, preferably 1 to 20 carbon atoms, which may be straight-chained, branched or cyclic. Examples thereof include methyl, ethyl, t-butyl, octyl, cyclohexyl and benzyl groups, which may be substituted by a substituent such as an aryl group, alkoxy group, aryloxy group, alkylthio group, arylthio group, soulfully group, sulfonamido group, sulfamoyl group, acylamino group or ureido group.

In formula (H), as the aromatic group represented by $A_0$ is cited a monocyclic or condensed cyclic aryl group such as a benzene ring or naphthalene ring. In formula (H), the heterocyclic group represented by $A_0$ is preferably a heterocyclic group containing a hetero-atom selected from nitrogen, sulfur and oxygen, including a pyrrolidine ring, imidazole ring, tetrahydrofuran ring, morpholine ring, pyridine ring, quinoline ring, thiazole ring, benzthiazole ring, thiophene ring and furan ring. Among these, $A_0$ is preferably an aryl group or heterocyclic group. The aryl group or heterocyclic group is preferably substituted. As examples of preferable substituents are those having an acidic group with a pKa of 7 to 11, such as sulfonamido, hydroxy, or mercapto group.

$A_0$ contains preferably a diffusion-proof group or a group promoting adsorption to silver halide. The diffusion-proof group is preferably a ballast group, which is used in non-diffusible photographic additives such as a coupler. As the ballast group is cited a photographically inactive group having 8 or more carbon atoms such as an alkyl group, alkenyl group, alkynyl group, alkoxy group, phenyl group, pheoxy group and alkylpheoxy group.

As examples of the group promoting adsorption to silver halide are cited a thiourea group, thiourethane group, mercapto group, thioether group, thione group, heterocyclic group, thioamido heterocyclic group, mercapto group and an adsorbing group as described in JP-A 64-90439.

$B_0$ represents a blocking group, preferably, $$—G_0—D_0$$

wherein $G_0$ is —CO—, —COCO—, —CS—, —C(=$NG_1D_1$)—, —SO—, —$SO_2$— or —P(O) ($G_1D_1$)—, in which $D_1$ is a hydrogen atom, an aliphatic hydrocarbon group, aromatic hydrocarbon group or heterocyclic group. In the case where plural $D_1$s are present in a molecule, they may be the same or different from each other. $G_0$ is preferably —CO— or —COCO—, more preferably, —COCO—.

$D_0$ is an aliphatic hydrocarbon group, aromatic hydrocarbon group, heterocyclic group, amino group, alkoxy group, aryloxy group, alkylthio group or arylthio group. $D_0$ is preferably a hydrogen atom, alkoxy group or amino group. $A_1$ and $A_2$, both of them are hydrogen atoms, or one of them is a hydrogen atom and the other is an acyl group such as acetyl group, trifluoroacetyl or benzoyl, sulfonyl group such as methanesulfonyl or toluenesulfonyl or oxalyl group such as ethoxalyl.

The compound represented by formula (H) is preferably represented by the following formula (H-2):

$$R_0—SO_2NH—Ar—NHNH—G_0—D_0 \qquad \text{Formula (H-2)}$$

wherein $R_0$ represents an alkyl group, aryl group or heterocyclic group, each of which may be substituted; Ar represented a substituted or unsubstituted a bivalent arylene group or heterocyclic group; and $G_0$ and $D_0$ are the same as defined in Formula (H).

Examples of the compound represented by formula (H) are shown as below, but the compound is not limited thereto.

H-1

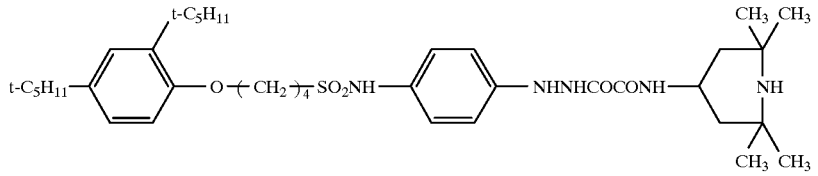

-continued
H-2
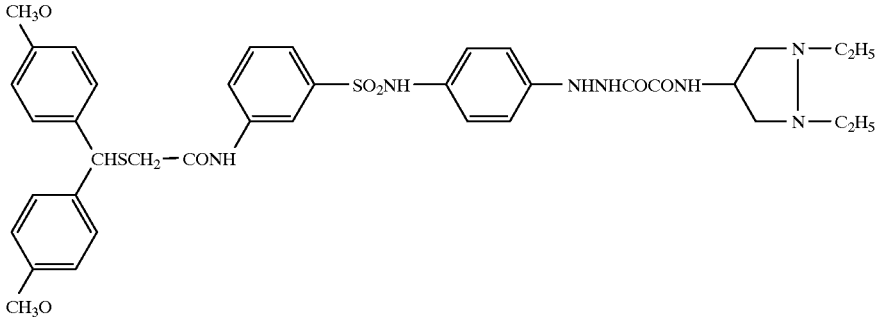
H-3
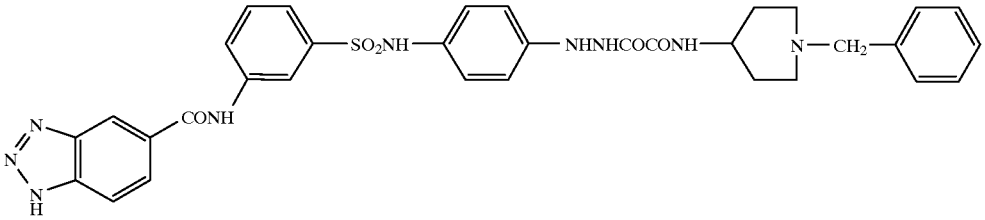
H-4
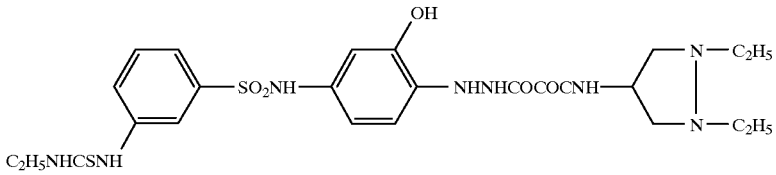
H-5
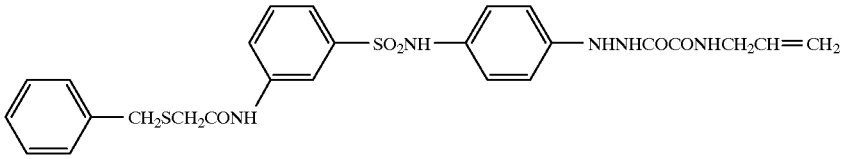
H-6
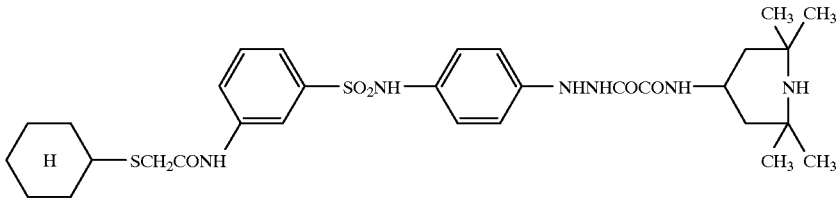
H-7
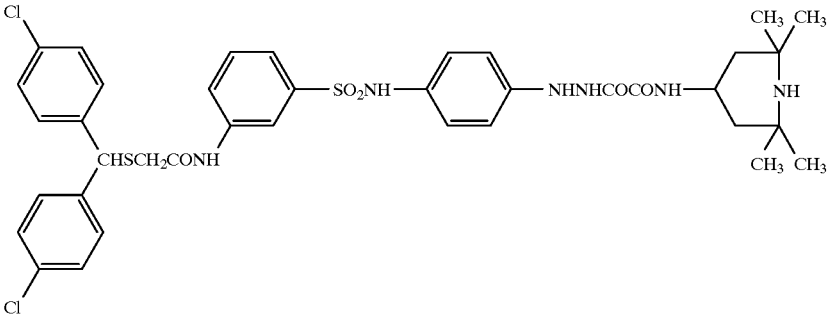

-continued
H-8
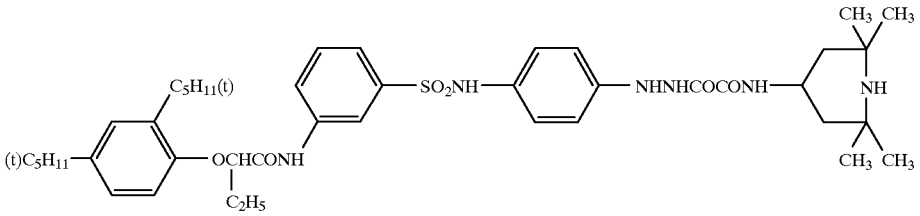
H-9
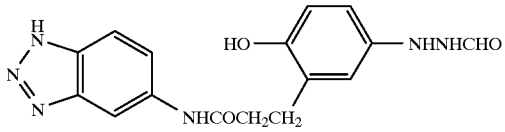
H-10
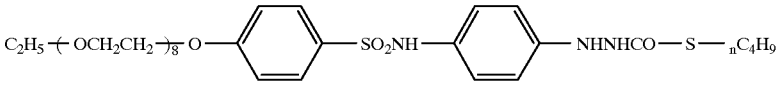
H-11
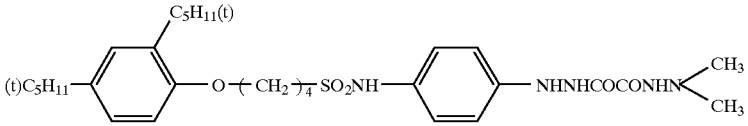
H-12
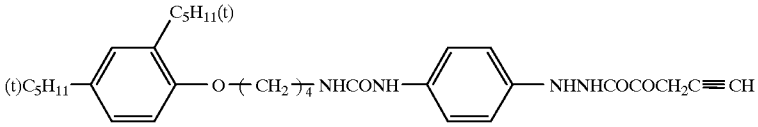
H-13
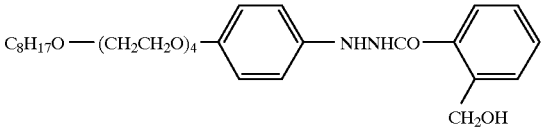
H-14
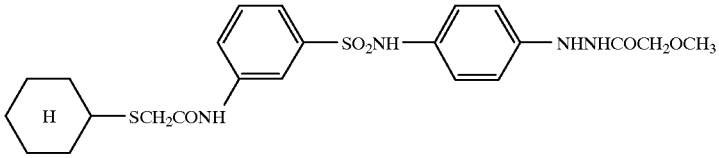
H-15
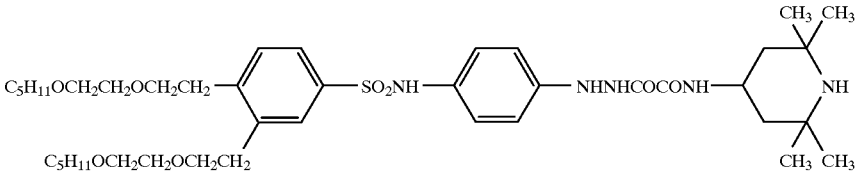
H-16
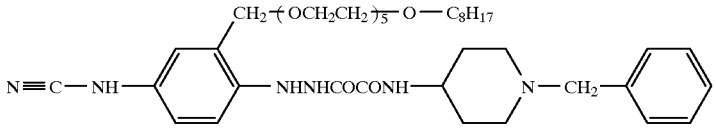

-continued
H-17
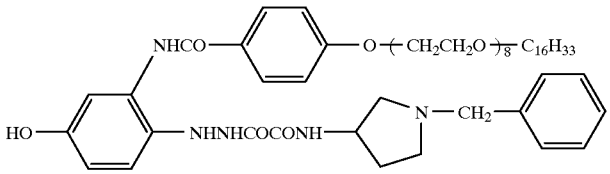
H-18
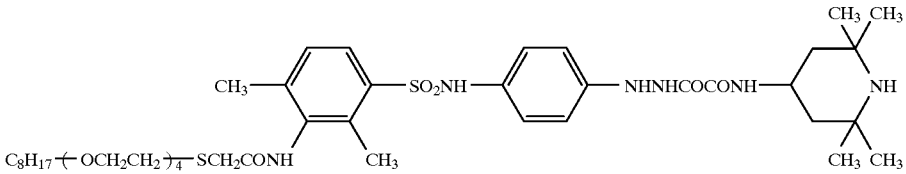
H-19
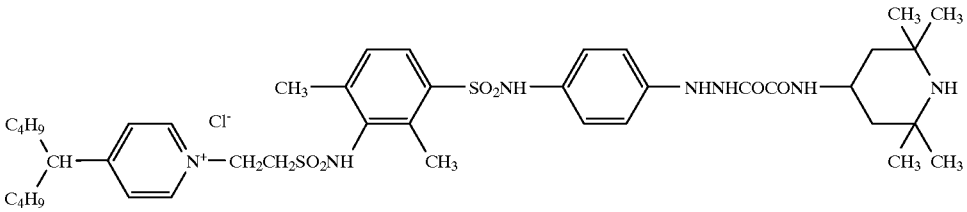
H-20
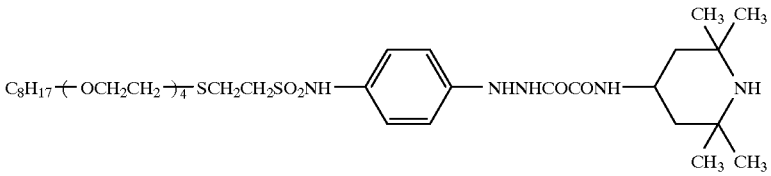
H-21
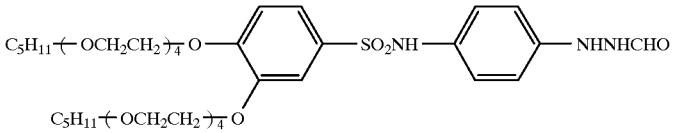
H-22
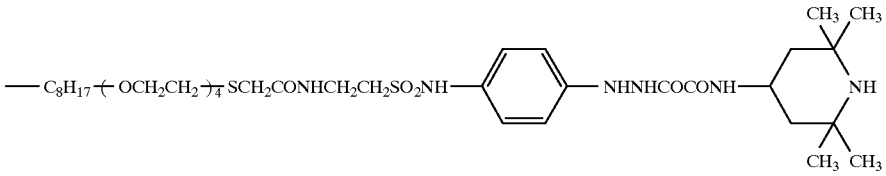
H-23
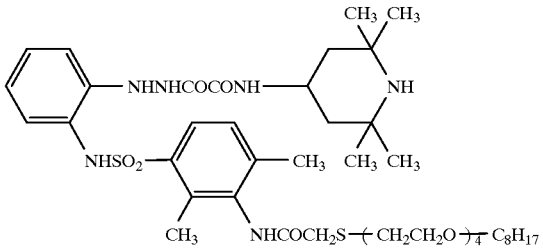
H-24
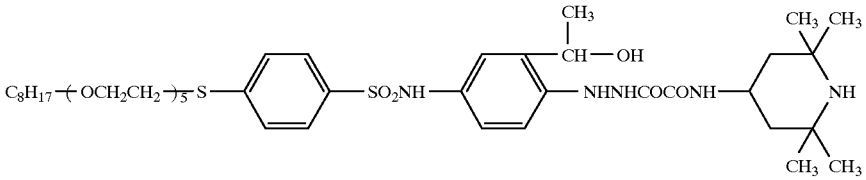

-continued

H-25

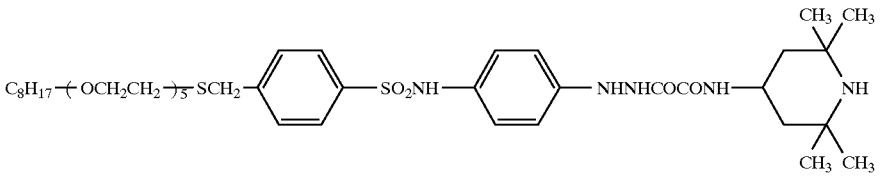

In the present invention, it is preferred to employ a nucleation accelerating agent, as represented by formula (Na) or (Nb) to promote contrast-increase.

Formula (Na)

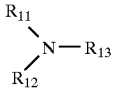

Formula (Nb)

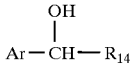

In formula (Na), $R_{11}$, $R_{12}$ and $R_{13}$ represents a hydrogen atom, substituted or unsubstituted alkyl group, substituted or unsubstituted alkenyl group, alkynyl group, substituted or unsubstituted aryl group. $R_{11}$, $R_{12}$ and $R_{13}$ may be combined with each other to form a ring. A preferable nucleation accelerating agent is an aliphatic tertiary amine compound. The compound has preferably a ballast group or a group capable of adsorbing to silver halide. To be diffusion-proofing, the compound has preferably a molecular weight of 100 or more, preferably 300 or more. As the adsorbent group to silver halide are cited a heterocyclic group, mercapto group, thioether group, thione group and thiourea group.

Examples of the nucleation accelerating agent of formula (Na) are shown as below.

Na-1

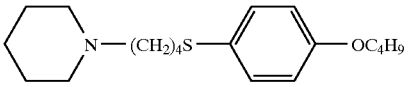

Na-2

Na-3

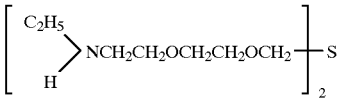

Na-4

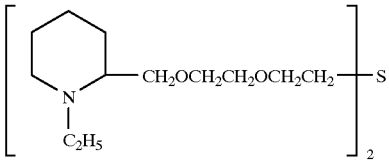

Na-5

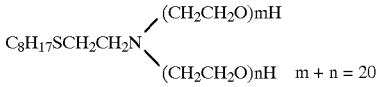

Na-6

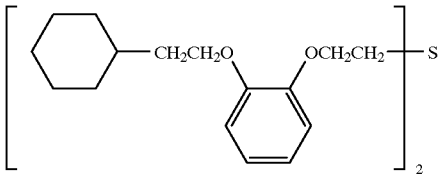

Na-7

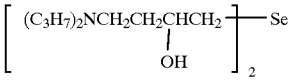

Na-8

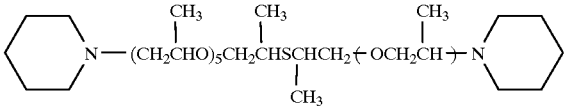

Na-9

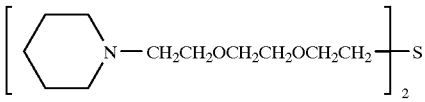

Na-10

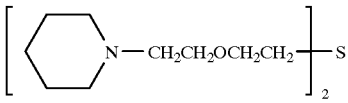

-continued

Na-11

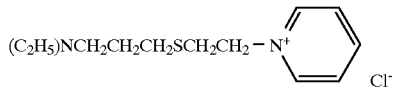

Na-12

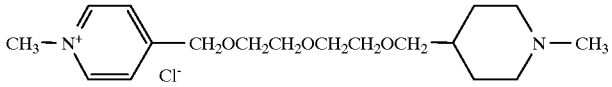

Na-13

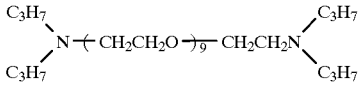

Na-14

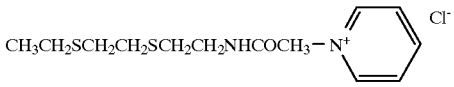

Na-15

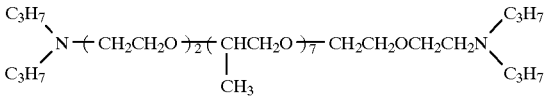

Na-16

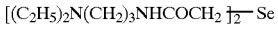

Na-17

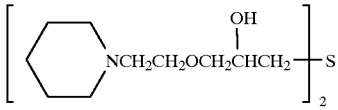

Na-18

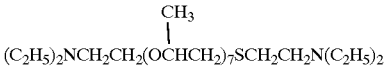

Na-19

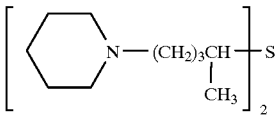

As a preferred embodiment of the compound represented by formula (Na) is cited a compound represented by the following formula (Na2).

Formula (Na2)

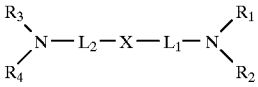

wherein $R_1$, $R_2$, $R_3$ and $R_4$ each represent a hydrogen atom, an alkyl group, alkenyl group, alkynyl group, aryl group, and heterocyclic group, each of which may be substituted. $R_1$ and $R_2$, or $R_3$ and $R_4$ may combine with each other to form a ring, provided that $R_1$ and $R_2$, or $R_3$ and $R_4$ are not hydrogen atoms at the same time.

X represents S, Se or Te. $L_1$ and $L_2$ represent a bivalent linkage group. Thus, the linkage group is a combination of the following groups:

—$CH_2$—, —CH═CH—, —$C_2H_4$—, pyridyl, —N($Z_1$)—, —O—, —S—

—(CO)—, —($SO_2$)—, and —$CH_2NH$— in which $Z_1$ represents a hydrogen atom, alkyl group or aryl group. The above groups may be substituted by a substituent such as an alkylene, alkenylene, arylene, acylamino, sulfonamido. The linkage group further contain preferably at least one of the following groups:

—[$CH_2CH_2O$]—, —[CH($CH_3$)$CH_2O$]—, —[OCH($CH_3$)$CH_2O$]— and —[$OCH_2CH(OH)CH_2$]—

In formula (Nb), Ar represents an aromatic hydrocarbon group or heterocyclic group, each of which may be substituted. $R_{14}$ represents a hydrogen atom, alkyl group, alkynyl group, or aryl group. Ar and $R_{14}$ may be combined with each other to form a ring. The compound preferably has a ballast group or a group capable of adsorbing to silver halide. To be diffusion-proofing, the compound has preferably a molecular weight of 120 or more, preferably 300 or more. Preferable group capable of adsorbing to silver halide is the same as the adsorbent group contained in the compound of formula (Na).

Examples of the compounds represented by formula (Nb) are shown as below.

Nb-1

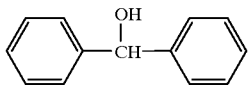

Nb-2

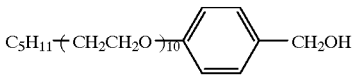

Nb-3

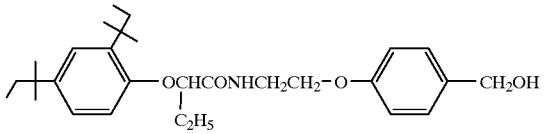

Nb-4

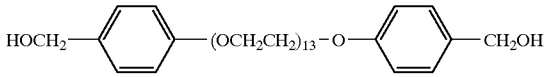

-continued

Nb-5

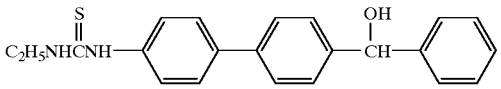

Nb-6

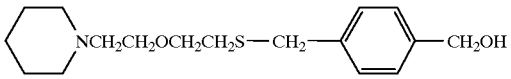

Nb-7

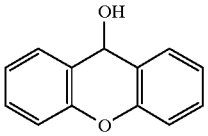

Nb-8

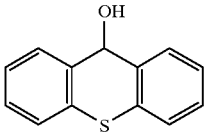

Nb-9

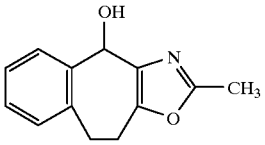

Nb-10

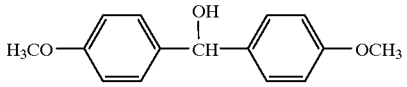

Nb-11

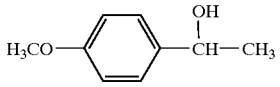

Nb-12

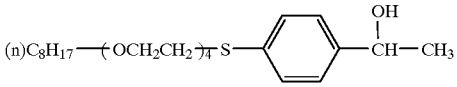

In particular, he use of the nucleation accelerating agent with a molecular weight of 200 or more leads to marked effects.

The hydrazine compound and nucleation accelerating agent used in the invention mat be incorporated into any of the layers provided on the emulsion layer-side. These compounds are preferably incorporated in a silver halide emulsion layer or an adjacent layer thereto. The amount to be incorporated is preferably $10^{-6}$ to $10^{-1}$ mol and preferably $10^{-5}$ to $10^{-2}$ mol per mol of silver halide.

Further examples of the nucleation accelerating agent include onium salts described in JP-A 7-270957, compounds represented by formula I described in JP-A 7-104420, and thiosulfonic compounds described in JP-A 2-103536 (page 17, right lower column line 19 to page 18, right upper column, line 4) and JP-A 1-237538.

At least one of component layers of the photographic material according to the invention preferably preferably contains the hydrazine compound afore-mentioned and a redox DIR compound capable of releasing a development inhibitor. The redox DIR compound has a moiety, as a redox group, such as hydroquinones, catechols, naphthohydroquinones, aminophenols, pyrazolidones, hydrazines, reductones or α-aminoketones.

The redox DIR compound is preferably a compound containing —NHNH— group or a compound represented by formula (3), (4), (5), (6), (7) or (8), as shown below.

The DIR compound containing —NHNH— is preferably one represented by formula (RE-a) or (RE-b).

Formula (RE-a)

T-NHNHCO-(Tm)n-PUG

Formula (RE-b)

T-NHNHCOCO-(Tm)n-PUG

In the formula, T represents an aryl group or alkyl group, each of which may be substituted. The aryl group includes a benzene ring or naphthalene ring, which may be substituted. Preferred substituents include a straight chained or branched alkyl group (preferably having 2 to 20 carbon atoms, e.g., methyl, ethyl, isopropyl, dodecyl), alkoxy group (preferably having 2 to 21 carbon atoms, e.g., methoxy, ethoxy), aliphatic acylamino group (preferably having 2 to 21 carbon atoms, e.g., acetylamino, heptylamino), and aromatic acylamino group. In addition, the aryl group further include the above aromatic ring bonded by a linkage group such as —CONH—, —O—, —$SO_2$NH—, —NHCONH—, or —$CH_2$CHN—.

Tm represents a timing group, and n is 0 or 1. PUG represents a compound capable of acting as a development inhibitor when being released. examples of the development inhibitor include 5-nitroindazole, 4-nitroindazole, 1-phenyltetrazole, 1-(3-sulfonyl)tetrazole, 5-nitrobenzotriazole, 4-nitrobenzotriazole, 5-nitroimidazole and 4-nitroimidazole. The development inhibitor, which is bonded to the —CO— or —COCO— linked to T—NHNH—, through a hetero atom such as N or S and/or a linkage group (e.g., alkylene, aralkylene or arylene), can control timing of inhibiting development. Further, there is also usable a hydroquinone compound with a ballast group, which has a development inhibiting group such as triazole, indazole, imidazole, thiazole or thiadiazole. Examples thereof include 2-(dodecylethyleneoxide-thiopropioneamido)-5-(5-nitroindazole-2-yl)hydroquinone, 2-(stearylamido)-5-(1-phenyltetrazole-5-thio) hydroquinone, 2-(2,4-di-t-amylphenoxypropioneamido)-5-(5-nitrotriazole-2-yl)hydroquinone, 2-dodecylthio-5-(2-mercaptothiothiadiazole-5-thio)hydroquinone.

The above-described DIR compounds can be synthesized by referring to methods described in U.S. Pat. No. 4,269,929.

The redox DIR compound can be incorporated in any of component layers of the emulsion-side. The DIR compound preferably is incorporated in a silver halide emulsion layer nearest to the support and/or a light-insensitive hydrophilic colloidal layer adjacent to the emulsion layer. The DIR compound can be incorporated through dissolution in alcohols such as methanol ethanol, glycols such as ethylene glycol, triethylene glycol or propylene glycol, esters, dimethylformamide, dimethylsulfooxide, tetrahydrofuran, esters such as ethyl acetate or ketones such as acetone or methyl ethyl ketone. The compound which is scarcely soluble in water or organic solvents, can be dispersed so as to have an average particle size of 0.01 to 6 μm, by using a high-speed impeller, sand mill, ultrasonic homogenizer or ball mill. Dispersion can be performed by using an anionic or nonionic surfactant, thickener or latex in combination.

The DIR compound is incorporated in an amount of $10^{-6}$ to $10^{-1}$ and preferably $10^{-4}$ to $10^{-2}$ mol per mol of silver halide.

Preferred compounds represented by formula (RE-a) or (RE-b) are shown below.

RE-1
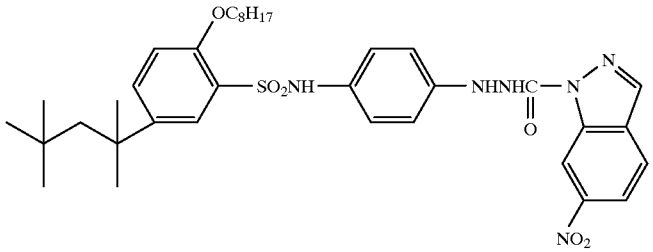
RE-2
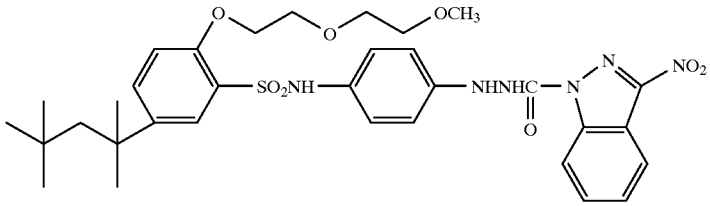
RE-3
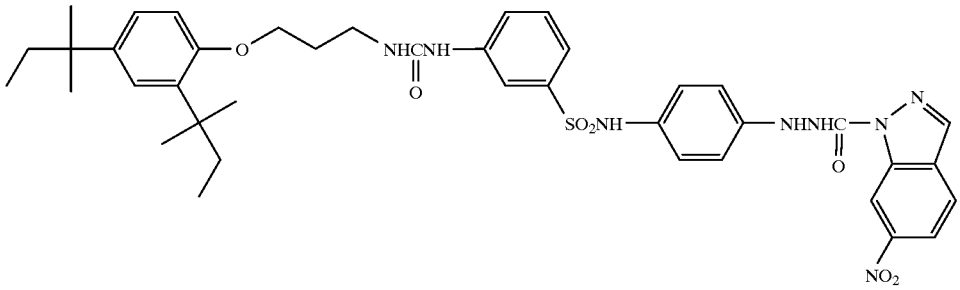
RE-4
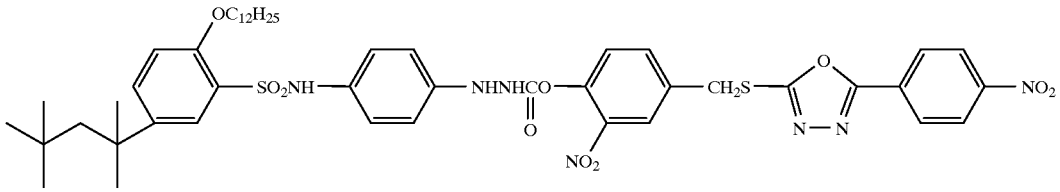
RE-5
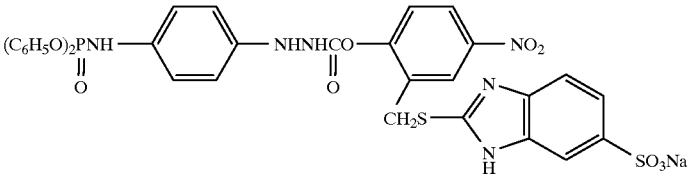
RE-6
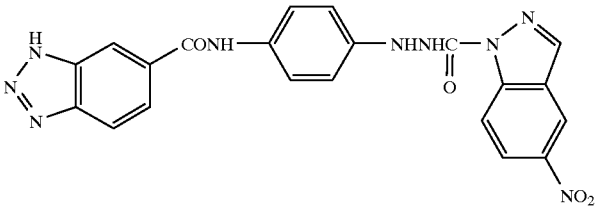

-continued
RE-7
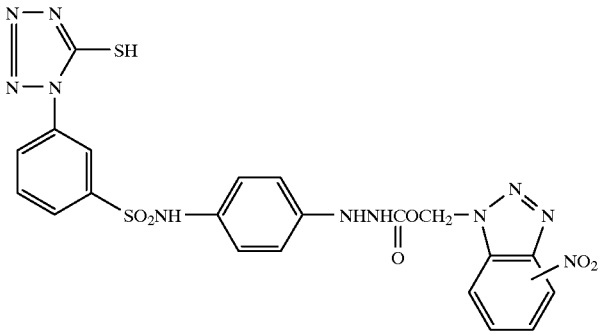
RE-8
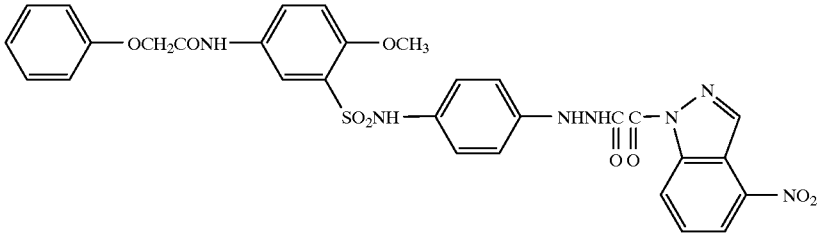
RE-9
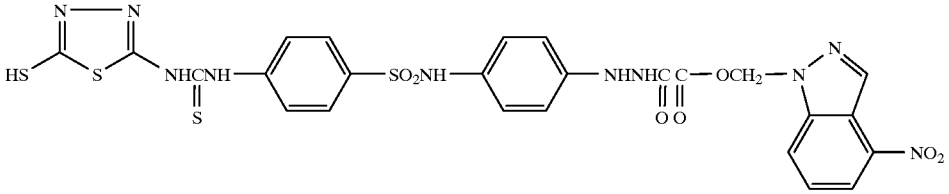
RE-10
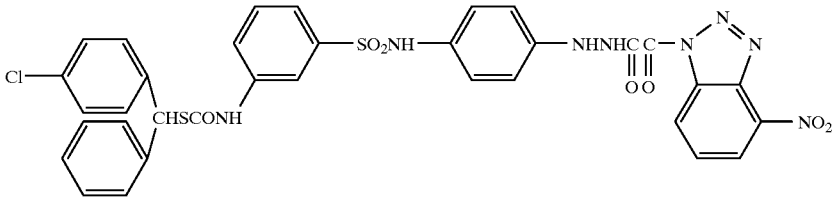
Further examples are referred to R-1 through R-50 described in JP-A 4-245243, (0053) at page 8 to (0068) at page 22.
Another type of the redox DIR compound is one represented by the following formulas (3) through (8).
Formula (3)
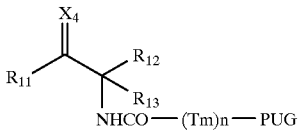
Formula (4)
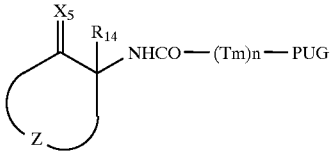
-continued
Formula (5)
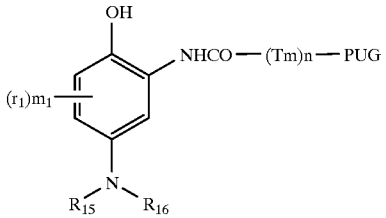
Formula (6)
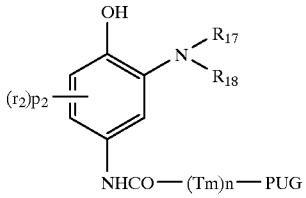

-continued

Formula (7)

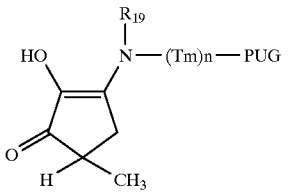

Formula (8)

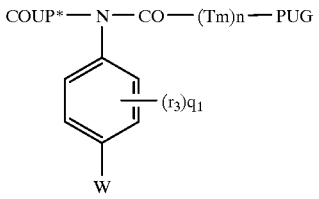

In the formulas, $R_{11}$ represents an alkyl group or aryl group; $R_{12}$ and $R_{13}$ each represent a hydrogen atom, acyl group, carbamoyl group, cyano group, nitro group, sulfonyl group, aryl group, oxalyl group, heterocyclic group, alkoxycarbonyl group, or aryloxycarbonyl group; $R_{15}$ through $R_{19}$ each represent a hydrogen atom, alkyl group, aryl group or heterocyclic group; $r_1$, $r_2$ and $r_3$ each represent a substituent; $X_4$ and $X_5$ each represent O or NH; Z represents an atomic group necessary for forming a 5 or 6-membered ring; W represents N($R_{50}$($R_{51}$ or OH, in which $R_{50}$ and $R_{51}$ each represent a hydrogen atom, alkyl group or aryl group; COUP represents a coupler moiety capable of coupling with an oxidation product of a developing agent of an aromatic primary amine; * represents the coupling position of a coupler; Tm represents a timing group; $m_1$ and $p_1$ are each an integer of 0 to 3; $q_1$ is an integer of 0 to 4; n is 0 or 1; and PUG represents a group which can act as a development inhibitor when being released.

The alkyl group, aryl group and heterocyclic group represented by $R_{11}$, $R_{15}$ through $R_{19}$, $R_{50}$ and $R_{51}$ are preferably methyl, p-methoxyphenyl and pyridyl. Of the acyl group, carbamoyl group, cyano group, nitro group, sulfonyl group, aryl group, oxalyl group, heterocyclic group, alkoxycarbonyl group and arylcarbonyl group represented by $R_{12}$ and $R_{13}$ are preferred the acyl group and carbamoyl group and cyano group. $R_{11}$ to $R_{19}$, $R_{50}$ and $R_{51}$ may be substituted. As examples of substituents are cited a halogen atom such as chlorine or bromine; alkyl group such as methyl, ethyl, isopropyl, hydroxyethyl, methoxyethyl, trifluoromethyl or t-butyl; cycloalkyl group such as cyclopentyl or cyclohexyl; alalkyl group such as benzyl or 2-phenethyl; aryl group such as phenyl, naphthyl, p-tolyl or p-chlorophenyl; alkoxy group such as methoxy, ethoxy, isopropoxy or n-butoxy; aryloxy group such as pheoxy; cyano group; acylamino group such as acetylamino or propionylamino; alkylthio group such as methylthio, ethylthio or n-butylthio; arylthio group such as phenylthio; sulfonylamino group such as methanesulfonylamino or benzenesulfonylamino; ureido group such as 3-methylureido, 3,3-dimethylureido or 1,3-dimethylureido; sulfamoylamino group such as dimethylsufamoylamino; carbamoyl group such as methylcarbamoyl, ethylcarbamoyl or dimethylcarbamoyl; sulfamoyl group such as ethylsulfamoyl or dimethylsulfamoyl; alkoxycarbonyl group such as methoxycarbonyl or ethoxycarbonyl; aryloxycarbonyl group such as phenoxycarbonyl; sulfonyl group such as methanesulfonyl, butanesulfonyl or phenylsulfonyl; acyl group such as acetyl, propanoyl or butyloyl; amino group such as methylamino, ethylamino group or dimethylamino; hydroxy group; imido group such as phthalimido; and heterocyclic group such as pyridyl, benzimidazolyl, benzthiazolyl or benzoxazolyl.

COUP represents a coupler moiety. As a cyan coupler moiety is cited a phenol coupler or naphthol coupler; as a magenta coupler is cited 5-pyrazolone, pyrazolone coupler, cyanoacetylcoumarone coupler, open-chained acylacetonitrile coupler or indazolone coupler. As a yellow coupler moiety is cited a benzoylacetoanilide coupler, pivaloylacetoanilide coupler or malonic-dianilide coupler. As a non-dye forming coupler is cited a open-chained or cyclic active methylene compound such as indanone, cyclopentanone, malonic diester, imidazoline, oxazolinone or thiazolinone. COUP is preferably represented by formulas (Coup-1) to (Coup-8).

Formula (Coup-1)

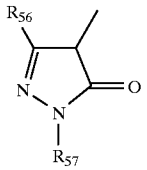

In the formula, $R_{56}$ represents an acylamido group, anilino group or ureido group; $R_{57}$ a phenyl group which may be substituted by one or more halogen atoms, alkyl groups, alkoxy groups or cyano groups.

Formula (Coup-2)

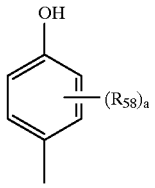

Formula (Coup-3)

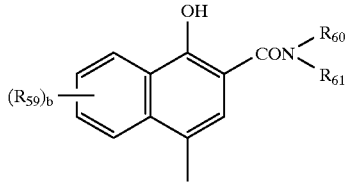

In the formulas, $R_{58}$ and $R_{59}$ each represent a halogen atom, acylamido group, alkoxycarbonylamido group, sulfoureido group, alkoxy group, alkylthio group, hydroxy group or aliphatic group; $R_{60}$ and $R_{61}$ each represent an aliphatic group, aromatic group or heterocyclic group and one of $R_{20}$ and $R_{21}$ may be a hydrogen atom; a is an integer of 1 to 4; b is an integer of 0 to 5, and when a or b is 2 or more, $R_{19}$ may be the same or different from each other.

Formula (Coup-4)

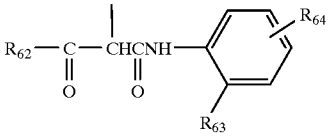

-continued

Formula (Coup-4)

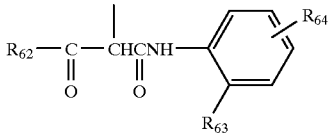

Formula (Coup-5)

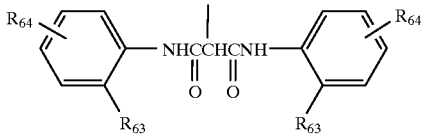

In the formula, $R_{62}$ represents a tertiary alkyl group or aromatic group; $R_{63}$ represents a hydrogen atom, halogen atom or alkoxy group; $R_{64}$ represents an acylamido group, aliphatic group, alkoxycarbonyl group, sulfamoyl group, carbamoyl group, alkoxy group, halogen atom or sulfonamido group.

Formula (Coup-6)

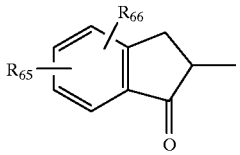

In the formula, $R_{65}$ represents an aliphatic group, alkoxy group, acylamino group, sulfonamido group, sulfamoyl group or diacylamino group; $R_{66}$ represents a hydrogen atom, halogen atom or nitro group.

Formula (Coup-7)

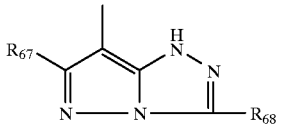

Formula (Coup-7)

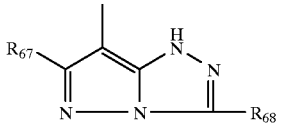

Formula (Coup-8)

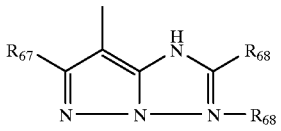

In the formulas, $R_{67}$ and $R_{68}$ each represent a hydrogen atom, aliphatic group, aromatic group or heterocyclic group.

Z represents a 5- or 6-membered heterocyclic ring having at least one of O, S and N, which may be monocyclic or a condensed ring, and may also be substituted. As a substituent thereof is cited one afore-described.

Tm represents a timing group including —$OCH_2$— or a bivalent timing group as described in U.S. Pat. Nos. 4,248,962, 4,409,328 and 3,674,478, Research Disclosure 21228 (December, 1981), JP-A 57-56837 and 4-438.

As the development inhibitor represented by PUG are cited development inhibitor as described in U.S. Pat. No. 4,477,563, JP-A 60-218644, 60-221750, 60-233650 and 61-11743.

Exemplary examples of the compounds represented by formulas (3) through (8) are shown below, but the compounds are not limited to these examples.

Tm-1

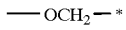

Tm-2

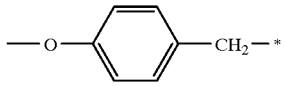

Tm-3

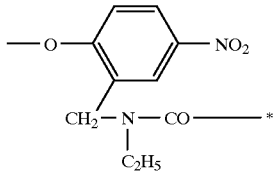

Tm-4

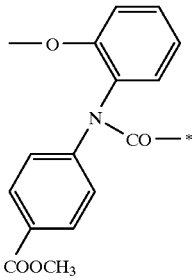

Tm-5

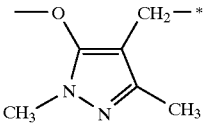

Tm-6

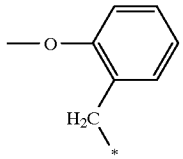

Tm-7

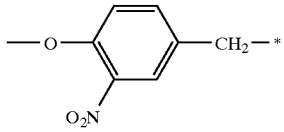

Tm-8

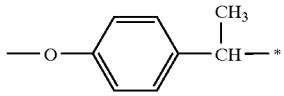

-continued
Tm-9
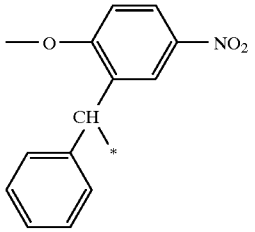
Tm-10
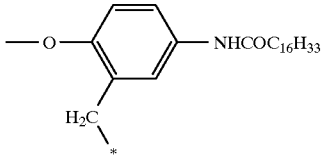
Tm-11
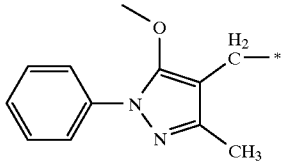
Tm-12
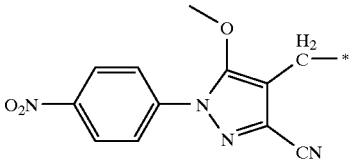
Tm-13
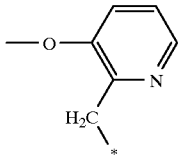
Tm-14
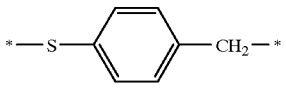
Tm-15
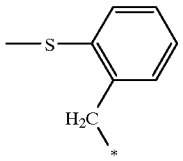
-continued
Tm-16
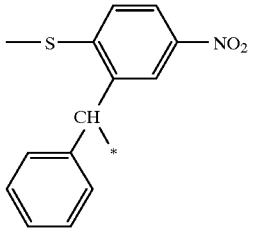
Tm-17
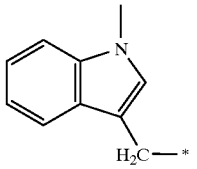
Tm-18
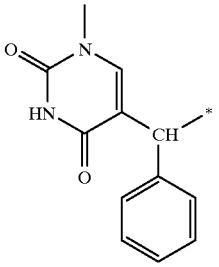
Tm-19
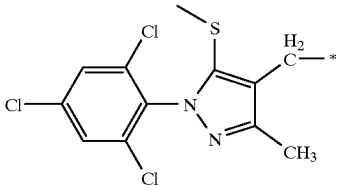
Tm-20
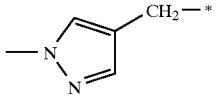
Tm-21
n = 0
In the above formulas, the symbol "*" represents the bonding position of PUG

*—PUG
1
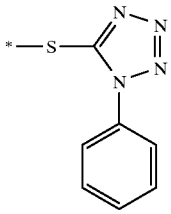
2
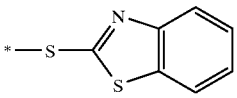
3
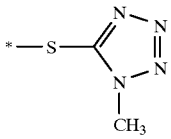
4
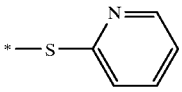
5
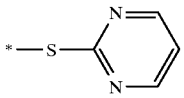
6
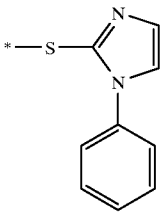
7
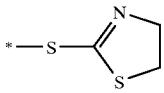
8
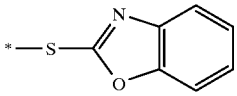
9
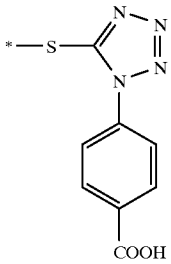
10
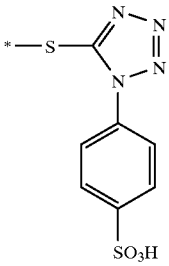
11
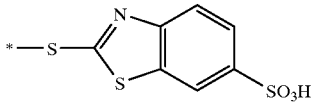
12
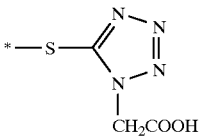
13
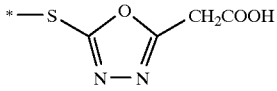
14
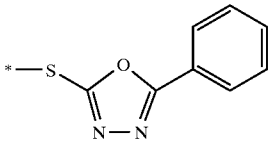
15
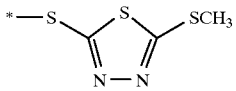
16
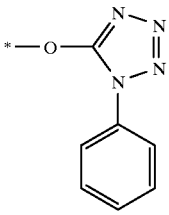

-continued
17
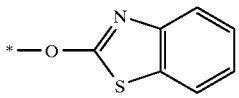
18
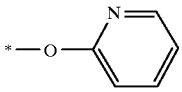
19
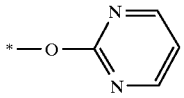
20
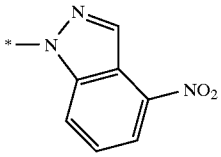
21
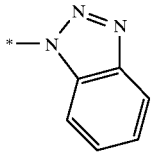
22
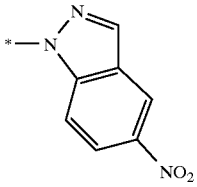
23
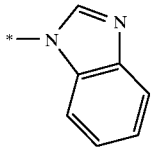
24
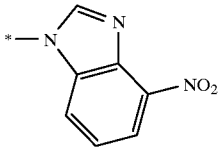
25
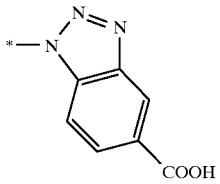
26
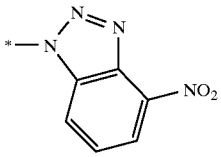
27
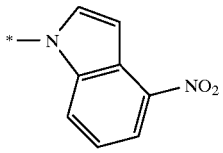
28
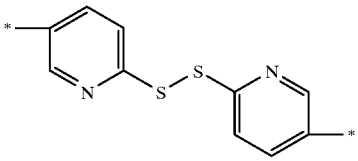
29
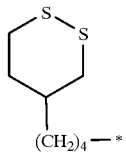
30
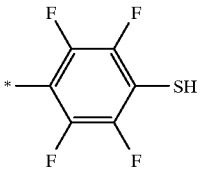
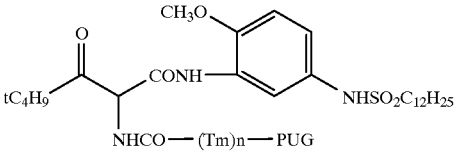
| Compound | Tm | PUG |
|---|---|---|
| 1 | 1 | 1 |
| 2 | 2 | 4 |
| 3 | 4 | 14 |
| 4 | 17 | 17 |
| 5 | 21 | 22 |

-continued
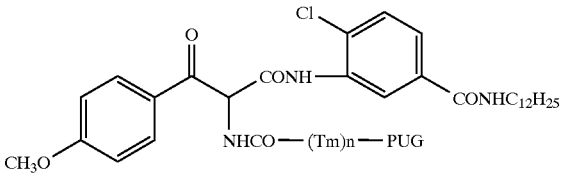
| Compound | Tm | PUG |
|---|---|---|
| 6 | 2 | 2 |
| 7 | 3 | 6 |
| 8 | 6 | 10 |
| 9 | 11 | 13 |
| 10 | 20 | 24 |
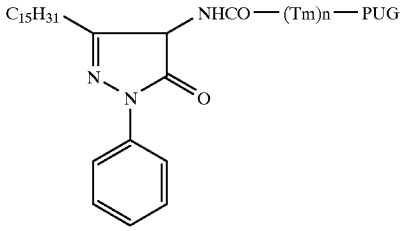
| Compound | Tm | PUG |
|---|---|---|
| 11 | 1 | 1 |
| 12 | 2 | 5 |
| 13 | 5 | 2 |
| 14 | 6 | 15 |
| 15 | 17 | 3 |
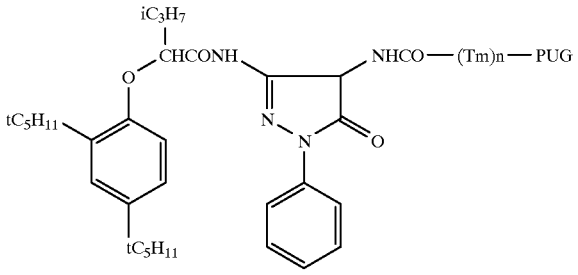
| Compound | Tm | PUG | Compound | Tm | PUG |
|---|---|---|---|---|---|
| 16 | 1 | 1 | 21 | 8 | 5 |
| 17 | 2 | 1 | 22 | 8 | 1 |
| 18 | 2 | 4 | 23 | 18 | 22 |
| 19 | 2 | 5 | 24 | 20 | 2 |
| 20 | 6 | 2 | 25 | 21 | 20 |
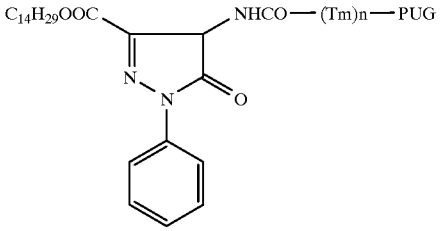
| Compound | Tm | PUG |
|---|---|---|
| 26 | 2 | 4 |
| 27 | 4 | 8 |
| 28 | 12 | 9 |
| 29 | 13 | 12 |
| 30 | 16 | 16 |

-continued
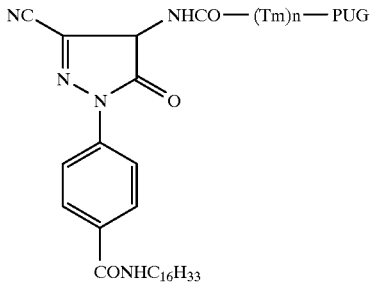
| Compound | Tm | PUG |
|---|---|---|
| 31 | 2 | 3 |
| 32 | 7 | 7 |
| 33 | 8 | 11 |
| 34 | 14 | 14 |
| 35 | 19 | 18 |
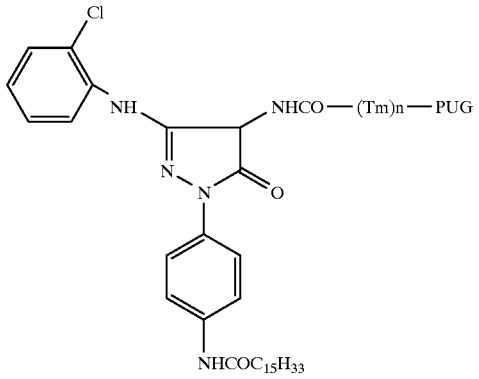
| Compound | Tm | PUG |
|---|---|---|
| 36 | 2 | 2 |
| 37 | 5 | 8 |
| 38 | 9 | 18 |
| 39 | 10 | 21 |
| 40 | 19 | 27 |
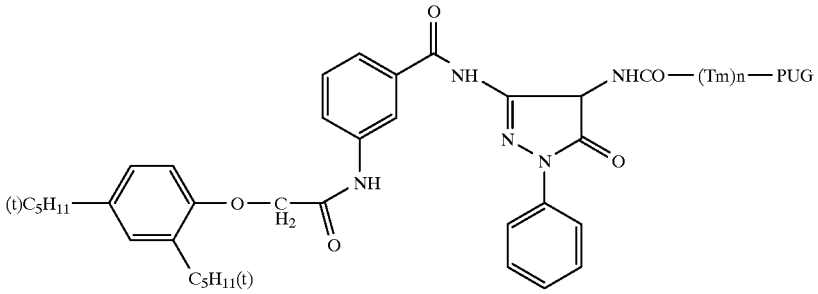
| Compound | Tm | PUG |
|---|---|---|
| 41 | 2 | 4 |
| 42 | 2 | 5 |
| 43 | 5 | 15 |
| 44 | 6 | 6 |
| 45 | 21 | 26 |

-continued

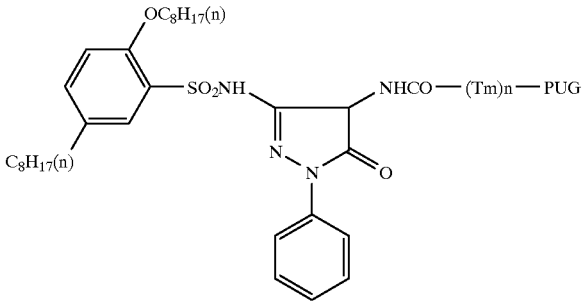

| Compound | Tm | PUG |
|---|---|---|
| 101 | 2 | 4 |
| 102 | 8 | 5 |
| 103 | 8 | 1 |
| 104 | 1 | 15 |
| 105 | 17 | 18 |

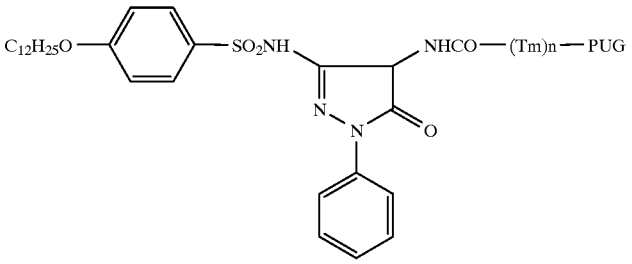

| Compound | Tm | PUG |
|---|---|---|
| 106 | 2 | 4 |
| 107 | 8 | 5 |
| 108 | 8 | 1 |
| 109 | 1 | 20 |
| 110 | 14 | 23 |

The above-described compound can be incorporated in any of component layers of the emulsion-side. The DIR compound preferably is incorporated in a silver halide emulsion layer nearest to the support and/or a light-insensitive hydrophilic colloidal layer adjacent to the emulsion layer. The compound can be incorporated through dissolution in an appropriate water-miscible solvent alcohols, ketones, dimethylformamide or methyl cellosolve. The compound can also be incorporated in the form of an emulsified dispersion using known oils. The compound can be incorporated in the form of a solid particle dispersion, by using a high-speed impeller, sand mill, ultrasonic homogenizer or ball mill.

The compound is incorporated in an amount of $10^{-6}$ to $10^{-1}$ and preferably $10^{-4}$ to $10^{-2}$ mol per mol of silver halide.

In the present invention, well-known sulfur sensitization, reduction sensitization, noble metal sensitization and a chemical sensitization with a Se- or Te-compound may be applied.

As a sulfur sensitizer can be used various sulfur compounds including thiosulfates, thioureas, rhodanines polysulfides, besides a sulfur compound contained in gelatin. As selenium sensitizer are preferably used triphenylselenophosphines.

Selenium sensitization includes a variety of selenium sensitizers, as disclosed in U.S. Pat. Nos. 1,574,944, 1,602,592, 1,623,499, JP-A 60-150046, 4-25832, 4-109240 and 4-4-147250. Usable selenium sensitizers include colloidal selenium, isoselenocyanates (e.g., allyl isoselenocyanate), selenoureas (e.g., N,N-dimethylselenourea, N,N,N'-triethylselenourea, N,N,N'-trimethyl-N'-heptafluoroselenourea, N,N,N'-trimethyl-N'-heptafluoropropylcarbonylselenourea, N,N,N'-trimethyl-N'-4-nitrophenylcarbonylselenourea), selenoketones (e.g., selenoacetone, selenoacetophenone), selenoamides (e.g., selenoacetoamide, N,N-dimethylselenobenzamide), selenocarboxylic acids and selenoesters (e.g., 2-selenopropionic acid methy-3-selenobutyrate), selenophosphates (tri-p-triselenophosphate) and selenides (triphenyphosphineselenide, diethylselenide, diethyldiselenide). Among these sensitizers are preferable selenoureas, selenoamides, selenoketones and selenides.

The amount of the selenium sensitizer to be used depends on a selenium compound, silver halide grains and chemical ripening conditions, and in general, are within a range of $10^{-8}$ to $10^{-4}$ mol per mol of silver halide. Chemical ripening by use of the selenium sensitizer is carried out preferably at a temperature of 40 to 90° C. (preferably, 45 to 80° C.) and a pH of 4 to 9 and a pAg of 6 to 9.5.

In the cases where the sensitizer is water soluble it can be added as such. In the case of being scarcely water soluble, it can be in various manner. For example, the sulfur sensitizer, selenium sensitizer and/or tellurium sensitizer are previously mixed with a gelatin aqueous solution and then incorporated. Alternatively, the sensitizer is is dissolved in a low boiling solvent and dispersed by emulsifying in the presence of a surfactant. In this case, the low boiling solvent is preferably removed after being dispersed. It may be added by a method in which it has been previously mixed a gelatin solution, by a method disclosed in JP-A 4-140739, thus in the form of a dispersion of mixture solution with an organic solvent-soluble polymer. Furthermore, there may be acceptable a dispersing method by use of a high-speed impeller, sand mill, ultrasonic homogenizer or ball mill to obtain an average particle size of 0.01 to 6 $\mu$m.

As a representative noble metal sensitization is cited gold sensitization, in which a gold complex compound, as a gold compound is used. Besides gold, a complex of noble metals such as platinum, palladium and rhodium may be usable.

As a reduction sensitizer, stannous salt, amines, formamidinesulfinic acid and silane compounds are usable.

Oxidizing agents can also be used during the course of manufacturing the photographic materials according to the invention. Examples of inorganic oxidizing agents usable in the invention include hydrogen peroxide and its adducts (e.g., $NaBO_2$. $3H_2O_2$. $3H_2O$, $2Na_2CO_3$. $3H_2O_2$, $Na_4P_2O_7$. $2H_2O_2$, $2Na_2SO_4$. $H_2O_2$. $2H_2O$), peroxyacid salts (e.g., $K_2S_2O_8$, $K_2C_2O_6$, $K_4P_2O_8$), peroxy acid complex salts (e.g., $K_2[Ti(O_2)C_2O_4]$. $3H_2O$, $4K_2SO_4$. $Ti(O_2)$. OH. $SO_4$. $2H_2O$, $Na_2[VO(O_2)](C_2O_4)_26$, oxyacid salts such as permanganate (e.g., $KMnO_4$) and chromate (e.g., $K_2CrO$), halogen elements such as iodine and bromine, perhalogenates (e.g., potassium periodate), high valent metal salts (e.g., potassium ferricyanate), and thiosulfonates.

Examples of organic oxidizing agents include quinones such as p-quinone, organic peroxides such as peracetic acid and perbenzoic acid, and a compound capable of releasing an active halogen (e.g., N-bromosuccinimide, chloramin T, chloramin B). Of these oxidizing agents are preferred ozone, hydrogen peroxide and its adduct, inorganic oxidizing agents of halogen elements, quinones and an organic oxidizing agents capable of releasing an active halogen.

The oxidizing agent can be added in an amount of $10^{-7}$ to $10^{-1}$ mols, preferably $10^{-6}$ to $10^{-2}$ mols and more preferably, $10^{-5}$ to $10^{-3}$ mols per mol of silver halide. The oxidizing agent can be incorporated according to the conventional manner as employed in adding additives to a photographic emulsion. Thus, a water soluble compound is added in the form of an aqueous solution with an appropriate concentration. A water insoluble compound can be added through solution in a water miscible organic solvent such as alcohols, glycols, ketones, esters or amides. The oxidizing agent can also be added in the form of a solid particle dispersion.

The oxidizing agent can be added at any time during the course of manufacturing photographic materials and preferably during the time of the process of preparing silver halide grains to immediately before coating on a support.

Silver halides used in the present invention include silver chloride, silver bromochloride containing 60 mol % or more chloride, or silver iodobromochloride containing 60 mol % or more chloride.

The average grain size of silver halide grains used in the invention is preferably 0.7 $\mu$m or less, more preferably, 0.1 to 0.5 $\mu$m. The word, "grain size" refers to a diameter of the grain, in the case where it is in the form of a sphere or close thereto. In the case where the grain is cubic, the size refers to a diameter of a sphere having a volume identical to the cube. A method for determining the average grain size is referred to C. E. K. Mees & T. H. James, The Theory of the Photographic Process, 3rd ed., pages 36–43 (1966. Macmillan).

Shapes of the silver halide grains are not limitative, which are tabular, spherical, cubic, tetradecahedral, octahedral or any other form. Narrow grain-size spread is preferable. Monodispersed emulsion in which grain sizes of 90% or more (preferably 95% or more) of the total grains are within a range of the average grain size ±40% thereof.

The manner in which a water soluble silver salt and a water soluble halide react with each other may be any of a single jet mixing method, simultaneously mixing method and combination thereof. The silver halide grains may be formed in excess of silver ions (so-called reverse mixing method). As one mode of the simultaneously mixing method, there may be employed a controlled double jet method, in which the reaction mixture for forming silver halide grains is maintained at a given pAg to thereby form regular-formed, monodispersed silver halide grains.

In the silver halide emulsion used in the present invention, it is preferable to incorporate at least of a cadmium salt, zinc salt, lead salt, thallium salt, iridium salt, rhodium salt, ruthenium salt, rhenium salt, osmium salt, iron salt, copper salt, platinum salt and palladium salt including complexes thereof during the course of forming nucleus grains or causing them to grow. Ligands of the complex salts include a halogen atom, nitrocyl group, cyano group, aquo group, alkyl group, pseudo-halogen group alkoxy group, ammonium group and a combination thereof.

Of these are preferred rhodium salts, ruthenium salts, rhenium salts and osmium salts. Thus, the metal salts are preferably incorporated in the form of a complex salt represented by the following formula:

$$[ML_6]^m$$

wherein M represents a metal selected from Rh, Re, Ru and Os; L represents a ligand and L may be identical or different from ech other; and m is 0, −1, −2 or −3. Examples of the ligand represented by L include a halogen atom (F, Cl, Br, I), —CN, —SCN, —SeCN, —TeCN, azido group (—$N_3$), nitrosyl group (—NO), thionitrosyl (—NS) and aquo group ($H_2O$). In cases of the aquo ligand, one or two aquo ligands are preferably included. Exemplary examples thereof are as follows: $[RhCl_6]^{3-}$, $[RuCl_6]^{3-}$, $[ReCl_6]^{3-}$, $[OsCl_6]^{3-}$, $[Rh(NO)Cl_5]^{2-}$, $[RhBr_4(H_2O)_2]^-$, $[Ru(NO)(H_2O)Cl_4]^-$, $[RhCl_5(H_2O)]^{2-}$, $[Re(NO)Cl_5]^{2-}$, $[Re(NO)CN_5]^{2-}$, $[Re(NO)ClCN_4]^{2-}$, $[Rh(NO)_2Cl_4]^-$, $[Rh(NO)(H_2O)Cl_4]^-$, $[Ru(NO)CN_5]^{2-}$, $[Rh(NS)Cl_5]^{2-}$, $[Os(NO)Cl_5]^{2-}$, $[Re(NO)Cl_5]^-$, $[Ru(NS)Cl_5]^{2-}$, $[Re(NS)Cl_4(SeCN)]^{2-}$. To allow the metal to incorporate in the grain, the complex salt is added during the course of forming grains. The metal may be incorporated uniformly or internally in the grain. The addition amount thereof is $10^{-8}$ to $10^{-3}$ and preferably $10^{-8}$ to $10^{-6}$ mol per mol of silver halide.

The halide composition in the surface of silver halide grains can be controlled using water soluble halide salts or silver halide fine grains. This technique is known as halide conversion. Silver halide grains may have uniform halide composition through from the interior to the surface, or may comprise plural layers different in halide composition, contents of doping agents or distribution of lattice defects. In the invention, plural kinds of silver halide grains different in grain size, sensitivity, crystal habit, spectral sensitive wavelength, halide composition, monodispersity, content and kind of the doping agent, manufacturing conditions such as silver potential, pH and desalting methods, surface state and chemical ripening conditions. In this case, the silver halide grains may be contained in the same layer or different layers.

Silver halide emulsions and manufacturing methods thereof refer to Research Disclosure 176, 17643 pages 22–23 (December, 1978).

A silver halide emulsion used in the invention may be spectrally sensitized in combination with a sensitizing dye other than the sensitizing dyes afore-mentioned. Usable sensitizing dyes include a cyanine dye, merocyanine dye, complex cyanine dye, complex merocyanine dye, holopolar cyanine dye hemicyanine dye, styryl dye and hemioxonol dye. These dyes may have basic heterocyclic nuclei, such as a pyrroline nucleus, oxazoline nucleus, thiazoline nucleus, pyrrol nucleus, oxazole nucleus, thiazole nucleus, selenazole nucleus, imidazole nucleus, tetrazole nucleus, pyridine nucleus, these nuclei condensed with an alicyclic hydrocarbon ring, these nuclei condensed with an aromatic hydrocarbon ring such as indolenine nucleus, benzindolenine nucleus, indole nucleus, benzoxazole nucleus, naphthooxazole nucleus, benzthiazole nucleus, naphthothiazole nucleus, benzselenazole nucleus, bensimidazole nucleus and quinoline nucleus. These nuclei may be substituted. The merocyanine dye and complex merocyanine dye may have a nucleus having a ketomethylene structure such as a pyrazoline-5-one nucleus, thiohydantoin nucleus, 2-thiooxazoline-2,4-dione nucleus, rhodanine nucleus and thiobarbituric acid nucleus. These are described in Research Disclosure 176, 17643 (December, 1978), U.S. Pat. Nos. 4,425,425 and 4,425426. The sensitizing dye can be dissolved by means of ultrasonic vibration. A method for dissolving or dispersing the dye to add into an emulsion is described in U.S. Pat. Nos. 3,482,981, 3,585,195, 3,469,987, 3,425,835 and 3,342,605, 3,660,101 and 3,658,546, British Patent No. 1,271,329, 1,038,029 and 1,121,174. These dyes may be used singly or in combination thereof. The combined use of dyes is usable for the purpose of supersensitization. Effective supersensitive combination and supersensitizing materials are described in Research Disclosure 176, 17643 page 23 IV (December, 1978).

The photographic material according to the invention may contain a variety of compounds for the purpose of preventing fog occurred in the course of manufacturing or aging the photographic material or stabilizing photographic performance thereof. Thus, there may be added an antifoggant or stabilizer including azoles such as a benzthiazolium, nitroindazoles, nitrobenzimidazoles, chlorobenzimidazoles, bromobenzimidazoles, mercaptothiazoles, mercaptobenzthiazoles, mercaptobenzimidazoles, mercaptothiadiazoles, aminotriazoles, benztriazoles, nitrobenztriazoles, mercaptotetrazoles (especially, 1-phenyl-5-mercaptotetrazole); mercaptopyrimidines, mercaptotriazines; thioketo compound such as oxazolinethione; azaindenes such as triazaindenes, tetrazaindenes (especially, 4-hydroxy-1,3,3a,7-tetrazaindenes), pentazaindenes; benzenethiosulfonic acid, benzenesulfininc acid, benzenesulfonic acid amide. Of these are particularly preferred a substituted or unsubstituted heterocyclic compounds containing any of N, O, S and Se or their condensed ring compounds, and water soluble halide compounds.

The silver halide emulsion or light-insensitive hydrophilic colloid used in the invention may contain an organic or inorganic hardener. Examples thereof include chromium salts such as chrome alum and chromium acetate, aldehydes such as formaldehyde, glyoxal and glutar aldehyde, N-methylol compound such as dimethylol urea and methylol dimethylhydantoin, dioxane derivatives such as 2,3-dihydroxydioxane, active vinyl compound such as 1,3,5-triacryloyl-hexahydro-s-triazinebis(vinylsulfonyl)methyl ether and N,N'-methylenebis-[β-(vinylsulfonyl) propioneimide], active halogen compound such as 2,4-dichloro-6-hydroxy-s-triazine, mucohalogen acid such as mucochloric acid and pheoxymucochloric acid, isooxazoles, dialdehyde starch, 2-chloro-6-hydroxytriazinyl gelatin. The hardener may be used singly or in combination thereof.

The silver halide emulsion or light-insensitive hydrophilic colloid used in the invention may contain various surfactant (s) for various purposes, including a coating aid, antistatic agent, sliding modifier, emulsion-dispersing agent, antisticking agent and photographic characteristic modifier.

Gelatin is advantageously employed as a binder or protective colloid. Other hydrophilic colloidal materials may be usable. Examples thereof include gelatin derivatives, a graft polymer of gelatin and another polymer, protein such as albumin and casein, cellulose derivatives such as hydroxyethylcellulose, carboxymethyl cellulose and cellulose sulfuric acid ester, sugar derivatives such as sodium alginate and starch derivative, and synthetic hydrophilic polymer compounds such as polyvinyl alcohol, polyvinyl alcohol partially acetal, poly-N-vinylpyrrolidone, polyacrylic acid, polymethacrylic acid, polyacrylamide, polyvinylimidazole, polyvinylpyrazole and copolymer of these polymers.

Besides lime-processed gelatin, there may be usable acid-processed gelatin, gelatin hydrolysate and gelatin-enzyme reaction product.

In one embodiment of the present invention, a total coating amount of gelatin of the emulsion layer side is preferably not more than 3.6 g per $m^2$ of the photographic material.

In another embodiment of the invention, the total coating amount of gelatin of the emulsion layer side (A), expressed in $g/m^2$ and a total amount of said composite material in $g/m^2$ (B) preferably meet the following requirement:

$1.0 \leqq A/B \leqq 17.5$.

The silver halide emulsion used in the invention may contain a dispersion of water-insoluble or sparingly water-soluble polymer for the purpose of improving dimensional stability or reducing silver sludge. Examples thereof include alkyl(metha)acrylate, alkoxyacryl(metha)acrylate, glycidyl (metha)acrylate, (metha)acrylamide, vinylester such as vinylacetate, acrylonitrile, olefin, styrene, copolymer thereof, and a polymer having, as a monomer component, a combination of afore-described monomers and such a monomer s acrylic acid, methacrylic acid, α, β-unsaturated dicarboxylic acid, hydroxyalkyl(metha)acrylate, sulfoalkyl (metha)acrylate and styrenesulfonic acid. There may also be used, as a monomeric component, a monomer containing a plurality of ethylenic unsaturated groups. These monomer may contain a water-solubilizing group such as a hydroxy group, sulfon group, carboxyl group or amido group. Further, a primary through quaternary amino group, phosphonium group, aliphatic or aromatic —$NR_{61}NR_{62}$—$R_{63}$ (in which $R_{61}$, $R_{62}$ and $R_{63}$ each represents a hydrogen atom or a group bonded through an aliphatic group, aromatic group, sulfinic acid group, carbonyl group, oxalyl group, carbamoyl group, amino group, sulfonyl group, sulfoxy group, iminomethylene group, alkenyl group, alkynyl group, aryl group, alkoxy group, alkenyloxy group, alkynyloxy group or aryloxy group) or cationic group. They can be synthesized by conventional methods. Furthermore, they may be polymerized in the presence of water soluble organic compounds such as gelatin or polyvinyl alcohol. After completing synthesis, they may be subjected to shelling with a gelatin or a silane coupling agent.

Other various additives may be used in the photographic light sensitive material of the invention. Examples thereof include desensitizer, plasticizer. With regard to additives, there may be usable compounds described in Research Disclosure 176 (afore-cited), page 22–31.

In the photographic material according to the invention, at least two hydrophilic colloid layers are provided on one side of a support. One or more light insensitive hydrophilic colloid layers are provided. In the case of two or more layers, there may be provided a protective layer, an interlayer between two emulsion layers or between an emulsion layer nearest to the support and the support.

In the photographic material of the invention, photographic component layer(s) are coated on one-side or both sides of a flexible support conventionally used. The flexible support is a film comprised of a synthetic polymer, including cellulose acetate, cellulose butyloacetate, polystyrene, polyethylene terephthalate or polyethylene terenaphthalate, and paper support coated with polymer such as polyethylene or polyethylene terephthalate. There may provided on the support a magnetic recording layer, antistatic layer or pealing layer.

Developing agents used in the invention include dihydroxybenzenes such as hydroquinone, chlorohydroquinone, bromohydroquinone, 2,3-dichlorohydroquinone, methylhydroquinone, isopropylhydroquinone and 2,5-dimethylhydroquinone; 3-pyrazolidones such as 1-phenyl-3-pyrazolidone, 1-phenyl-4methyl-3-pyrazolidone1-phenyl-4,4-dimethyl-3-pyraolidone1-phenyl-4-ethyl-3-pyrazolidone and 1-phenyl-5-methyl-3-pyrazolidone; aminophenols such as o-aminophenol, p-aminophenol, N-methyl--p-aminophenol and 2,4-diaminophenol; pyrogallol; ascorbic acid; 1-aryl-3-pyrazolines such as 1-(p-hydroxyphenyl)-3-aminopyrazoline, 1-(p-aminophenyl)-3-aminopyrazoline and 1-(p-amino-N-methyphenyl)-3-aminopyrazoline; and transition metal complex salts. (These are a complex salt of a transition metal such as Ti, V, Cr, Mn, Fe, Co, Ni and Cu, which take a form with reducing, such as a form of a complex salt of $Ti^{3+}$, $V^{2+}$, $Cr^{2+}$ and $Fe^{2+}$ . As a ligand are cited an aminopolycarboxylic acid such as ethylenediaminetetraacetic acid (EDTA) and diethylenetriaminepentaacetic acid (DTPA), and polyphosphoric acid such as hexamethapolyphosphoric acid and tetrapolyphosphoric acid.) These developing agent may be used singly or in combination thereof. A combination of 3-pyrazolidones and dihydroxybenzenes, a combination of aminophenols and dihydroxybenzenes, a combination of 3-pyrazolidones and ascorbic acid, a combination of aminophenols and ascorbic acid, a combination of 3-pyrazolidones and transition metal salts, and a combination of aminophenols and transition metal salts are preferable. The developing agent is preferably used in an amount of 0.01 to 1.4 mol/l.

As antisludging agent usable in the invention are cited compounds described in Japanese Patent examined No. 60-4702, JP-A 3-51844, 4-26838, 4-362942 and 1-319031.

Waste developer liquor can be rejuvenated through electrolysis. Thus, a cathode (e.g., a conductor such as stainless wool or semiconductor) is put into the waste developer liquor and an anode (e.g., an insoluble conductor such as carbon, gold, platinum and titanium) is put into an electrolytic solution in such a manner that a developer waste liquor is, through an anion exchange membrane, in contact with a electrolytic solution. The rejuvenation is conducted by energizing both electrodes. The photographic material can be processed while the waste liquor is being rejuvenating. Various additives to the developer, such as a preservative, alkali, pH buffer, sensitizing agent, antifoggant and antisludging agent may be introduced at that time. The photographic material can be developed while energizing the developer, in which the above additives may be added into the developer. In the case where the waste developer liquor is rejuvenated for reuse, a developing agent is preferably a transition metal complex salt.

The preservatives usable in the invention is preferably a sulfite or metabisulfite, such as sodium sulfite, potassium sulfite, ammonium sulfite and sodium metabisulfite. The sulfite is added preferably in an amount of not less than 0.25 mol/l, more preferably not less than 0.4 mol/l.

The developer may contain an alkali (e.g., sodium hydroxide, potassium hydroxide), pH buffer (e.g., a carbonate, phosphate, borate, boric acid, citric acid, alkanolamine), dissolving aid (e.g., polyethylene glycols, ester thereof, alkanolamine), sensitizing agent (e.g., nonionic surfactants including polyoxyethylenes, quaternary ammonium compounds), surfactant, deforming agent, antifoggant (e.g., halides such as potassium bromide and sodium bromide, nitrobenzindazole, nitrobenzimidazole, benztriazole, benzthiazole, tetrazoles, thiazoles)cheating agent (e.g., ethylenediaminetetraacetic acid and an alkali salt metal thereof, nitrilotriacetate, polyphosphate), development accelerating agent (e.g., compounds described in U.S. Pat. No. 2,304,025, Japanese Patent examined No. 47-45541), hardener (e.g., glutar aldehyde, bisulfite adduct thereof). The pH of the developer is preferably 8 to 12 and more preferably 9.5 to 11.

It is preferred that the photographic material according to the invention is developed with a developer with a pH of 9.5 to 11.0 to form a high contrast image with γ of 10 to 30. (Herein, the term, "γ" means a slope of a straight line connecting two points on a density-exposure characteristic curve.)

In processing the photographic materials according to the invention, there can be a developing solution substantially not containing hydroquinones (e.g., hydroquinone, chlorohydroquinone, bromohydroquinone, methylhydroquinone, hydroquinone-monosulfonate). In this case, it is preferred to contain a compound represented by the following formula (A):

Formula (A)

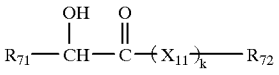

In the formula, $R_{71}$ and $R_{72}$ independently are a substituted or unsubstituted alkyl group, substituted or unsubstituted amino group, substituted or unsubstituted alkoxy group or substituted or unsubstituted alkylthio group, and $R_{71}$ and $R_{72}$ may combine with each other to form a ring; k is 0 or 1, and when k is 1, X is —CO— or —Cs—.

In the formula (A), a compound formed by combination of $R_{71}$ and $R_{72}$ and represented by the following formula (A-a) is preferred.

Formula (A-a)

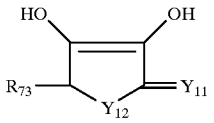

In the formula, $R_{73}$ is a hydrogen atom, substituted or unsubstituted alkyl group, substituted of unsubstituted aryl group, substituted or unsubstituted amino group, substituted or unsubstituted alkoxy group, sulfo group, carboxy group, amido group or sulfonamido group; $Y_{11}$ is O or S; $Y_{12}$ is O, S or $NR_4$, in which $R_{74}$ is substituted or unsubstituted alkyl group or substituted or unsubstituted aryl group.

As the alkyl group of formula (A) and formula (A-a) is preferred a lower alkyl group, such as an alkyl group having 1 to 5 carbon atoms; the amino group is preferably unsubstituted amino group or amino group substituted by a lower alkoxy group; the alkoxy group is preferably a lower alkoxy group; the aryl group is preferably a phenyl group or naphthyl group; these groups may be substituted and as substituents are cited hydroxy group, halogen atom, alkoxy group, sulfo group, carboxy group, amido group, and sulfonamido group.

Examples of the compound represented by formulas (A) and (A-a) are shown below, but the present invention is not limited thereto.

| No. | $X_{11}$ | $R_{71}$ | $R_{72}$ |
|---|---|---|---|
| A-1 | — (k = 0) | $HOCH_2$—CH(OH)—CH(OH)— | —OH |
| A-2 | — (k = 0) | $CH_3$—CH(OH)—CH(OH)— | —OH |
| A-3 | — (k = 0) | $HOCH_2$—CH(OH)—CH(OH)— | —$CH_3$ |
| A-4 | — (k = 0) | $CH_3$—CH(OH)—CH(OH)— | —$CH_3$ |
| A-5 | —C(=O)— (k = 1) | $HOCH_2$—CH(OH)—CH(OH)— | —OH |
| A-6 | —C(=O)— (k = 1) | $CH_3$—CH(OH)—CH(OH)— | —OH |
| A-7 | —C(=S)— (k = 1) | $HOCH_2$—CH(OH)—CH(OH)— | —OH |
| A-8 | —C(=S)— (k = 1) | $CH_3$—CH(OH)—CH(OH)— | —OH |
| A-9 | —C(=O)— (k = 1) | HO—$CH_2$— | —OH |
| A-10 | —C(=O)— (k = 1) | HO—$CH_2$— | —$CH_3$ |

-continued

| | | | |
|---|---|---|---|
| A-11 | —C(=O)— (k = 1) | HO—$CH_2$— | —$C_2H_5$ |
| A-12 | —C(=O)— (k = 1) | HO—$CH_2$— | —$C_2H_4OH$ |

| No. | $Y_{11}$ | $Y_{12}$ | $R_{73}$ |
|---|---|---|---|
| A-13 | O | O | H |
| A-14 | O | O | $CH_3$ |
| A-15 | O | O | $CH_2$(OH) |
| A-16 | O | O | $CH_3$—CH(OH)— |
| A-17 | O | O | $HOCH_2$—CH(OH)— |
| A-18 | O | O | $ClCH_2$—CH(OH)— |
| A-19 | O | O | $HOOCCH_2$—CH(OH)— |
| A-20 | S | O | H |
| A-21 | S | O | $CH_3$—CH(OH)— |
| A-22 | S | O | $HOCH_2$—CH(OH)— |
| A-23 | O | $NCH_3$ | H |
| A-24 | O | NH | $HOCH_2$—CH(OH)— |
| A-25 | O | S | H |
| A-26 | O | S | $HOCH_2$—CH(OH)— |
| A-27 | O | S | $CH_3$—CH(OH)— |
| A-28 | S | S | H |
| A-29 | S | S | $HOCH_2$—CH(OH)— |
| A-30 | S | S | H |

These compounds are exemplarily ascorbic acid, erythorbic acid or salts thereof (e.g., sodium, potassium, or lithium salt), derivatives derived therefrom, being commercially available and readily synthesized by a well known method.

Furthermore, the compound represented by formula (A) or (A-a) can used in combination with a 3-pyrazolidones (e.g., 1-phenyl-3-pyrazolidone, 1-phenyl-4-methyl-3-pyrazolidone, 1-phenyl-4,4-dimethyl-3-pyrazolidone, 1-phenyl-4-ethyl-3-pyrazolidone, 1-phenyl-5-ethyl-3-pyrazolidone), and aminophenols (e.g., o-aminophenol, p-aminophenol, N-methyl-o-aminophenol, N-methyl-p-aminophenol, 2,4-diaminophenol) In this case, 3-pyrazolidones or aminophenols are preferably used in an amount of 0.01 to 1.4 mol per liter of a developing solution.

The photographic material according to the invention may be subjected to an activator processing. As a specific mode of development processing, a developing agent is contained in the emulsion layer of a photographic material, which is processed in an alkali solution to be developed. A combination of this development with stabilization processing with a thiocyanate has been employed as one of rapid processing methods. In such rapid processing, inventive effects are remarkably displayed.

A fixer may contain conventional constituents. The fixer is an aqueous solution comprising a fixing agent and other constituents. The pH thereof is within a range of 3.8 to 5.8. As the fixing agent is employed a thiosulfate such as sodium thiosulfate, potassium thiosulfate and ammonium thiosulfate; thiocyanate such as sodium thiocyanate, potassium thiocyanate and ammonium thiocyanate; and organic sulfur compound capable of forming a stable, water-soluble silver complex.

The fixer may contain, as a hardener, a water-soluble aluminum salt, such as aluminum chloride, aluminum sulfate and potassium alum. The fixer may contain optionally a preservative (e.g., sulfite, bisulfite), pH buffer (e.g., acetic acid), pH adjusting agent (e.g., sulfuric acid) and chelating agent having water softening ability.

After fixing, the photographic material is further subjected to washing, in which water may be supplied in an amount of some liters per min. in response to processing; water is circulated and reused with treating by means of chemicals or a filter, ozone or light; or a stabilizing bath containing a stabilizer is employed as a washing bath with replenishing thereto a small amount of a stabilizer in response to processing. The washing process is carried out at room temperature or a temperature of 30 to 50° C. In the case of using the stabilizing bath, plembing-free process, is possible without connecting to tap water. There may be provided a rinse bath before or after each processing bath.

Mother liquid or replenisher of developer, fixer or stabilizer is supplied in the form of a working solution or a solution which is prepared by diluting a concentrated solution immediately before using. The mother liquid or replenisher is stocked as a working solution or its concentrated solution, a viscous liquid in a semi-paste form, or a system in which single solid component or a mixture thereof is dissolved at the time of use. In case of employing the mixture, components which are not easily reacted with each other may be packed in a layered form under vacuum and opened to be dissolved when using, or may be formed in a tablet form. In particular, a system in which tablet-formed one is supplied to a dissolution tank or directly to a processing tank, is superior in handling, space-saving and storage stability and preferably employed.

Photographic materials according to the invention is preferably processed at a developing temperature of 20 to 50° C. Processing is preferably carried out using an automatic processor, in which a given amount of a developer or fixer is replenished in proportion to the area of the photographic material to be processed. The developer or fixer replenishing amount is preferably 300 ml or less and more preferably 75 to 200 ml per $m^2$, in terms of reduction of effluents.

In light of a demand for shortening a total processing time, it is preferred that the overall processing time (Dry to Dry from the time when the front end of a film is put in to the processor to the time when all of the film comes out of the drying zone is between 10 and 60 sec. The total processing time is an overall process time necessary for processing a black-and-white photographic material, including developing, fixing, bleaching, washing or stabilizing, and drying steps.

In the processor, a heat conductive member with a temperature of 90° C. or more (for example, a heat roller heated at 90~130° C.) or radiating member by directly applying electricity to a radiating element such as tungsten, carbon, nichrome, a mixture of zirconium oxide, yttrium oxide and thorium oxide, to heat and emit radiation, or by conducting thermal energy from a resistance pyrogeneous substance to a radiation emissive substance such as copper, stainless, nickel and various types of ceramics, to generate heat or radiate infrared rays can preferably be used in order to construct the heating zone. There may be provided a control system of drying conditions, as described in JP-A 1-315745 and 2-108051.

EXAMPLES

Embodiment of the present invention will be explained based on the following examples.

Example 1

Preparation of silver halide emulsion:

To a reaction vessel were added an aqueous silver nitrate solution and an aqueous solution of NaCl and KBr by controlled double jet addition, while being maintained at a temperature of 35° C., EAg of 120 mV and a pH of 3.0, to form a silver halide grain emulsion with an average grain size of 0.20 $\mu$m. Furthermore, silver halide emulsions were prepared in a manner similar to the above, provided that the halide composition was varied or metal dopants were added during precipitation, as shown in Table 1. The resulting emulsions each were adjusted to a pH of 5.6 with 1N NaOH aqueous solution. To the emulsions was added phenyl isocyanate-modified gelatin and each emulsion was desalted to remove soluble salts. After desalting, gelatin was further added thereto in an amount of 15 g per mol of silver, the pH was adjusted to 5.7 and the emulsion was redispersed at 55° C. for 30 min. The EAg of emulsions were each 190 mV at 40° C. To each of the resulting emulsion were added 4-hydroxy-6-methyl-1,3,3a,7-tetrazaindene of $1.5\times10^{-3}$ mol per mol of silver and potassium bromide of $8.5\times10^{-4}$ mol per mol of silver and the pH and EAg were adjusted to 5.6 and 123 mV, respectively. Further thereto were added flower of sulfur of $2\times10^{-5}$ mol (as sulfur atoms) and chloroauric acid of $1.5\times10^{-5}$ mol, and chemical ripening was carried out at 60° C. for a period of 80 min. After completing chemical ripening were added 4-hydroxy-6-methyl-1,3,3a,7-tetrazaindene of $2\times10^{-3}$ mol per mol of silver, 1-phenyl-5-mercaptotetrazole of $3\times10^{-4}$ per mol of silver and potassium iodide of $1.5\times10^{-3}$ mol per mol of silver. Each emulsion was cooled to 40° C. and further thereto was added a sensitizing dye (d-1) of $1\times10^{-3}$ mol per mol of silver.

d-1

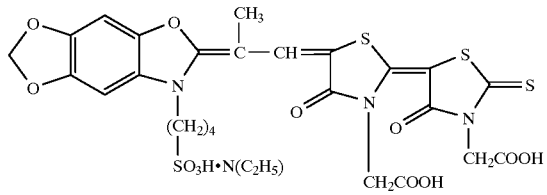

Preparation of photographic material:

On one side of a subbed support were simultaneously coated a light insensitive hydrophilic colloid layer, a silver halide emulsion layer and a protective layer in this order from the support. After setting, on the other side of the support, a backing layer and a backing protective layer in this order from the support were simultaneously coated and set, and both sides were simultaneously dried to obtain photographic material samples 101 to 114. Light insensitive hydrophilic colloid layer

| | |
|---|---|
| Gelatin | 0.9 g/m$^2$ |
| Dye f-4 (solid particle dispersion) | 30 mg/m$^2$ |
| Latex L-AB | 0.3 g/m$^2$ |
| Sodium dodecylbenzenesulfonate | 20 mg/m$^2$ |

Silver halide emulsion layer:

| | |
|---|---|
| Gelatin | 1.7 g/m$^2$ |
| Silver halide emulsion (based on silver) | 3.3 g/m$^2$ |
| Hydrazine compound, as shown in Table 1 | |
| Nucleation accelerating agent Na-12 | 10 mg/m$^2$ |
| Latex L-AB | 0.5 g/m$^2$ |
| Dextran (av.M.W. = ca.40,000) | 0.3 g/m$^2$ |
| Sodium iso-amyl-n-decylsulfosuccinate | 2 mg/m$^2$ |
| Sodium naphthalenesulfonate | 8 mg/m$^2$ |
| Saponin | 20 mg/m$^2$ |
| 2-Mercapto-6-hydroxypurine | 2 mg/m$^2$ |
| 2-Mercaptopyridine | 1 mg/m$^2$ |
| Ascorbic acid | 20 mg/m$^2$ |
| EDTA | 25 mg/m$^2$ |
| Poly(sodium styrenesulfonate) | 15 mg/m$^2$ |

Composite polymeric material, PL-15 (average particle size 0.23 μm), as shown in Table 1

The pH of the coating solution was 5.4.

Protective layer:

| | |
|---|---|
| Gelatin | 0.8 g/m$^2$ |
| Sodium iso-amyl-n-decylsulfosuccinate | 12 mg/m$^2$ |
| Matting agent, PMMA (av.size, 3 μm) | 25 mg/m$^2$ |
| Hydroquinone | 50 mg/m$^2$ |
| Lubricant R-21 | 60 mg/m$^2$ |
| 1,3-Vinylsulfonyl-2-propanol | 40 mg/m$^2$ |
| Hardener h1 | 30 mg/m$^2$ |
| Poly(sodium styrenesulfonate) | 10 mg/m$^2$ |
| Fungicide z | 0.5 mg/m$^2$ |

Backing layer:

| | |
|---|---|
| Gelatin | 0.6 g/m$^2$ |
| Sodium iso-amyl-n-decylsulfosuccinate | 5 mg/m$^2$ |
| Polymer latex L-A | 0.3 g/m$^2$ |
| Poly(sodium styrenesulfonate) | 10 mg/m$^2$ |
| Dye f1 | 45 mg/m$^2$ |
| Dye f2 | 25 mg/m$^2$ |
| Dye f3 | 30 mg/m$^2$ |
| 1-Phenyl-5-mercaptotetrazole | 10 mg/m$^2$ |
| Hardener h2 | 100 mg/m$^2$ |
| Zinc hydroxide | 50 mg/m$^2$ |
| EDTA | 50 mg/m$^2$ |

Backing protective layer:

| | |
|---|---|
| Gelatin | 0.4 g/m$^2$ |
| Matting agent, PMMA (av. size, 3 μm) | 50 mg/m$^2$ |
| Sodium di-(2-ethylhexyl)sulfosuccinate | 10 mg/m$^2$ |
| Poly(sodium styrenesulfonate) | 10 mg/m$^2$ |

h1

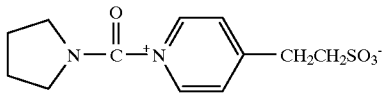

f1

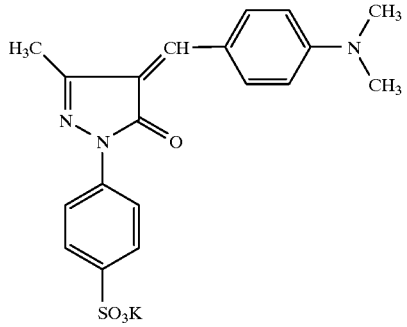

f2

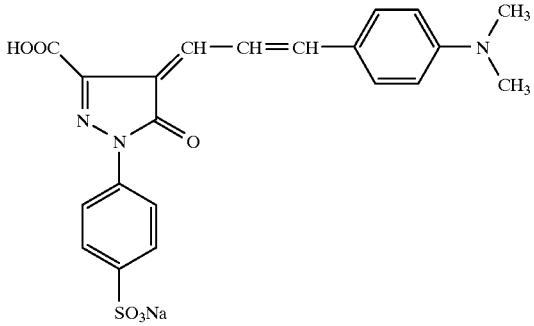

-continued f3

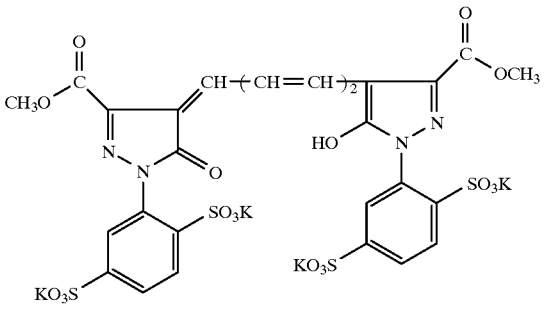

h2

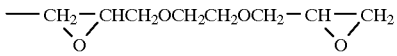

f4

(Solid particle dispersion)

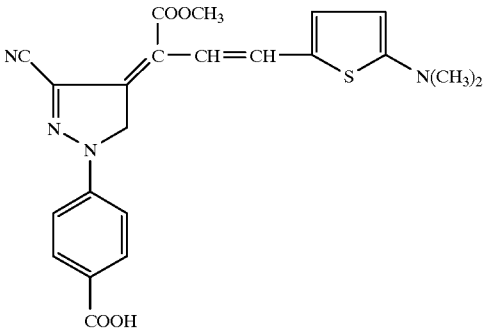

Z

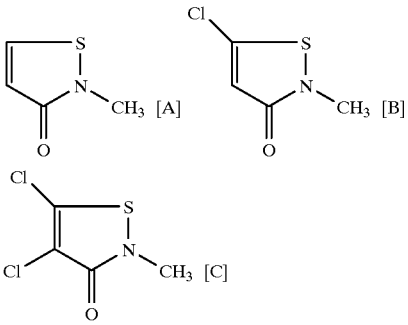

[A]:[B]:[C] = 46:50:4 (molar ratio)

L2

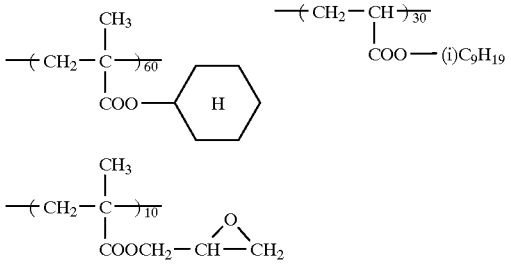

Developer composition (per liter of working solution)

| | |
|---|---|
| Pentasodium diethylenetriaminepentaacete | 1 g |
| Sodium sulfite | 42.5 g |
| Potassium sulfite | 17.5 g |
| Potassium carbonate | 55 g |
| Hydroquinone | 20 g |
| 4-methyl-4-hydroxymethyl-1-phenyl- | 0.85 g |

-continued

| | |
|---|---|
| 3-pyrazolidone (Dimezon S) | |
| Potassium bromide | 4 g |
| 5-Methylbenztriazole | 0.2 g |
| Boric acid | 8 g/l |
| Diethylene glycol | 40 g/l |
| 8-Mercaptoadenine | 0.07 g |
| Water to make | 1 liter |

The pH was made to 10.4 with KOH.

Fixer composition (per liter of working solution)

| | |
|---|---|
| Ammonium thiosulfate (70% aq. solution) | 200 ml |
| Sodium sulfite | 22 g |
| Boric acid | 9.8 g |
| Sodium acetate trihydride | 34 g |
| Acetic acid (90% aq. solution) | 14.5 g |
| Tartaric acid | 3.0 g |
| Aluminum sulfate (27% aq. solution) | 25 ml |
| Water to make | 1 liter |

The pH was made to 4.9 with sulfuric acid.

Processing condition

| Step | Temperature | Time |
|---|---|---|
| Developing | 35° C. | 30 sec. |
| Fixing | 35° C. | 20 sec. |
| Washing | Ordinary temp. | 10 sec. |
| Drying | 45° C. | 30 sec. |
| Total | | 100 sec. |

Evaluation of sensitivity:

Samples each were closely brought into contact with a step wedge and exposed to pulsed Xe-light through 633 nm interference filter for $10^{-5}$ sec. and processed by a processor, GR-27 (product of Konica Corp.), using processing solutions as described above. Processed samples were sensitometrically measured with PDA-65 (Konica Digital Densitometer). A sensitivity is defined as reciprocal necessary for the exposure necessary for giving a density of 1.0. The sensitivity was shown as a relative value, based on the sensitivity of Sample 101 being 100. The contrast (γ) was referred to as the slope of a straight line that connects two points corresponding to densities of 1.0 and 3.0.

Evaluation of black spot

Processed samples were visually observed with a 40× loupe. Evaluation was made, based on five grades of 5, 4, 3, 2 and 1, in order of increasing of black spots. Grade 1 and 2 were not be able to stand practical use.

Evaluation of abrasion mark:

Samples were allowed to stand at 23° C. and 40% R.H. over a period of 1 hr. Under the same environment, each sample of 3.5×30 cm was loaded with a load of 300 g per 2×2 cm, using a nylon-made brush and scrubbed at a speed of 10 cm/sec. Subsequently, samples were processed in the same manner as above-described and visually evaluated, based on the following criteria.

5: No abrasion mark observed

4: Abrasion marks slightly observed

3: Abrasion marks overall observed and low in density

2: Abrasion marks overall observed and rather high in density

1: Level outside practical use

Grade 1 and 2 were not be able to stand practical use. Results are summarized in Table 1.

TABLE 1

| Sample | Emulsion | | Hydrazine | Composite material | Sensi- | | Black | Abrasion | |
|---|---|---|---|---|---|---|---|---|---|
| No. | AgX | Doped metal (mol/Ag mol) | (mg/m$^2$) | (g/m$^2$) | tivity | γ | spot | mark | Remark |
| 101 | $AgCl_{70}Br_{30}$ | — | — | — | 100 | 3 | 0 | 2 | Comp. |
| 102 | $AgCl_{70}Br_{30}$ | $K_2[RhCl_6]$ $(2.0 \times 10^{-7})$ | — | — | 70 | 9 | 0 | 2 | Comp. |
| 103 | $AgCl_{70}Br_{30}$ | — | — | PL-15 (0.5) | 100 | 3 | 0 | 2 | Comp. |
| 104 | $AgCl_{70}Br_{30}$ | $K_2[RhCl_6]$ $(2.0 \times 10^{-7})$ | — | PL-15 (0.5) | 70 | 9 | 0 | 5 | Comp. |
| 105 | $AgCl_{60}Br_{40}$ | $K_2[RhCl_6]$ $(2.0 \times 10^{-7})$ | — | PL-15 (0.5) | 75 | 7 | 0 | 5 | Inv. |
| 106 | $AgCl_{50}Br_{50}$ | $K_2[RhCl_6]$ $(2.0 \times 10^{-7})$ | H-7 (10) | PL-15 (0.5) | 80 | 6 | 0 | 3 | Comp. |
| 107 | $AgCl_{70}Br_{30}$ | $K_2[RhCl_6]$ $(2.0 \times 10^{-7})$ | H-7 (10) | — | 120 | 23 | 4 | 1 | Comp. |
| 108 | $AgCl_{70}Br_{30}$ | $K_2[OsCl_6]$ $(2.0 \times 10^{-7})$ | H-7 (10) | — | 125 | 22 | 3 | 1 | Comp. |
| 109 | $AgCl_{70}Br_{30}$ | $K_2[Re(NS)Cl_5]$ $(2.0 \times 10^{-7})$ | H-7 (10) | — | 110 | 25 | 4 | 1 | Comp. |
| 110 | $AgCl_{70}Br_{30}$ | $K_2[RhCl_6]$ $(2.0 \times 10^{-7})$ | H-7 (10) | PL-15 (0.5) | 120 | 23 | 5 | 5 | Inv. |
| 111 | $AgCl_{70}Br_{30}$ | $K_2[RhCl_5(H_2O)]$ $(2.0 \times 10^{-7})$ | H-7 (10) | PL-15 (0.5) | 120 | 25 | 4 | 5 | Inv. |
| 112 | $AgCl_{70}Br_{30}$ | $K_2[Ru(NO)Cl_5]$ $(2.0 \times 10^{-7})$ | H-7 (10) | PL-15 (0.5) | 110 | 27 | 5 | 4 | Inv. |
| 113 | $AgCl_{70}Br_{30}$ | $K_2[OsCl_6]$ $(2.0 \times 10^{-7})$ | H-7 (10) | PL-15 (0.5) | 125 | 22 | 4 | 5 | Inv. |
| 114 | $AgCl_{70}Br_{30}$ | $K_2[Re(NS)Cl_5]$ $(2.0 \times 10^{-7})$ | H-7 (10) | PL-15 (0.5) | 120 | 25 | 5 | 4 | Inv. |

Example 2

Samples 201 to 204 were prepared in the same manner as Sample 111 of Example 1, except that the light insensitive hydrophilic layer (herein denoted as L-1), silver halide emulsion layer (L-2) or protective layer (L-3) was varied with respect to amounts of gelatin and composite polymeric material, as shown in Table 2. Samples were also evaluated in the same manner as in Example 1. Results thereof are shown in Table 2.

TABLE 2

| Sample | Gelatin (g/m$^2$) | | | Composite material (g/m$^2$) | | | | Sensi- | | Black | Abrasion |
|---|---|---|---|---|---|---|---|---|---|---|---|
| No. | L-1 | L-2 | L-3 | L-1 | L-2 | L-3 | Ratio* | tivity | γ | spot | mark |
| 111 | 0.9 | 1.7 | 0.8 | 0 | 0.5 | 0 | 6.8 | 120 | 25 | 4 | 5 |
| 201 | 0.9 | 1.7 | 1 | 0 | 0.5 | 0 | 7.2 | 120 | 24 | 4 | 5 |
| 202 | 1 | 1.8 | 1.2 | 0 | 0.5 | 0 | 8 | 120 | 18 | 4 | 5 |
| 203 | 0.9 | 1.7 | 0.8 | 0 | 0.2 | 0 | 17 | 125 | 25 | 3 | 4 |
| 204 | 0.9 | 1.7 | 0.8 | 0 | 0.1 | 0 | 34 | 130 | 25 | 3 | 2 |

*Ratio by weight of gelatin to composite material

Example 3

Preparation of silver halide emulsion A:

To an aqueous solution (C) in a reaction vessel were added an aqueous silver nitrate solution (A) and an aqueous solution (B) of NaCl and KBr by controlled double jet addition, while being maintained at a temperature of 35° C., EAg of 120 mV and a pH of 3.0, to form $AgCl_{70}Br_{30}$ nucleus grains with an average grain size of 0.09 μm (hereinm the term, "$AgCl_{70}Br_{30}$" means silver chlorobromide containing 70 mol % chloride and 30 mol % bromide). Then the EAg was adjusted to 100 mV, then an aqueous silver nitrate solution (D) and an aqueous halide solution (E) were added for 15 min. to obtain a $AgCl_{70}Br_{30}$ emulsion with an average grain size of 0.20 and a variation coefficient of grain size of 15%. Thereafter, the pH was adjusted to 5.6 and adding S-1 of $2\times10^{-4}$ mol per mol of silver, the emulsion was further ripened at 50° C. for 10 min. To the emulsions was added phenyl isocyanate-modified gelatin and each emulsion was desalted to remove soluble salts. After desalting, gelatin was further added thereto in an amount of 15 g per mol of silver, the pH was adjusted to 5.7 and the emulsion was redispersed at 55° C. for 30 min. The EAg of emulsions were each 190 mV at 40° C.

Solution A:

| | |
|---|---|
| Silver nitrate | 16 g |
| Nitric acid (5%) | 5.3 ml |
| Deionized water | 48 ml |

Solution B:

| | |
|---|---|
| NaCl | 3.8 g |
| KBr | 3.5 g |
| Ossein gelatin | 1.7 g |
| Deionized water | 48 ml |

Solution C:

| | |
|---|---|
| NaCl | 1.4 g |
| Ossein gelatin | 7 g |
| Nitric acid (5%) | 6.5 ml |
| $K_2RhCl_5(H_2O)$ | 0.06 mg |
| Deionized water | 700 ml |

Solution D:

| | |
|---|---|
| Silver nitrate | 154 g |
| Nitric acid (5%) | 4.5 ml |
| deionized water | 200 ml |

Solution E:

| | |
|---|---|
| NaCl | 37 g |
| KBr | 33 g |
| Ossein gelatin | 6 g |
| $K_2RhCl_5(H_2O)$ | 0.04 mg |
| Deionized water | 200 ml |

To each of the resulting emulsion were added 4-hydroxy-6-methyl-1,3,3a,7-tetrazaindene of $1.5\times10^{-3}$ mol per mol of silver and potassium bromide of $8.5\times10^{-4}$ mol per mol of silver and the pH and EAg were adjusted to 5.6 and 123 mV, respectively. Further thereto were added flower of sulfur of $2\times10^{-5}$ mol (as sulfur atoms) and chloroauric acid of $1.5\times10^{-5}$ mol, and chemical ripening was carried out at 60° C. for a period of 80 min. After completing chemical ripening were added 4-hydroxy-6-methyl-1,3,3a,7-tetrazaindene of $2\times10^{-3}$ mol per mol of silver, 1-phenyl-5-mercaptotetrazole of $3\times10^{-4}$ per mol of silver and potassium iodide of $1.5\times10^{-3}$ mol per mol of silver. The emulsion was cooled down to 40° C. and further thereto was added a sensitizing dye (VIII-1) of $1\times10^{-3}$ mol per mol of silver.

Preparation of silver halide emulsion B:

A silver halide emulsion B was prepared in the same manner as emulsion A, except that the amount of $K_2RhCl_5(H_2O)$ of Solution C was changed to 0.10 mg and a reaction temperature was varied to 40° C., and $AgCl_{70}Br_{30}$ emulsion with an average grain size of 0.25 μm and a variation coefficient of grain size of 15% was obtained. Thereafter, the emulsion was chemically and spectrally sensitized in the same manner as in emulsion A.

Preparation of photographic material:

On one side of a subbed support were simultaneously coated a redox compound layer, a light insensitive hydrophilic colloid layer, a silver halide emulsion layer, an interlayer and a protective layer in this order from the support. After setting, on the other side of the support, a backing layer and a backing protective layer in this order from the support were simultaneously coated and set in the same manner as in Example 1. Both sides were simultaneously dried to obtain photographic material samples 301 to 306.

Redox compound layer

| | |
|---|---|
| Silver halide emulsion B | 0.3 g/m$^2$ (based on silver) |
| Gelatin | 0.3 g/m$^2$ |
| Saponin | 60 mg/m$^2$ |

Redox compound, as shown in Table 3

Light insensitive hydrophilic colloid layer

| | |
|---|---|
| Gelatin | 0.9 g/m$^2$ |
| Dye f-5 (solid particle dispersion) | 30 mg/m$^2$ |
| Latex L-AB | 0.3 g/m$^2$ |
| Sodium dodecylbenzenesulfonate | 20 mg/m$^2$ |

Silver halide emulsion layer:

| | |
|---|---|
| Gelatin | 1.7 g/m$^2$ |
| Silver halide emulsion A | 3.3 g/m$^2$ (based on silver) |
| Hydrazine H-7 | 5 mg/m$^2$ |
| Nucleation accelerating agent Na-12 | 3 mg/m$^2$ |
| Latex, as shown in Table 3 | |
| Sodium iso-amyl-n-decylsulfosuccinate | 2 mg/m$^2$ |
| Sodium naphthalenesulfonate | 8 mg/m$^2$ |
| Saponin | 20 mg/m$^2$ |
| 2-Mercapto-6-hydroxypurine | 2 mg/m$^2$ |
| 2-Mercaptopyridine | 1 mg/m$^2$ |
| Ascorbic acid | 20 mg/m$^2$ |
| EDTA (Ethylenediaminetetraacetic acid) | 25 mg/m$^2$ |
| Poly(sodium styrenesulfonate) | 15 mg/m$^2$ |

Composite polymeric material as shown in Table 3
The pH of the coating solution was 5.4.

Interlayer:

| | |
|---|---|
| Gelatin | 0.3 g/m$^2$ |
| Latex, as shown in Table 3 | |
| Sodium dodecylbenzenesulfonate | 20 mg/m$^2$ |

Protective layer:

| | |
|---|---|
| Gelatin | 0.8 g/m$^2$ |
| Sodium iso-amyl-n-decylsulfosuccinate | 12 mg/m$^2$ |
| Matting agent, PMMA (av. size, 3 μm) | 25 mg/m$^2$ |
| Hydroquinone | 50 mg/m$^2$ |
| Lubricant R-21 | 45 mg/m$^2$ |
| Latex, as shown in Table 3 | |
| Composite polymeric material, PL-10 (average particle size 0.18 μm), as shown in table 3 | |
| 1,3-Vinylsulfonyl-2-propanol | 40 mg/m$^2$ |
| Hardener h1 | 30 mg/m$^2$ |
| Poly(sodium styrenesulfonate) | 10 mg/m$^2$ |
| Fungicide z | 0.5 mg/m$^2$ |

Dye f5

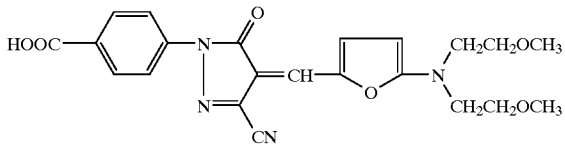

S-1

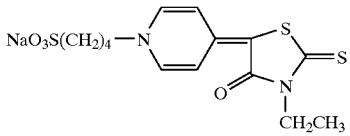

Evaluation of samples:

Samples each were closely brought into contact with a step wedge and exposed to tungsten light with 3200° K. for 3 sec. and processed by a processor and sensitometrically measured in the same manner as in Example 1. The sensitivity was shown as a relative value, based on the sensitivity of Sample 301 being 100. Samples were also evaluated with respect to black spots and abrasion marks in the same manner as in Example 1. Results thereof are shown in Table 3.

TABLE 3

| Sample No. | Redox layer | Emulsion layer | | Inter-layer | | Protective layer | | Sensitivity | γ | Black spot | Abrasion mark | Remark |
|---|---|---|---|---|---|---|---|---|---|---|---|---|
| 301 | None | PL-10<br>L-F | (0.7)*<br>(0.75) | L-AB | (0.2) | PL-10<br>R-21<br>Mat.** | (0.3)<br>(30)<br>(12.5) | 100 | 15 | 5 | 4 | Inv. |
| 302 | No. 22 | PL-10<br>L-F | (0.7)<br>(0.75) | L-AB | (0.2) | PL-10<br>R-21<br>Mat. | (0.3)<br>(30)<br>(12.5) | 95 | 15 | 4 | 5 | Inv. |
| 303 | No. 22 | PL-15<br>L-F | (0.7)<br>(0.25) | — | | PL-15<br>R-21<br>Mat. | (0.3)<br>(30)<br>(12.5) | 120 | 22 | 4 | 3 | Inv. |
| 304 | No. 22 | PL-15<br>L-F | (0.7)<br>(0.75) | DOP | (0.2) | PL-15<br>R-21<br>Mat. | (0.3)<br>(30)<br>(12.5) | 120 | 22 | 4 | 4 | Inv. |
| 305 | No. 22 | PL-15<br>L-F | (0.7)<br>(0.25) | L-AB | (0.2) | PL-21<br>Mat. | (30)<br>(12.5) | 120 | 21 | 5 | 5 | Inv. |
| 306 | No. 21 | Silica<br>L-F | (0.7)<br>(075) | L-AB | (0.2) | R-21<br>Silica<br>Mat. | (30)<br>(0.3)<br>(12.5) | 120 | 21 | 2 | 2 | Comp. |

*Values in parentheses indicate amounts in $g/m^2$ of latexes or composite materials, or $mg/m^2$ of R-21 or a matting agent
**Mat.: Matting agent (amorphous silica, 8 μm)
DOP: Di-n-octyl phthalate
Silica: Colloidal silica

Example 4

Preparation of silver halide emulsion (C1):

Silver bromochloride core grains containing 70 mol % chloride and having an average size of 0.09 μm was prepared by a double jet method. During the course of forming the core grains, there were added $K_3Rh(NO)_4(H_2O)_2$ of $7\times10^{-8}$ mol per mol of silver and $K_3OsCl_6$ of $8\times10^{-6}$ mol per mol of silver, while being maintained at a temperature of 40° C., a pH of 3.0 and EAg of 165 mV.

The EAg was lowered to 125 mV and the core grains were further covered with a shell by a double jet method. During the course of forming the shell, there were added $K_2IrCl_6$ of $3\times10^{-7}$/Ag mol and $K_3RhCl_6$ of $9\times10^{-8}$ mol/Ag mol. Silver iodide fine grains were further added thereto to form an emulsion comprising monodispersed (variation coefficient of 10%), silver iodobromochloride cubic grains containing 70 mol % chloride and having an average size of 0.15 μm and containing 90 mol % chloride and 0.2 mol % iodide. The emulsion was desalted using a modified gelatin described in JP-A 2-280139 (phenylcarbamoyl gelatin, in which an amino group contained in the gelatin was substituted by phenylcarbamyl, e.g., G-8 compound exemplified in JP-A 2-280139). After desalting, the EAg of the emulsion was proved to be 190 mV at 50° C.

To the resulting emulsion was added 4-hydroxy-6-methyl-1,3,3a,7-tetrazaindene of $1.5\times10^{-3}$ mol/Ag mol. After adding thereto potassium bromide and citric acid to adjust the pH and EAg to 5.6 and 123 mV, respectively and further adding sodium p-toluenethiosulfonate (Chloramine T) of $1\times10^{-3}$ mol/Ag mol, the emulsion was chemically ripened at 55° C. by adding sulfur ($S_8$) in the form of a solid particle dispersion (which was prepared by adding water to its methanol solution and dispersing therein, having an average particle size of 3 μm) and chloroauric acid of $1.5\times10^{-5}$ mol. After completing the ripening, a sensitizing dye (d-1) of 100 mg and trihexylamine of 5 mg was added. Then the temperature was lowered to 40° C., 4-hydroxy-6-methyl-1,3,3a,7-tetrazaindene of $2\times10^{3}$ mol/Ag mol. 1-phenyl-5-mercaptotetrazole of $3\times10^{-4}$ mol/Ag mol and potassium iodide of $5\times10^{-3}$ mol/Ag mol was further added and the pH was adjusted to 5.1 with citric acid.

Preparation of silver halide emulsions (C2):

Silver halide emulsions C2 was prepared in the same manner as the silver halide emulsion C1, except that the addition amount of the Rh complex salt to the shell portion was changed to $6\times10^{-8}$ mol/Ag mol and reaction temperature was raised to 50° C. The resulting emulsion with an average grain size of 0.19 mm was chemically sensitized in the same manner as emulsion C1. Emulsion C2 was proved to have a sensitivity higher by 40% than that of emulsion C1.

Preparation of photographic material containing a hydrazine compound for use in plate-making scanner:

On one side of a subbed support were coated the following gelatin sublayer, silver halide emulsion layer-1, silver halide emulsion layer-2 and emulsion protective layer in this order from the support. On the other side of the support were further coated a backing layer and backing protective layer to prepare Samples 401 to 404.

Gelatin sublayer composition:

| | |
|---|---|
| Gelatin | 0.45 $g/m^2$ |
| Saponin | 56.5 $mg/m^2$ |
| Sodium polystyrenesulfonate (MW.500,000) | 15 $mg/m^2$ |
| Fungicide z | 0.5 $mg/m^2$ |

Silver halide emulsion layer-1:

| | |
|---|---|
| Gelatin | 0.65 $g/m^2$ |
| Silver halide emulsion C1 | 1.5 $g/m^2$ (based on silver) |
| Sensitizing dye d-1 | 200 mg/Ag mol |
| Hydrazine compound H-1 | $2\times10^{-3}$ mol/Ag mol |
| Amine compound AM-1 | 7 $mg/m^2$ |
| Redox compound No.21 | 70 $mg/m^2$ |
| Compound a | 100 $mg/m^2$ |
| 2-Pyridinol | 1 $mg/m^2$ |
| Polymer latex L1 (av. size 0.25 μm) | 0.25 $g/m^2$ |
| Hardener h3 | 5 $mg/m^2$ |
| Sodium iso-amyl-n-decylsulfosuccinate | 0.7 $g/m^2$ |
| Sodium naphthalenesulfonate | 8 $mg/m^2$ |
| Saponin | 20 $mg/m^2$ |
| Hydroquinone | 20 $mg/m^2$ |
| 2-Mercapto-6-hydroxypurine | 2 $mg/m^2$ |
| 2-Mercaptopyrimidine | 1 $mg/m^2$ |

-continued

| | |
|---|---|
| Colloidal silica (av. size 0.05 μm) | 150 mg/m$^2$ |
| Ascorbic acid | 20 mg/m$^2$ |
| EDTA | 25 mg/m$^2$ |
| Poly(sodium styrenesulfonate) | 15 mg/m$^2$ |

The pH of a coating solution was 5.2.

The redox compound was dispersed in the following manner.

Dispersing method of the redox compound:

| | |
|---|---|
| Redox compound | 2 g |
| Ethyl acetate | 80 g |

According to the above formula, the redox compound was dissolved and the resulting solution was mixed with an aqueous gelatin solution.

| | |
|---|---|
| 10% TK-AX (product of Takemoto Yushi Corp.) | 6 g |
| 15% gelatin aqueous solution | 180 g |

The mixture was preliminarily dispersed at 40° C. for 5 min. by a homogenizer and further dispersed. Then ethyl acetate was removed under reduced pressure of 30 mmHg and water was added to make the total amount of the dispersion 280 g.

Silver halide emulsion layer-2:

| | |
|---|---|
| Gelatin | 0.65 g/m$^2$ |
| Silver halide emulsion C2 | 1.5 g/m$^2$ (based on silver) |
| Sensitizing dye d-2 | 300 mg/m$^2$ |
| Hydrazine compound H-2 | $4 \times 10^{-3}$ mol/Ag mol |
| Amine compound AM-1 | 7 mg/m$^2$ |
| Redox compound No.21 | 70 mg/m$^2$ |
| Sodium iso-amyl-n-decylsulfosuccinate | 1.7 mg/m$^2$ |
| 2-Mercapto-6-hydroxypurine | 1 mg/m$^2$ |
| Nicotinic acid amide | 1 mg/m$^2$ |
| Propyl gallate | 50 mg/m$^2$ |
| Mercaptopyrimidine | 1 mg/m$^2$ |
| EDTA | 50 mg/m$^2$ |
| Copolymer of styrene-maleic acid (MW 70,000) | 10 mg/m$^2$ |
| Latex L2 (compound described in JP-A 5-66512, Example 3, type Lx-3 composition) | 0.25 g/m$^2$ |
| Colloidal silica (av. size 0.05 μm) | 150 mg/m$^2$ |

Composite polymeric material, as shown in Table 4

As the gelatin was used phthalated gelatin. The pH of a coating solution was 4.8.

Emulsion protective layer:

| | |
|---|---|
| Gelatin | 1.3 g/m$^2$ |
| Amine compound AM-14 | 14 mg/m$^2$ |
| Sodium iso-amyl-n-decylsulfosuccinate | 12 mg/m$^2$ |
| Matting agent (PMMA, av size 3.5 μm) | 25 mg/m$^2$ |
| Amorphous silica (av. size 8 μm) | 12.5 mg/m$^2$ |
| Surfactant S1 | 26.5 mg/m$^2$ |
| Lubricant (silicone oil) | 4 mg/m$^2$ |
| Compound a | 50 mg/m$^2$ |
| Polymer latex L4 (av. size 0.10 μm) | 0.25 g/m$^2$ |
| Colloidal silica (av. size 0.05 μm) | 150 mg/m$^2$ |
| Dye f1 | 20 mg/m$^2$ |
| 1,3-vinylsulfonyl-2-propanol | 40 mg/m$^2$ |
| Hardener h1 | 30 mg/m$^2$ |
| Poly(sodium styrenesulfonate) | 10 mg/m$^2$ |
| Fungicide z | 0.5 mg/m$^2$ |
| Composite polymeric compound (Table 4) | 0.2 mg/m$^2$ |

Backing layer:

| | |
|---|---|
| Gelatin | 0.6 g/m$^2$ |
| Sodium iso-amyl-n-decylsulfosuccinate | 5 mg/m$^2$ |
| Polymer latex L3 (av. size 0.10 μm) | 0.3 g/m$^2$ |
| Colloidal silica (av. size 0.05 μm) | 100 mg/m$^2$ |
| Poly(sodium styrenesulfonate) | 10 mg/m$^2$ |
| Dye f1 | 65 mg/m$^2$ |
| Dye f2 | 15 mg/m$^2$ |
| Dye f3 | 100 mg/m$^2$ |
| 1-Phenyl-5-mercaptotetrazole | 10 mg/m$^2$ |
| Hardener h2 | 100 mg/m$^2$ |
| Composite polymeric material (Table 4) | 0.4 mg/m$^2$ |
| Zinc hydroxide | 50 mg/m$^2$ |
| EDTA | 50 mg/m$^2$ |

Backing protective layer:

| | |
|---|---|
| Gelatin | 0.4 g/m$^2$ |
| Matting agent (PMMA, av. size 5 μm) | 50 mg/m$^2$ |
| Amorphous silica | 12.5 mg/m$^2$ |
| Sodium di-(2-ethylhexyl)sulfosuccinate | 10 mg/m$^2$ |
| Surfactant S1 | 1 mg/m$^2$ |
| Dye f1 | 65 mg/m$^2$ |
| Dye f2 | 15 mg/m$^2$ |
| Dye f3 | 100 mg/m$^2$ |
| Compound a | 50 mg/m$^2$ |
| Hardener h1 | 20 mg/m$^2$ |
| Poly(sodium styrenesulfonate) | 10 mg/m$^2$ |

Z

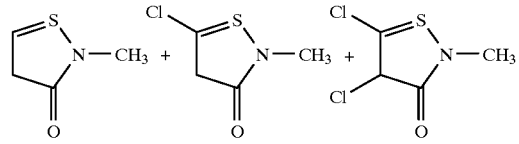

d-1

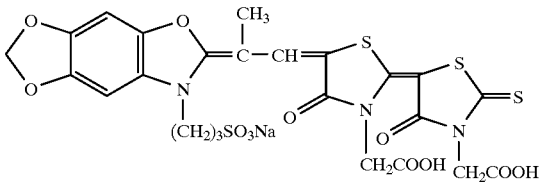

Compound a

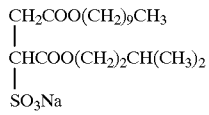

L1

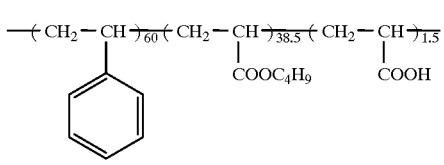

AM-1

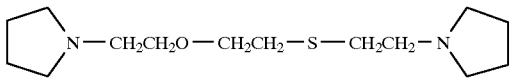

-continued d-2

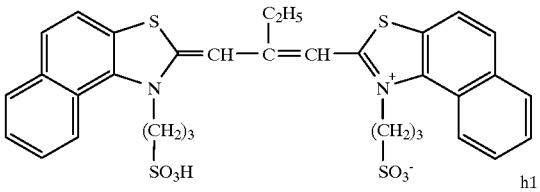

h1

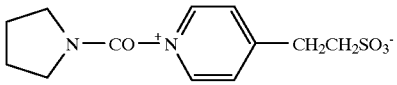

S1

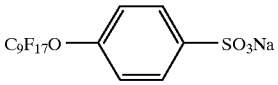

SF2

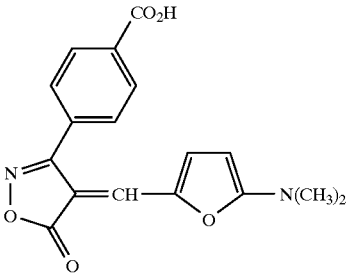

L3

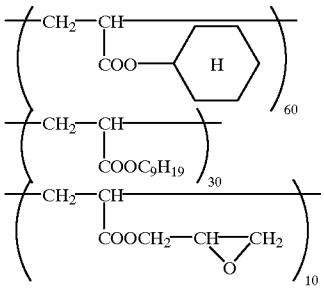

L4

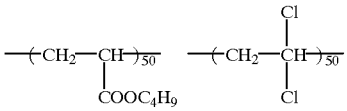

f1

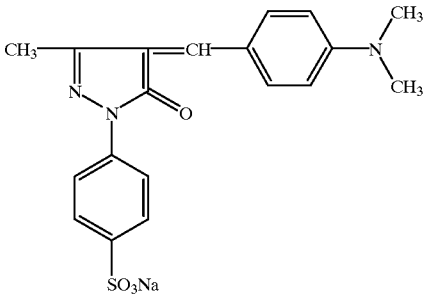

f2

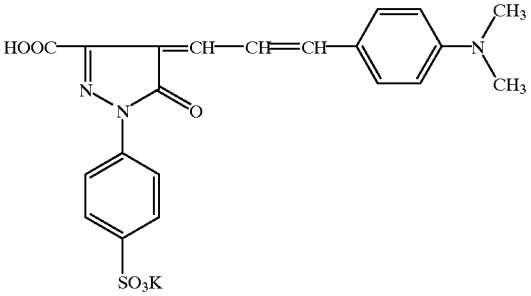

-continued f3

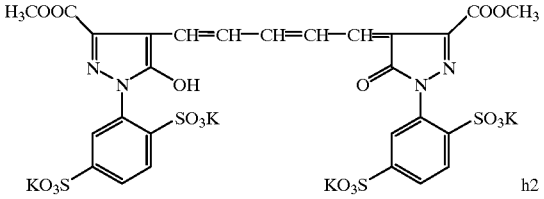

h2

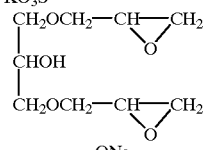

h3

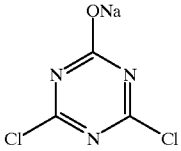

Thus prepared samples each were exposed and processed in the same manner as in Example 1

The sensitivity was shown as a relative value, based on the sensitivity of Sample 401 being 100. The contrast (γ) was referred to as the slope of a straight line that connects two points corresponding to densities 1.0 and 3.0.

Samples were also evaluated with respect to abrasion mark, crack and dryability. Crack and dryability was evaluated in the following manner.

Evaluation of crack:

After being allowed to stand at 55° C. under completely dried conditions over a period of 3 days, samples were visually evaluated with respect to crack, based on the following criteria.

5: No crack was observed.

4: Crack was slightly observed.

3: Little crack was observed, but no problem in practical use

2: Crack was apparently observed and problem in practical use

1: Crack was observed overall

Evaluation of dryability:

When a processed sample came out from a drying section, its drying state was visually evaluated based on the following criteria.

5: Completely dried

4: Slightly wetted, but samples do not stick with each other.

3: Wetted, lower level of practical use.

2: Remarkably wetted, and samples stick with each other

1: Level outside o practical use

Results thereof are shown in Table 4.

TABLE 4

| Sample No. | Emulsion layer ($g/m^2$) | Protective layer ($g/m^2$) | Backing layer ($g/m^2$) | Sensitivity | γ | Abrasion mark | Crack | Dryability |
|---|---|---|---|---|---|---|---|---|
| 401 | PL-10 (0.2) | PL-10 (0.2) | PL-10 (0.4) | 100 | 25 | 4 | 4 | 4 |
| 402 | PL-15 (0.2) | PL-15 (0.2) | PL-15 (0.4) | 105 | 25 | 5 | 5 | 5 |
| 403 | PL-19 (0.2) | PL-19 (0.2) | PL-19 (0.4) | 100 | 22 | 5 | 4 | 5 |
| 404 | Silica (0.2) | Silica (0.2) | Silica (0.4) | 100 | 25 | 2 | 2 | 3 |

What is claimed is:

1. A silver halide photographic light sensitive material comprising a support having, on one side thereof, component layers including a silver halide emulsion layer and light insensitive hydrophilic colloidal layer, wherein at least one of the component layers contains a composite polymeric material comprising inorganic particles and a hydrophobic polymer, said silver halide emulsion layer comprising a silver halide emulsion containing silver halide grains which have an average chloride content of not less than 60 mol % and contain at least one selected from the group consisting of rhodium, rhenium, ruthenium and osmium.

2. The silver halide photographic material of claim 1, wherein said inorganic particles are comprised of an oxide of a metal selected from the group consisting of Na, K, Ba, Al, Zn, Fe, Cu, Ti, Sn, In, W, Y, Sb, Mn, Ga, V, Nb, Tu, Ag, Bi, B, Si, Mo, Ce, Cd, Mg, Be, Ca, Zr, and Pb.

3. The silver halide photographic material of claim 2, wherein said metal oxide is selected from the group consisting of $SiO_2$, $TiO_2$, ZnO, $SnO_2$, MgO, $MnO_2$, $Fe_2O_3$, $ZnSiO_4$, $Al_2O_3$, $BeSiO_4$, $Al_2SiO_5$, $ZrSiO_4$, $CaWO_4$, $CaSiO_3$, $InO_2$, $SnSbO_2$, $Sb_2O_5$, $Nb_2O_5$, $Y_{23}$, $CeO_2$, $Sb_2O_3$ and $Na_2O$.

4. The silver halide photographic material of claim 1, wherein said hydrophobic polymer comprises a hydrophobic monomer selected from the group consisting of acrylates, methacrylates, vinyl esters, olefines, styrenes, crotonates, itaconic acid diesters, maleic acid diesters, fumaric acid diesters, allyl compounds, vinyl ethers, vinyl ketones, vinyl heterocyclic compounds, glycidyl esters, and unsaturated nitriles.

5. The silver halide photographic material of claim 1, wherein said composite material is in the form of particles having an average size of 0.005 to 3.0 $\mu$m.

6. The silver halide photographic material of claim 1, wherein said at least one of the component layers or another component layer contains a hydrazine compound.

7. The silver halide photographic material of claim 6, wherein said at least one of the component layers or another component layer contains a redox DIR compound capable of releasing a development inhibitor upon being oxidized.

8. The silver halide photographic material of claim 1, wherein a total coating amount of gelatin of the emulsion layer side is not more than 3.6 g per $m^2$ of the photographic material.

9. The silver halide photographic material claim 8, wherein said the total coating amount of gelatin of the emulsion layer side (A) and a total amount of said composite material, expressed in $g/m^2$ (B) meet the following requirement:

$1.0 \leqq A/B \leqq 17.5$.

10. The silver halide photographic material of claim 1, wherein said at least one of the component layers or another component layer contains a lubricant.

11. The silver halide photographic material described of claim 1, wherein said at least one of the component layers or another component layer contains a water soluble polymer.

12. The silver halide photographic material described of claim 1, wherein said at least one of the component layers or another component layer contains a latex.

13. The silver halide photographic material of claim 1, wherein said at least one of the component layers or another component layer contains an oleophilic compound.

14. The silver halide photographic material of claim 1, wherein said at least one of the component layers or another component layer contains a matting agent.

* * * * *